US006604641B2

(12) United States Patent
Wolf et al.

(10) Patent No.: US 6,604,641 B2
(45) Date of Patent: Aug. 12, 2003

(54) LOW-POWER ELECTRICALLY OPERATED COUPLER

(75) Inventors: Michael Paul Wolf, Highland, MD (US); David L. Krebiehl, St. Joseph, MI (US); Scott B. Long, Portland, OR (US)

(73) Assignee: Mike's Train House, Inc., Columbia, MD (US)

( * ) Notice: Subject to any disclaimer, the term of this patent is extended or adjusted under 35 U.S.C. 154(b) by 0 days.

(21) Appl. No.: 10/237,066

(22) Filed: Sep. 9, 2002

(65) Prior Publication Data

US 2003/0001051 A1 Jan. 2, 2003

Related U.S. Application Data

(62) Division of application No. 09/731,048, filed on Dec. 7, 2000, now Pat. No. 6,457,681.

(51) Int. Cl.[7] ..... B61G 5/00
(52) U.S. Cl. ..... 213/75 TC; 213/75 D
(58) Field of Search ..... 310/12, 15, 14, 310/23; 213/75 R, 75 TC, 75 D

(56) References Cited

U.S. PATENT DOCUMENTS

| | | | | |
|---|---|---|---|---|
| 1,766,329 A | | 6/1930 | Caruso | |
| 1,887,988 A | | 11/1932 | Boisselier | |
| 1,982,692 A | | 12/1934 | Queeney | 104/151 |
| 1,997,748 A | | 4/1935 | Rosenthal | 104/151 |
| 2,013,947 A | | 9/1935 | Boisselier | 104/151 |
| 2,077,163 A | | 4/1937 | Bailey | 104/149 |
| 2,221,963 A | | 11/1940 | Case et al. | 104/151 |
| 2,247,418 A | | 7/1941 | Smith | 246/31 |
| 2,257,473 A | | 9/1941 | McKeige et al. | 104/150 |
| 2,383,411 A | * | 8/1945 | Obszarny | 335/261 |
| 2,606,281 A | | 8/1952 | Thomas et al. | 246/29 |
| 2,622,542 A | | 12/1952 | Bonanno | 104/150 |
| 2,658,629 A | * | 11/1953 | Pettit | 213/211 |
| 2,826,996 A | | 3/1958 | Smith | 104/150 |
| 2,830,148 A | | 4/1958 | Barger | 200/87 |
| 2,882,834 A | | 4/1959 | Smith | 104/150 |
| 2,963,985 A | | 12/1960 | Palmer et al. | 104/151 |
| 3,010,055 A | * | 11/1961 | Nicolaus | 335/262 |

(List continued on next page.)

FOREIGN PATENT DOCUMENTS

| | | |
|---|---|---|
| DE | 2361538 | 6/1975 |
| DE | 2425427 | 12/1975 |
| DE | 2738820 | 3/1979 |

(List continued on next page.)

OTHER PUBLICATIONS

"Is Astrac on the right track?", Linn H. Westcott, Dec. 1963, pp. 10–11 and 33–37.
"Lionel E–Units", pp. 231–234.
"Introducing the CTC–16: A 16–channel command control system you can build", Keith Gutierrez, Part 1, Model Railroader, Dec. 1979, PP. 64–67.

(List continued on next page.)

*Primary Examiner*—Mark T. Le
(74) *Attorney, Agent, or Firm*—McDermott, Will & Emery

(57) ABSTRACT

An electrically operated coupler includes a knuckle movable between an open position and a closed position, a plunger mechanically couplable to the knuckle, and a solenoid having a central hollow portion for receiving at least a portion of the plunger, at least a portion of the solenoid includes ferromagnetic material adapted to define at least a portion of a magnetic circuit for driving the plunger. The movable plunger includes a cap configured to engage the knuckle at a locking position of the plunger for locking the knuckle in the closed position. The solenoid drives the movable plunger toward or away from the locking position and a guide member guides the cap toward and away from the locking position.

16 Claims, 24 Drawing Sheets

U.S. PATENT DOCUMENTS

| | | | | | |
|---|---|---|---|---|---|
| 3,024,375 | A | * | 3/1962 | Tyzack | 310/24 |
| 3,166,684 | A | * | 1/1965 | Williams | 310/339 |
| 3,211,111 | A | | 10/1965 | Morley | 104/149 |
| 3,220,356 | A | | 11/1965 | Leslie | 104/151 |
| 3,293,549 | A | | 12/1966 | Patterson | 325/64 |
| 3,315,613 | A | | 4/1967 | Leslie | 104/151 |
| 3,363,109 | A | | 1/1968 | Wilhelm | 307/12 |
| 3,400,488 | A | | 9/1968 | Phillpott et al. | 46/244 |
| 3,425,009 | A | * | 1/1969 | Voigt | 335/177 |
| 3,425,156 | A | | 2/1969 | Field | 46/232 |
| 3,448,307 | A | * | 6/1969 | Duris | 310/23 |
| 3,529,216 | A | | 9/1970 | Kolm et al. | 317/147 |
| 3,553,450 | A | | 1/1971 | Ernst | 246/32 |
| 3,555,270 | A | | 1/1971 | Persson | 246/194 |
| 3,587,100 | A | | 6/1971 | Sparta et al. | 343/225 |
| 3,639,755 | A | | 2/1972 | Wrege | 246/187 B |
| 3,664,060 | A | | 5/1972 | Longnecker | 46/232 |
| 3,699,522 | A | | 10/1972 | Haner. Jr. | 340/171 R |
| 3,705,387 | A | | 12/1972 | Stern et al. | 340/171 A |
| 3,736,484 | A | | 5/1973 | Reynolds et al. | 318/587 |
| 3,810,099 | A | | 5/1974 | Woods | 340/171 R |
| 3,839,822 | A | | 10/1974 | Rexford | 46/232 |
| 3,883,839 | A | * | 5/1975 | Barrett et al. | 338/116 |
| 3,955,129 | A | | 5/1976 | Wagner et al. | 318/55 |
| 3,964,701 | A | | 6/1976 | Kacerek | 246/2 F |
| 3,994,237 | A | | 11/1976 | Thomsen | 104/149 |
| 4,010,409 | A | | 3/1977 | Waites | 318/587 |
| 4,085,356 | A | | 4/1978 | Meinema | 318/331 |
| 4,204,200 | A | | 5/1980 | Beyl, Jr. | 340/384 E |
| 4,207,569 | A | | 6/1980 | Meyer | 343/6.5 R |
| 4,219,962 | A | | 9/1980 | Dankman et al. | 46/232 |
| 4,247,107 | A | | 1/1981 | Smith, III et al. | 273/86 B |
| 4,270,226 | A | | 5/1981 | Weintraub et al. | 455/353 |
| 4,307,302 | A | | 12/1981 | Russell | 307/40 |
| 4,325,199 | A | | 4/1982 | McEdwards | 46/232 |
| 4,334,221 | A | | 6/1982 | Rosenhagen et al. | 340/825.72 |
| 4,335,381 | A | | 6/1982 | Palmer | 340/825.21 |
| 4,341,982 | A | | 7/1982 | Lahti et al. | 318/51 |
| 4,349,196 | A | | 9/1982 | Smith, III et al. | 273/1 GC |
| 4,358,691 | A | * | 11/1982 | Naylor | 310/12 |
| 4,390,877 | A | | 6/1983 | Curran | 340/825.72 |
| 4,481,661 | A | | 11/1984 | Spector | 381/61 |
| 4,572,996 | A | | 2/1986 | Hanschke et al. | 318/341 |
| 4,613,103 | A | | 9/1986 | Waranowitz | 246/473 A |
| 4,620,280 | A | | 10/1986 | Conklin | 364/426 |
| 4,711,418 | A | | 12/1987 | Aver, Jr. et al. | 246/5 |
| 4,723,737 | A | | 2/1988 | Mimoun | 246/2 S |
| 4,747,351 | A | | 5/1988 | Baret | 104/297 |
| 4,914,368 | A | | 4/1990 | Orton | 318/663 |
| 4,914,431 | A | | 4/1990 | Severson et al. | 340/825.69 |
| 4,929,949 | A | | 5/1990 | Yamamoto et al. | 341/176 |
| 4,933,980 | A | | 6/1990 | Thompson | 381/61 |
| 4,964,837 | A | | 10/1990 | Collier | 446/409 |
| 5,012,236 | A | | 4/1991 | Troyk et al. | 340/825.54 |
| 5,024,626 | A | | 6/1991 | Robbins et al. | 446/409 |
| 5,045,016 | A | | 9/1991 | Stern et al. | 446/409 |
| 5,050,505 | A | | 9/1991 | Konno | 104/295 |
| 5,061,905 | A | | 10/1991 | Truchsess | 331/47 |
| 5,073,750 | A | | 12/1991 | Coron | 318/58.7 |
| 5,085,148 | A | | 2/1992 | Konno | 104/130 |
| 5,085,610 | A | | 2/1992 | Engel et al. | 446/175 |
| 5,088,955 | A | | 2/1992 | Ishimoto | 446/409 |
| 5,146,153 | A | | 9/1992 | Luchaco et al. | 323/324 |
| 5,174,216 | A | | 12/1992 | Miller et al. | 104/296 |
| 5,184,048 | A | | 2/1993 | Severson et al. | 318/280 |
| 5,195,920 | A | | 3/1993 | Collier | 446/409 |
| 5,201,641 | A | * | 4/1993 | Richer | 417/417 |
| 5,241,487 | A | | 8/1993 | Bianco | 364/569 |
| 5,251,856 | A | | 10/1993 | Young et al. | 246/4 |
| 5,263,670 | A | | 11/1993 | Colbaugh et al. | 246/63 R |
| 5,267,318 | A | | 11/1993 | Severson et al. | 381/51 |
| 5,297,484 | A | | 3/1994 | Piserchia et al. | 105/1.5 |
| 5,306,197 | A | | 4/1994 | Watanabe | 446/409 |
| 5,394,068 | A | | 2/1995 | Severson et al. | 318/280 |
| 5,441,223 | A | | 8/1995 | Young et al. | 246/4 |
| 5,448,142 | A | | 9/1995 | Severson et al. | 318/280 |
| 5,492,290 | A | | 2/1996 | Quinn et al. | 246/219 |
| 5,555,815 | A | | 9/1996 | Young et al. | 104/296 |
| 5,590,856 | A | | 1/1997 | Quinn et al. | 246/219 |
| 5,633,985 | A | | 5/1997 | Severson et al. | 395/2.76 |
| 5,749,547 | A | | 5/1998 | Young et al. | 246/4 |
| 5,773,939 | A | | 6/1998 | Severson et al. | 318/51 |
| 5,832,431 | A | | 11/1998 | Severson et al. | 704/258 |
| 5,896,017 | A | | 4/1999 | Severson et al. | 312/280 |
| 5,940,005 | A | | 8/1999 | Severson et al. | 340/825.52 |
| 6,014,934 | A | | 1/2000 | Pierson | 105/26.05 |
| 6,281,606 | B1 | | 8/2001 | Westlake | 307/125 |

FOREIGN PATENT DOCUMENTS

| | | |
|---|---|---|
| DE | 3309662 A1 | 9/1984 |
| GB | 1436814 | 5/1976 |
| GB | 2014770 A | 8/1979 |
| SE | 7801499-0 | 9/1979 |

OTHER PUBLICATIONS

"The CTC–16: A command control system you can build", Keith Gutierrez, Part 2, Model Railroader, Jan. 1980, pp. 86–93.

CTC–16: A command control system you can build, Keith Gutierrez, Part 3, Model Railroader, Feb. 1980, pp. 89–92.

"The CTC–16: A command control system you can build", Keith Gutierrez, Part 4, Model Railroader, Mar. 1980, pp. 89–93.

"CTC–16: A command control system you can build", Keith Gutierrez, Part 5, Model Railroader, Apr. 1980, pp. 71–77.

"The CTC–16: Epilogue", Richard C. Kamm et al., Model Railroader, Dec. 1980, pp. 132–136 (pp. 54–55 from Mar. 1991).

"Build the wireless throttle: 1", Keith Gutierrez, Mar. 1983, Model Railroader, pp. 86–95.

"Build the wireless throttle: 2", Keith Gutierrez, Apr. 1983, Model Railroader, PP. 68–75.

"Commercial Command Control Systems", Andy Sperandeo, Model Railroader, Nov. 1979, pp. 80–81.

"$\mu$P—programmable speed controller for model railways", W. Pussel, elektor, Jul./Aug. 1979, pp. 7–84 – 7–85.

"The Digital Model Train –Part 1", T. Wigmore, Elektor Electronics, Feb. 1989, pp. 42–46.

"The Digital Model Train –Part 2", T. Wigmore, Elektor Electronics, Mar. 1989, pp. 50–53.

"The Digital Model Train –Part 3", T. Wigmore, Elektor Electronics, Apr. 1989, pp. 14–18.

"The Digital Model Train –Part 4", T. Wigmore, Elektor Electronics, May 1989, 99. 16–17.

"The Digital Model Train –Part 5", T. Wigmore, Elektor Electronics, Jul./Aug. 1989, pp. 56–59.

"The Digital Model Train –Part 6", T. Wigmore, Elektor Electronics, Sep. 1989, pp. 44–47.

"The Digital Model Train –Part 7", T. Wigmore, Elektor Electronics, Oct. 1989, pp. 21–24.

"The Digital Model Train –Part 8", T. Wigmore, Elektor Electronics, Nov. 1989, pp. 32–36.

"The Digital Model Train Part 9: Keyboards", T. Wigmore, Elektor Electronics, Dec. 1989, pp. 24–28.

"The Digital Model Train Part 10—RS232 Interface", T. Wigmore, Elektor Electronics, Jan. 1990, pp. 38–43.
"The Digital Model Train Part 11—The Monitor Unit", T. Wigmore, Elektor Electronics, Feb. 1990, pp. 53–55.
"The Digital Model Train Part 12—Address Display", T. Wigmore, Elektor Electronics, Mar. 1990, pp. 52–54.
"The Digital Model Train Concluding Part", T. Wigmore, Elektor Electronics, 1990, pp. 24–26.
"Please Climb Aboard!", marklin Digital Ho, 1985/86 E, pp. 1–16.
"Everything is Digital", marklin Digital, 1988/1989 E, pp. 1–8.
"100 Years of Model Railroading", marklin, New Items 1991, pp. 1–32.
"Everything operates digitally", marklin, 1990/91 E, pp. 1–15.

* cited by examiner

LOW-POWER ELECTRICALLY OPERATED COUPLER

This application is a divisional of application Ser. No. 09/731,048 filed Dec. 7, 2000, now U.S. Pat. No. 6,457,681.

FIELD OF THE INVENTION

The present invention is directed to a new control, sound and operating system for model toys and vehicles, and in particular for model train and railroad systems. The present invention contains a number of inventive features for model trains as well, including new coupler and smoke unit designs.

BACKGROUND OF THE INVENTION

Model trains have had a long and illustrious history. From the earliest model trains to the present, one of the primary goals of model train system designers has been to make the model train experience as realistic as possible for the user.

The typical model train has an electric motor inside the train that operates from a voltage source. The voltage is sent down the model tracks where it is picked up by the train's wheels and rollers, then transferred to the motor. A power source supplies the power to the tracks. The power source can control both the amount (amplitude) and polarity (direction) of the voltage, so that the user may control both the speed and direction of the train. Some systems use a DC voltage applied to the track. In others, the voltage is an AC voltage, and is usually the 60 Hz AC voltage available from standard U.S. wall outlets. In these systems, a transformer is necessary to reduce the amount of voltage provided to the system.

Using the above-described system, an early method of operating model trains is now referred to as "legacy" mode. As the user increases or decreases the amount of voltage applied to the track through manipulation of a throttle on the power source, the train will gain or lose speed as it travels along the track. This is a straightforward operation whereby the user directly controls the amount of voltage applied to the train's motor. Such a mode of operation requires the user to constantly monitor and adjust the amount of voltage applied to the tracks. For example, a train approaching a curve in the track may de-rail if the train is moving too fast. The user must therefore reduce the amount of voltage received by the train's motor by cutting back on the power source throttle prior to the train reaching the curve. Similar situations may occur elsewhere on the track layout, such as when the train approaches an upgrade (which may require the user to increase the amount of voltage applied) or when the train is attached to a heavy load.

In addition to being able to control the speed and direction of model trains, early train systems enabled the user to operate a whistle (or horn) and later a bell located on the train. In AC-powered systems, this was done by applying a DC offset voltage superimposed on the AC voltage applied to the track. In later systems, the train had circuitry that distinguished between the polarities of the DC offset voltage. Thus, for example, the whistle (or horn) would blow when a +DC offset voltage was applied to the track, and the bell would ring when a −DC offset voltage was applied. Typically, the user would press a "horn" or "bell" button located on the power source to effect the desired sound.

It should be apparent that the above-described system provided the user with only limited control over the operation of the train, and further required constant manual manipulation of the power source in order to maintain the train on the track layout. Later-developed systems therefore attempted to address these shortcomings and thereby increase the realism of the model train experience.

Two examples of such systems include those disclosed in U.S. Pat. No. 5,251,856 to Young et al., and Marklin's Digital line of model trains. These systems enabled the user to have remote control operation of the train. This was accomplished by inserting a control unit between the power source and the tracks. The control unit responded to commands entered by the user on a hand-held remote control. These types of systems generally utilized microprocessor technology. A microprocessor or receiver located in the model trains would have a unique digital address associated with it. The user would enter the train's address and a command for the train on the remote control, such as "stop," "blow whistle," "change direction," and so on. The address and commands would be implemented as infra-red (IR) or radio frequency (RF) signals. The control unit would receive the commands and pass the commands through the tracks in digital form, where the model train corresponding to the entered address would pick up the command. The microprocessor inside the model train would then execute the entered command. For example, if the user had entered a command such as "turn on train light," the microprocessor would send a signal to the light driver circuit located inside the train, and the light driver circuit would turn on the light.

In the aforementioned U.S. Pat. No. 5,251,856, the user is able to control the speed of the train through the remote control. This is accomplished through the use of a triac switch located inside the control unit. The power source is set to a maximum desired level. In response to input from the user, the triac switch inside the control unit switches the AC waveform from the power source at appropriate times to control the AC power level and impose a DC offset. The speed of the trains will then change in accordance with the change in power applied to the track. The aforementioned Marklin system, on the other hand, controls the speed of the trains by use of pulse width modulation (PWM) and full-wave rectifier circuits located inside the train. The duty factor of the output signal from the PWM circuit varies between 0 and 15/16 at a frequency that is 1/16 of a counter frequency that remains constant. This allows the user a 16-step speed control for each train.

Many other advances have been made in model trains beyond those described here. For example, U.S. Pat. No. 4,914,431 to Severson et al. describes the use of a state machine in the train that increases the number of control signals available to the user for control over train features such as sound volume, couplers, directional state, and various sound features. U.S. Pat. No. 5,448,142 discloses, among other things, ways to improve the quality and realism of sounds made by the train during operation. Still, further advances in the area of model trains are desirable, in order to approach the desired goal of realism during operation.

SUMMARY OF THE INVENTION

The present invention provides a model train operating, sound and control system that provides a user with operating realism beyond that found in prior art systems. The present invention provides a number of new and useful features in order to achieve this goal.

One feature of the present invention is a novel two-way remote control communication capability between the user and the model trains. This feature is accomplished by using a handheld remote control on which various commands may be entered, and a Track Interface Unit that retrieves and processes the commands. The Track Interface Unit converts the commands to modulated signals (preferably spread spectrum signals) which are sent down the track rails. The model train picks up the modulated signals, retrieves the entered command, and executes it through use of a processor and associated control and driver circuitry. The process may also be reversed, so that operating information regarding the train is provided back to the user for display on the remote control.

Another feature of the present invention is a speed control circuit located on the printed circuit board inside the model train that is capable of continuously monitoring the operating speed of the train and making adjustments to a motor drive circuit. Through this circuit, precise and accurate scale miles-per-hour speed may be continuously maintained by the model train, even as the train goes up and down hills or around curves.

Still another feature of the present invention is the ability to connect the Track Interface Unit to an external source, such as a computer, CD player, or other sound source, and have real-time sounds stream down the model train tracks for playing through the speakers located in the model train. This feature enables a user to actually have a song or other recorded sound "played" by the model train as it travels around the tracks. A microphone embodiment is also disclosed, whereby the user's voice may be played out through the model train speakers in real time.

Another feature of the present invention is a new coupler design and circuit that enables the activation of electric couplers to be achieved at very low voltage. This feature allows coupler firing in the model train environment to more closely match the operating conditions of couplers on real trains. This is particularly important when operating in "legacy" mode, where low voltage is directly related to low speed, thereby providing more realistic operation.

Yet another feature of the present invention is a smoke unit circuit design that allows smoke (or steam) output to be controlled by the user. In this way, smoke and steam output from the model train can be synchronized to match the operating condition of the train. For example, as the train picks up speed, the amount of smoke or steam output would increase accordingly. Or, if the load on the train increases, a larger amount of smoke will be outputted indicative of the additional power required to move the train. In addition, the smoke puffs let out by the train can be synchronized with the rotation of the wheels and thereby reflect train speed. For example, the smoke unit circuit can be controlled so that each ¼ rotation of the train wheels will result in one smoke "puff". Also, the smoke unit circuit can be controlled to "stream" smoke continuously, even at zero velocity, as do real-life steamer-type trains. Even further, the volume of smoke output can be automatic in relation to train conditions, or it can be manually controlled by the user.

Many other features are described herein. For example, sounds may be synchronized to the model train operation, such as engine "chuff" sounds. The present invention provides the capability of the model train simulating the Doppler effect as the train approaches and passes by. A series of operating commands may be recorded by the user for precise play-back at another time. Customized sounds may be recorded so that users can have the model train play their own unique sounds. Sounds and information may be downloaded (and uploaded) through the Internet via a computer or information appliance hookup to the TIU (additional examples include telephones, PDAs, or other devices capable of providing information). Many different accessories (track lights, track switches, crossing gates, etc.) may be controlled by the user on the remote control through use of an Accessory Interface Unit, also described herein.

The complete invention is described below, and in the corresponding claims.

DETAILED DESCRIPTION OF THE PREFERRED EMBODIMENTS

The present invention provides a control system that allows the user to operate multiple trains on the same track and under independent operating instructions. The present invention also allows a user to operate different trains on the same track in different modes of operation. For example, a user may operate one or more trains in "command" mode, which refers to the present invention's use of digital signals to operate the model train equipped with the inventive features described herein. At the same time, a user may operate one or more trains on the track in the aforementioned "legacy" mode. Finally, other trains on the track may operate in "conventional" mode, which is similar to legacy mode but which takes advantage of certain features of the present invention to improve the operation of the train.

Overview

Figure 1:
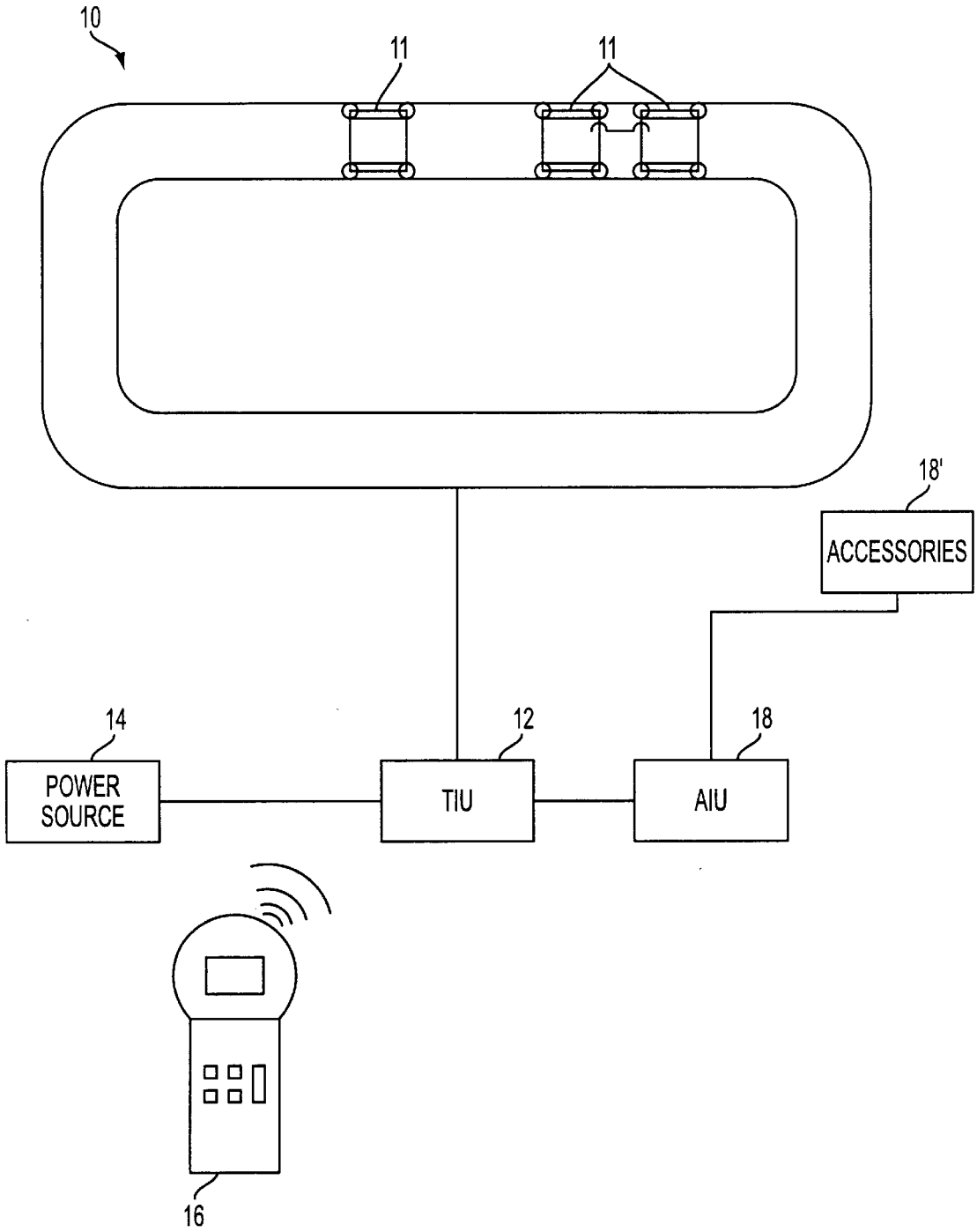
FIG. 1 shows one exemplary embodiment of the basic elements of the control system of the present invention.

FIG. 1 shows the basic components of the control system of the present invention. The track layout 10 is coupled to a Track Interface Unit (TIU) 12, which in turn is coupled to an Accessory Interface Unit (AIU) 18. The AIU is connected to any number of train layout accessories (shown generically as Accessories 18' in FIG. 1). The TIU 12 is connected to a power source 14, which may be any type of AC or DC voltage source, such as a transformer. In this embodiment, the power source 14 provides AC voltage and is plugged into a standard wall outlet (not shown). Also shown in FIG. 1 is a hand-held remote control 16. The user inputs commands on the remote control 16 in order to control the operation of the train(s) 11 on the track layout 10. The command mode of operation will be explained next.

In command mode, the train(s) 11 on the track ignore the voltage that is applied to the tracks with respect to speed settings. Instead, the train(s) 11 respond only to digital speed command signals entered by the user. In command mode, therefore, the power source 14 is typically set to approximately maximum voltage and left there.

The user enters the desired commands on the remote control 16. These commands are relayed to the TIU 12 by RF signals in the preferred embodiment, although it should be understood that any form of wireless transmission, including IR signaling, would also be acceptable. The TIU 12 has circuitry (explained more fully below) that receives the RF signals containing the commands, and other circuitry that converts the signals into modulated signals.

The present invention utilizes "spread spectrum" signaling as the preferred mode of communicating commands from the user to the model train(s) 11. Other modulation types are also acceptable and considered to be within the scope of the present invention. Spread spectrum signalling, however, has been determined to be the preferred method. Generally, in spread spectrum signaling, the signal is coded and the bandwidth of the transmitted signal is made larger than the minimum bandwidth required to transmit the information being sent.

Spread spectrum signaling is desirable in the present context because model train layouts generally are a noisy operating environment. When a narrow bandwidth is used to transmit a signal, there is the possibility that, due to noise, fading, or other interference, and the signal will be lost. Spread spectrum signaling substantially eliminates this risk. The details of the spread spectrum signalling used in the present invention will be described in detail below.

For illustrative purposes, the rest of the description herein will refer to spread spectrum signalling when referring to the communication method employed. It is contemplated, however, that other modulation methods could also be used, as described above.

Returning to the description of the command mode of operation, the TIU 12 transmits the spread spectrum signals out over the track layout 10. in other words, the signals are actually passed down the rail(s) of the track. The TIU 12 also provides power to the tracks from the power source 14. Thus, both track power (in the form of AC voltage) and the commands are sent out by the TIU 12 to the track layout 10 through the track rail(s).

The train(s) 11 on the track layout 10 have an engine board inside that contains a microprocessor and other circuitry, as will be described below. In simplest terms, the engine board in the train(s) 11 will receive the spread spectrum signals from the TIU 12 and execute any commands addressed to it. The train(s) 11 then performs the command entered by the user.

In command mode, each model train 11 has a unique digital address associated with it (along with a "universal address" that, if inputted, would send the command to all the trains). The user enters the address on the remote control 16 and the command that the user desires that particular train 11 to perform. Only the train 11 whose address has been entered will respond to the command.

Through this arrangement, multiple trains 11 may be independently controlled and operated by the user through use of the remote control 16. As a non-limiting example, a user may command train #1 to accelerate to a desired speed and turn on its lights; command train #2 to announce its impending arrival at the next station and to stop at that station; and command train #3 to reverse direction, slow down and fire its coupler in order to prepare to connect to a box car consist. The present invention allows for all three trains 11 to execute their respective commands independently of each other, while a constant AC voltage is applied to the track. Two or more trains 11 can function on the same track, at different speeds, even though the track voltage is the same and is controlled by the single power source 14 via the TIU 12.

Users can also operate one or more trains 11 on the track layout 10 in conventional mode. In this mode, the user varies the track voltage by manipulating the power source 14 (either manually or by remote control). A train 11 operating in conventional mode will respond to the change in track voltage by slowing down or speeding up. If more than one train 11 is operating in conventional mode, each will respond at the same time to the variance in track voltage being applied by the power source 14. Thus, independent operation of trains 11 in conventional mode is not possible.

However, the present invention allows the user to have one or more trains 11 operating in command mode and one or more trains 11 operating in conventional mode on the same track layout 10. Those train(s) 11 equipped with the novel engine board shown in FIG. 4 will operate in command mode if the user so desires as described above in response to commands entered by the user on the remote control 16. Those train(s) 11 operating in conventional mode will respond to changes in the track voltage effected by the user through the power source 14. The train(s) 11 in command mode will continue to execute the commands entered by the user without regard for the change in track voltage (subject to operational limits), and the train(s) 11 in conventional mode will respond only to changes in track voltage, oblivious to the spread spectrum signals applied to the tracks for the command mode train(s) 11. This allows older trains and trains of different manufacturers to operate alongside the inventive train disclosed herein on the same track layout.

Figure 2:
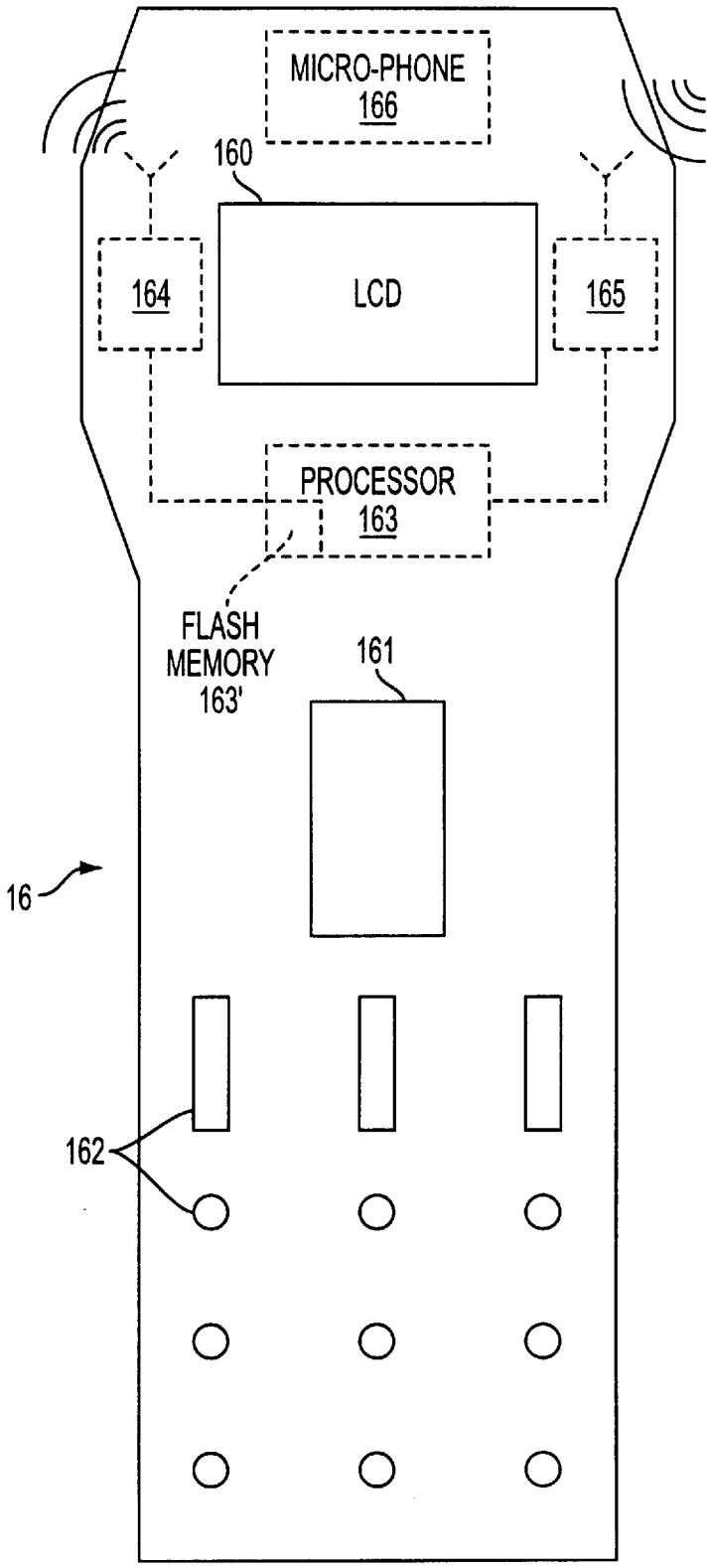
FIG. 2 shows one exemplary embodiment of the hand-held remote control of the present invention.

FIG. 2 shows one embodiment of the remote control 16 in more detail. It should be understood that the embodiment shown in FIG. 2 is merely exemplary, and any number of different remote control functions/designs may be used. In FIG. 2, the remote control 16 has an LCD display 160, a thumb-wheel 161, and various push buttons 162. The user enters commands by pressing a particular push-button 162 (or a predetermined series of push-buttons 162) dedicated to a particular command, or by using the thumb-wheel 161 to scroll through a menu that appears on the LCD display 160 to select the desired command. The remote control 16 is preferably battery operated and is controlled by a processor 163. One acceptable processor 163 is part number M30624FGLFP sold by Mitsubishi. It should be understood that other processors or hard-wired circuitry could be used. The remote control 16 also has a wireless transmitter, such as the illustrated RF transceiver 164 and antenna 165. The processor 163 in the remote control 16 monitors the inputs from the user and from the RF antenna 165 for any changes and updates the display accordingly.

As previously stated, the remote control 16 communicates with the TIU 12 as shown in FIG. 1. When the remote control processor 163 is required to send a command to the TIU 12, it does so through the RF transceiver 164. In one embodiment, the RF transceiver 164 operates in approximately the 900 MHz band using "ook" (on/off keying) modulation, although it would be recognized by those of skill in the art that other methods of communication could be used. The processor 163, via the transceiver 164, sends an RF signal that contains the command entered by the user.

Figure 3:
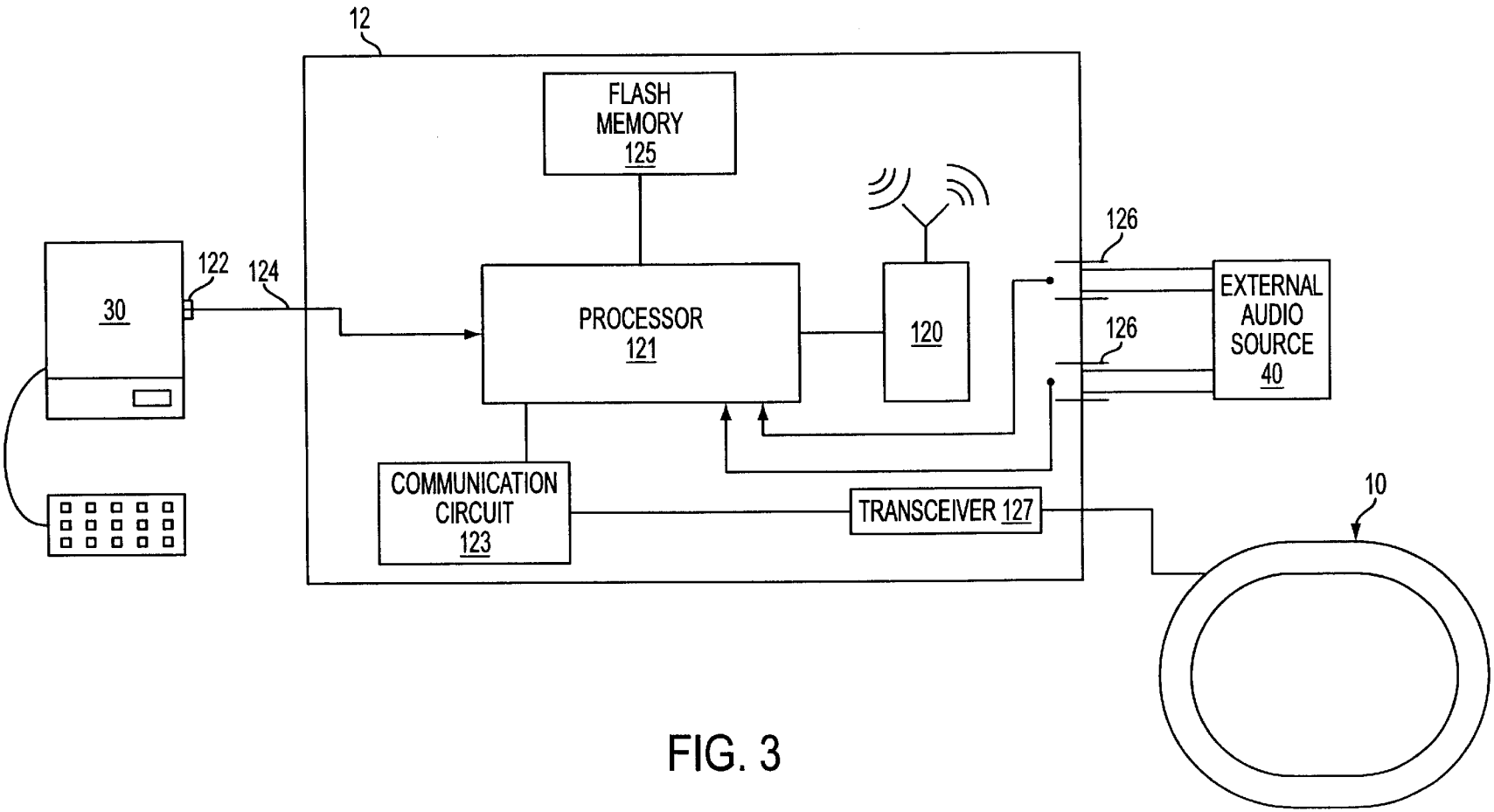
FIG. 3 shows one exemplary embodiment of the Track Interface Unit of the present invention.

The TIU 12 is shown in more detail in FIG. 3. The TIU 12 has a transceiver 120 that communicates with the transceiver 164 and antenna 165 located in the remote control 16. Thus, in one embodiment the transceiver 120 is a 900 MHz band 9600 baud ook transceiver, although it should be understood that other transceiver configurations could be used. Further, an IR receiver could be used if the remote control 16 is transmitting IR signals, or any other wireless transceiver may also be acceptable depending on the wireless communication scheme implemented by the manufacturer.

The transceiver 120 receives the RF signal containing the command issued from the remote control 16. The transceiver 120 passes the RF signal to a processor 121 that controls the TIU 12. One suitable processor is part number M30624FGLFP manufactured by Mitsubishi, although other processors are also acceptable. The processor 121 decodes the command from the RF signal and issues an "acknowledgment packet" to the transceiver 120 for communication back to the remote control 16. The acknowledgment packet is used to inform the remote control 16 that the command was successfully received by the TIU 12.

The processor 121 in the TIU 12 extracts the command from the RF signal and passes it to the communication circuit 123 for conversion into spread spectrum format (as described below). The communication circuit 123 then passes the spread spectrum signal to a transmitter 127 for outputting the spread spectrum signal to the track layout 10 via conventional wiring. The spread spectrum signal is mixed with the AC voltage provided to the tracks from the TIU 12 via the power source 14. It is contemplated that the processor may be capable of generating the spread spectrum signalling itself (such as a "system on a chip"), and in such an embodiment the communication circuit 123 would not be necessary.

In an alternate embodiment, it is possible for the user to communicate commands to the TIU 12 through use of a computer 30. In this embodiment, the TIU 12 is connected to the computer 30 through a standard RS232 port 122 (or other suitable data port) and cable 124. The commands normally entered on the remote control 16 are entered through a computer program executed by the computer 30. The ability to write such a program is well within the expertise of a person of ordinary skill in the art of computer programming, and therefore no description of such a program is required herein. In the computer embodiment, the operation of the TIU 12 and other elements of the invention remains the same.

Figure 4:
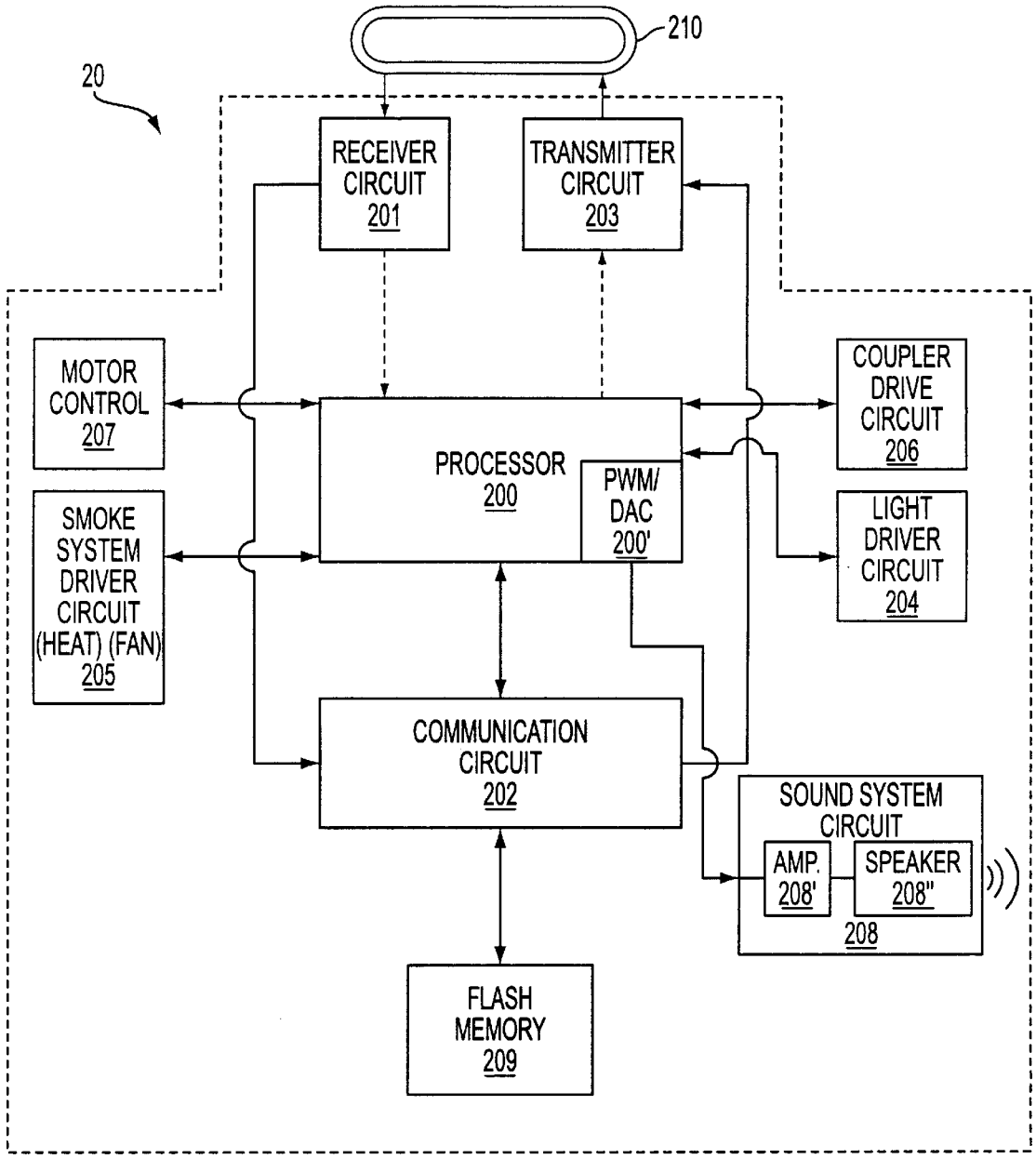
FIG. 4 shows one exemplary embodiment of the printed circuit board located on the model train(s)

The model train(s) 11 will be described next with reference to FIG. 4. The model train 11 has a printed circuit board 20 installed inside, which is shown in FIG. 4 in block diagram form. The printed circuit board 20 has a processor 200 at the center of the model train's operations. The processor 200 is connected to a receiver circuit 201 that picks the spread spectrum signals off from the train track rails in the preferred embodiment. The receiver circuit 201 passes the spread spectrum signals to a communication circuit 202. The communication circuit 202, in one embodiment, correlates the spread spectrum signals into a fixed data pattern that is capable of being recognized by the processor 200. When correlation is achieved, the data pattern is outputted by the communication circuit 202 to the processor 200. In an alternate embodiment, it is contemplated that the processor 200 is capable of converting the spread spectrum signals itself, and/or is able to detect the command data from the spread spectrum signals (for example, a system on a chip). In these embodiments, the communication circuit 202 is not necessary.

The processor 200, upon receiving the data pattern containing the command, outputs an acknowledge signal to the communication circuit 202. The communication circuit 202 converts the acknowledge signal to spread spectrum format and outputs the acknowledge spread spectrum signal to a transmitter circuit 203. Alternatively, the processor 200 outputs an acknowledge signal in spread spectrum format itself directly to the transmitter circuit 203. In this alternate embodiment, the communication circuit 202 is once again not necessary. In either embodiment, the transmitter circuit 203 places the acknowledge spread spectrum signal on the train track rails, where it is picked up by the TIU 12. The TIU processor 121 then converts the acknowledge spread spectrum signal into an RF signal, which the TIU transceiver 120 outputs to the remote control 16.

In this way, there is "handshake" capability between the TIU 12, model train printed circuit board 20, and remote control 16. The reason for such bi-directional capability is that it allows the data about the model train 11 to be received by the user. Such data may include, but is not limited to, the type of train 11 (diesel or steam), the digital address of the model train 11, consist information, the actual speed of the train 11, the types and amount of lights, whether there is a smoke unit present, the types of couplers, the various sound capabilities, the amount of memory available for sounds, the amount of voltage, current, and power the train 11 is using, and other such information. Thus, the TIU 12 and remote control 16 maintain all necessary, relevant information concerning the model train(s) 11 and their operation during use. This information is available to the user in order to enhance the user's enjoyment and realistic operation of the model train(s) 11.

Spread Spectrum Signalling

A description of the preferred embodiment of the present invention, wherein commands are transmitted by the user to the model train through spread spectrum signalling, will now be described. It should be understood that the following description describes one method of employing spread spectrum signalling. Other methods of spread spectrum signalling may also be used, and are considered within the scope of the present invention. The following description should therefore be considered illustrative, not limiting.

The present invention, in its preferred embodiment, uses spread spectrum signalling because model trains generally operate in a "noisy" electrical environment. Spread spectrum signalling utilizes an increased bandwidth technique in order to protect the integrity of the original signal and prevent the original signal from being distorted or changed by electric noise in the operating environment.

The operation is as follows. The user enters a command on the remote control 16 to be carried out by the model train 11. The command is transmitted by the remote control 16 through radio frequency signals (or, in alternate embodiments, any other type of wireless transmission) to the TIU 12. The transceiver 120 in the TIU 12 receives the command and passes it to the processor 121 (FIG. 3). The processor 121 converts the command into a data transfer packet which contains a data stream representing the command. Each command will be prefaced with a preamble (typically one byte long) that is a fixed series of digital "1"s and "0"s. The preamble is used to achieve code and bit synchronization prior to receiving data. The data stream is therefore a series of digital bits ("1" and "0"). A typical command may comprise 4 to 8 bytes of data. During streaming sound operation (described in detail below), the typical sound packet may be much larger, on the order of 32 bytes. It should be understood, however, that the present invention comprehends and encompasses within the claims hereto commands of any size and length.

The data transfer packet is then passed by the processor 121 to the communication circuit 123. The communication circuit 123 is used in the preferred embodiment to transmit and receive spread spectrum signals.

The communication circuit 123 receives the data transfer packet and converts each databit in the data transfer packet into 31 "chips." Thus, the chipping rate is 31 times the data rate. The chips make up a pseudo-noise (P-N) code. The P-N code is a series of 31 "1"s and "0"s. The P-N code is fixed and does not change. Thus, each databit "1" in the data transfer packet is converted into the same 31-bit P-N code. The databit "0"s are converted into the P-N code in inverted fashion; that is, if the first four chips of the P-N code are 0-1-1-0, for example, the first four chips of the P-N code inverted are 1-0-0-1.

A simple four-byte command, 32 data bits, in the data transfer packet is therefore converted into 992 chips, which means that it takes 992 chip times for a 4-byte command to be output by the communication circuit 123. In the preferred embodiment, the chipping rate is 3.75 MHz. The actual data rate is thus 3.75 MHz divided by 31, or 121 KHz.

The communication circuit 123 passes the P-N codes to a transceiver 127 (the transceiver may be a part of the communication circuit or a separate element) that continually outputs the P-N codes representing the databits in the data transfer packet. This process continues until the data transfer packet has been sent. At that point, the transceiver 127 is turned off, and no further P-N codes are transmitted. The P-N codes are coupled to the track 10 in streaming fashion.

The foregoing description represents the "transmitting" side of the spread spectrum signalling embodiment. What follows is a description of the "receiving" side. The receiver circuit 201 on the printed circuit board 20 (FIG. 4) located inside the model train 11 picks up the P-N codes from the track. The receiver circuit 201 passes the P-N codes to the communication circuit 202.

Figure 15A:
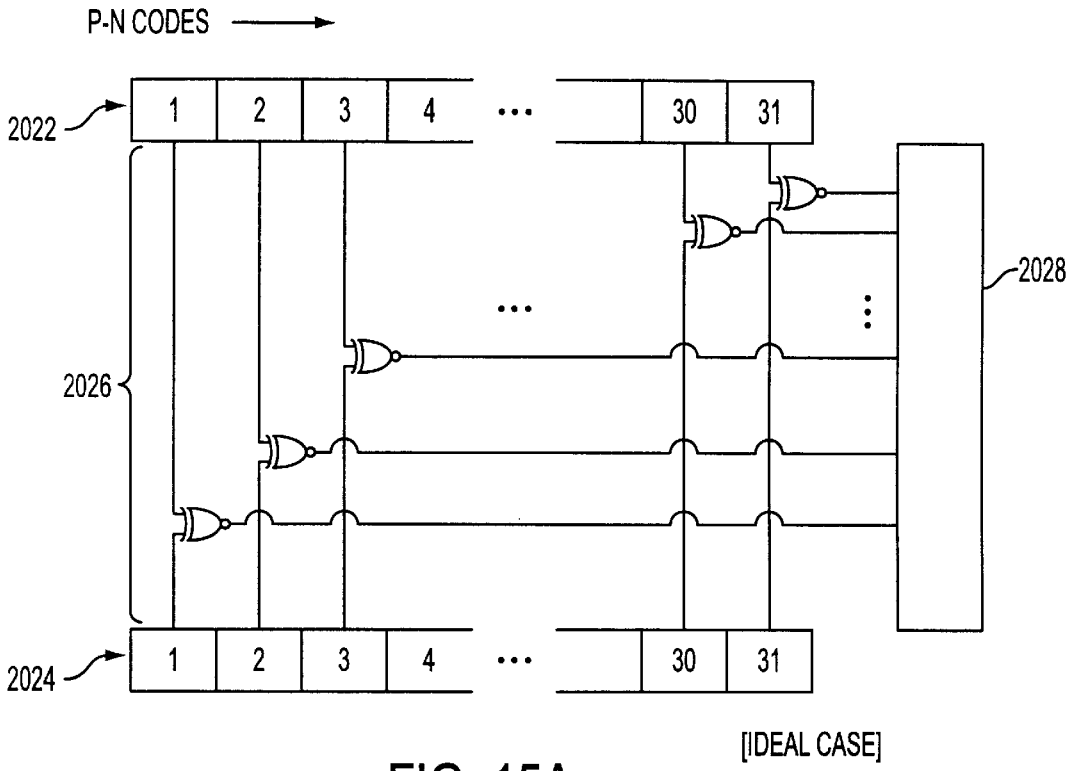
FIG. 15*a* shows a logic diagram of a spread spectrum signal decoder in an ideal environment.

Inside the communication circuit 202 is a 31 bit shift register 2022 (see FIG. 15*a*). As the P-N codes come into the communication circuit 202 at the chipping rate of 3.75 MHz, they are shifted through the 31 bit shift register 2022.

Parallel to the 31 bit shift register 2022, there is a 31 bit memory 2024 that is permanently loaded with the original 31 bit P-N code in normal, noninverted fashion. (The 31 bit memory 2024 can be any structure capable of permanently retaining the P-N code, such as another, fixed 31 bit shift register or a suitable hard-wired configuration). Between the 31 bit shift register 2022 and the 31 bit memory 2024 are a series of exclusive-or (XOR) gates (collectively labelled 2026). The inputs to the first XOR gate are the first stage of the 31 bit shift register 2022 and the first stage of the 31 bit memory 2024. The inputs to the second XOR gate are the second stage of the 31 bit shift register 2022 and the second stage of the 31 bit memory 2024, and so on. The XOR gates output a "1" when the inputs are different, and output a "0" when the inputs are the same. There are 31 XOR gates 2026, corresponding to the 31 bits in each of the 31 bit shift register 2022 and the 31 bit memory 2024.

An adder 2028 is connected to the 31 XOR gates 2026. The adder 2028 counts the outputs of the XOR gates 2026 in order to determine how many of the outputs from the XOR gates were "0". The output from the adder 2028 is therefore a number from 0 to 31; for example, if the output from the adder is 14, the communication circuit 202 knows that the output at 14 of the XOR gates was "0".

As the data is clocked through the 31 bit shift register 2022, the outputs from the XOR gates 2026 will change with each clock pulse. Accordingly, the output from the adder 2028 will also change. When the P-N codes in the 31 bit shift register 2022 match the P-N codes in the 31 bit memory 2024, the outputs of the XOR gates 2026 will all be "0" and the output of the adder 2028 will therefore be 31. At this point, the communication circuit 202 determines that the incoming data is correlated, i.e., the communication circuit 202 is now synchronized with the incoming data.

The communication circuit 202 now knows that every 31st clock pulse will be a databit in the original data transfer packet. The communication circuit 202 thereafter samples the output of the adder 2028 at every 31st clock pulse after correlation. This is done by summing the outputs of the XOR gates 2026. If the total is 16 or greater, the communication circuit 202 determines that the original databit in the data transfer packet was a "0". If the total of the outputs from the XOR gates is 15 or less, the communication circuit determines that the original databit was a "1". The reasoning for this is as follows: the P-N code loaded into the 31 bit memory 2024 corresponds to a databit "1". The more matches there are between the P-N codes passing through the 31 bit shift register 2022 and the 31 bit memory 2024, the more likely it is that the original databit was a "1". Because a match at the inputs of the XOR gates results in the XOR gate outputting a zero, if the P-N codes in the 31 bit shift register 2022 exactly match the P-N code in the 31 bit memory 2024, the outputs of all 31 XOR gates will be zero and the sum of the outputs of the XOR gates will also be zero. The communication circuit 202 would therefore know that the original databit representing a portion of the command was a "1". Thus, a majority of matches from the XOR gates results in a total sum of the outputs being 15 or less. The communication circuit 202 interprets that result to be a databit "1". A minority of matches, in contrast, results in the total sum of the outputs of the XOR gates being 16 or higher, which the communication circuit 202 will determine to be a databit "0".

In this fashion, the communication circuit 202 constructs the original information in the data transfer packet in binary form. When the communication circuit 202 reads a series of "1"s and "0"s that corresponds to the preamble, the communication circuit 202 then knows that the remaining "1"s and "0"s represent the command entered by the user. The communication circuit 202 provides the command to the processor 200. The processor 200 thereafter takes whatever action is necessary that corresponds to the command (as discussed in more detail below).

The foregoing description of the spread spectrum signalling embodiment represents the ideal case. In actual practice, there is noise on the rails and in the operating environment that can distort or change the values of the P-N codes. Recognizing that digital "1"s and "0"s are actually simply some voltage value, it is common for electrical noise to change the voltage value of a binary signal to the point that it is indeterminant or false, that is, opposite of what it should be. Moreover, in the real world environment there are not instantaneous changes from 1 to 0. Instead, there is a transition region from 1 to 0 and from 0 to 1 wherein the value is indeterminant. Sampling a signal during the transition region can result in faulty data. The end result with respect to all these problems is that the communication circuit 202 may believe it is synchronized when in fact it is not, or it may not detect synchronization. Obviously, this is undesirable, as it can result in the entered command not being performed.

To overcome this problem, the preferred embodiment of the present invention takes several precautions. First, the threshold for determining correlation between the P-N codes in the 31 bit shift register 2022 and the 31 bit memory 2024 is set to less than 31; a non-limiting example may be 28. Thus, if the outputs of the XOR gates 2026 are such that at least 28 of the P-N codes in the 31 bit shift register 2022 match the P-N code in the 31 bit memory 2024, the communication circuit 202 will consider itself synchronized to the incoming data stream.

Another problem that must be overcome concerns the clock rate. The phase of the clock signal is not known by the communication circuit 202. In other words, data (P-N codes) could be shifting into the 31 bit shift register 2022 right when the P-N codes are in a transition region as described above. In the transition region, the data is in effect undefined. Therefore, there is the possibility that undefined data is being sampled out of the 31 bit shift register 2022.

Figure 15B:
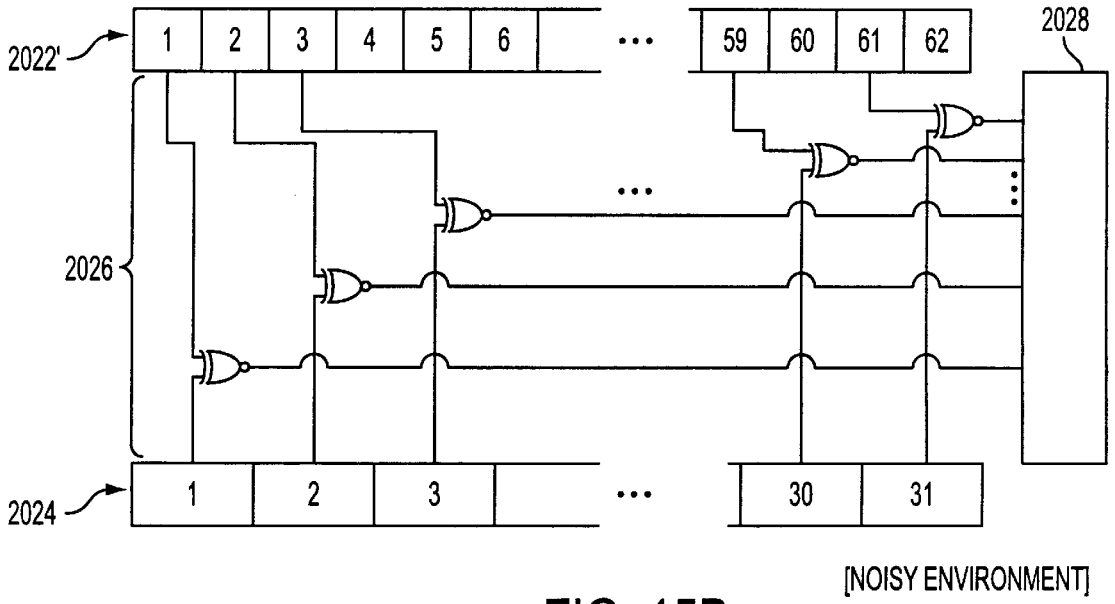
FIG. 15*b* shows a logic diagram of a spread spectrum signal decoder in a noisy operating environment.

In order to solve this problem, the 31 bit shift register in the ideal case is replaced with a 62 bit shift register 2022' (see FIG. 15*b*) that operates at twice the chipping rate; i.e., data is shifted into the 62 bit register 2022' at a rate of 7.5 MHz. This in effect means that for any given stage in the 62 bit shift register 2022', the next stage is 180 degrees out of phase. By this arrangement, if data is being clocked into one stage of the 62 bit shift register 2022' during transition, the same data will be clocked into the next stage when it is stable. The 62 bit shift register 2022' therefore functions like two 31 bit shift registers: stages 1, 3, 5, . . . 61 of the 62 bit shift register 2022' act like one 31 bit shift register, and stages 2, 4, 6, . . . 62 act like another 31 bit shift register that is 180 degrees out of phase with the first.

The 62 bit shift register 2022' is wired to the 31 XOR gates 2026 as explained above, except that only odd shift register outputs are used and the XOR gates 2026 provide an output at twice the rate of that described in the ideal condition. The outputs of the XOR gates 2026 are monitored by the adder 2028 to determine when the predetermined number (in the above example, 28) of matches occurs in order to determine synchronization.

In operation then, the communication circuit 202 will therefore determine when syncronization occurs by looking for 28 out of 31 matches. It should be apparent that when synchronization occurs, the communication circuit 202 thereafter monitors the outputs of the XOR gates 2026 after 62 clock cycles of the 7.5 MHz clock. The procedure then is the same as described in the ideal case for clocking in the remainder of the data and determining the original command entered by the user.

The communication circuits 123 and 202 in the TIU 12 and the engine board 20 of the model train 11 respectively are capable of both receiving and transmitting spread spectrum signals in the above fashion. Therefore, once the processor 200 in the model train 11 determines what the command is, the processor 200 assembles an acknowledge packet, which is intended to provide the TIU 12 and the remote control 16 with an indication that the command has been received. The acknowledge packet is sent to the communication circuit 202 for conversion into spread spectrum format as just described. This is then sent through the rails back to the TIU 12 where it is received and detected by the transceiver 127 and communication circuit 123 in the TIU 12. The acknowledge spread spectrum signal is decoded as explained above and the acknowledge signal is passed to the TIU processor 121. In this manner, all components of the model train system are aware of the operating conditions of the model train at all times.

Sound System Features

Returning to FIG. 4 and the description of the printed circuit board 20 in the model train 11, the processor 200 controls and drives the various component circuits located on the printed circuit board 20. For example, the processor 200 drives the operation of the lights located on the model train 11 through the light driver circuit 204. The smoke system is operated by the smoke system driver circuit 205 under command of the processor 200. The couplers are controlled by the processor 200 via the coupler drive circuit 206. The train's motor is controlled by the processor 200 through the motor control 207. The sound system is controlled by the processor 200 through an audio amplifier/low pass filter circuit 208', which is connected to a speaker 208" (collectively, the "sound system circuit" 208).

Certain sounds for the model train may be stored in a flash memory 209, which in the FIG. 4 embodiment is connected to the processor 200. The processor 200 is capable of retrieving one or more sound files from the flash memory 209, processing them, and outputting them to the sound system circuit 208. In an alternate embodiment, such as a system on a chip configuration, the sound files are stored on the same integrated circuit as the processor. The sound files may be output from the processor 200 through a pulse width modulation (PWM) circuit 200' found in the processor 200, or by a digital to analog converter circuit (DAC) 200'. The processor 200 is capable of manipulating the sound file data in order to generate various sound effects, such as Doppler, as will be explained below.

The processor 200 is also capable of independently controlling the volume of different processed sounds, in response to commands entered from the user on the remote control 16. The user can also control a "master" volume control by having the processor 200 adjust the DC voltage level of the audio amplifier 208' found in the sound system circuit 208. Alternatively, the master volume may be controlled by the processor 200 limiting the pulse output level of the PWM circuit 200'. This allows the user to adjust the volume of different sounds independently, and adjust the volume of the sounds as a whole. The user can also cut all sounds by turning the master volume to its minimum level. It is also desirable for the printed circuit board 20 to have a battery backup or capacitors (not shown) in order to allow the sounds to continue for a fixed amount of time even after the power has been removed from the track.

Thus, according to the invention, a user may want the train 11 to continually play a "chuffing" sound when the train 11 is in motion. The processor 200 will repeatedly retrieve the "chuff" sound file from the flash memory 209, process it, and feed it to the sound system circuit 208. At the same time, the user may want the train 11 to play station and status announcements (for example, "now arriving at Union Station;" "we are currently 60 miles from Baltimore," etc.). The processor 200 will retrieve the appropriate sound files, as described above. The user may also want the train whistle to blow every 15 seconds. Once again, the processor 200 will retrieve the sound files. All these sounds will play, at the same time, through the speaker 208" in the sound system circuit 208.

At some point, however, the user may wish to lower the volume of the "chuff" sound in order to better hear the station announcements. The processor 200 is capable of reducing the volume of the chuff sound and increasing the volume of the station announcement sounds, while maintaining the volume of the whistle sound. Finally, the user may desire to lower the volume of all the sounds simultaneously, which the processor 200 accomplishes through the master volume control.

As previously stated with respect to the above-described embodiment, sounds are stored in the flash memory 209 on the printed circuit board 20 in the model train(s) 11. It is also possible that sounds are stored in a flash memory 125 located in the TIU 12 (see FIG. 3). In this way, once a user requests a sound on the remote control 16, the TIU processor 121 retrieves the appropriate sound file from the TIU flash memory 125, relays it to the communication circuit 123 for conversion to a spread spectrum signal, and sends it down the train track rails. The addressed model train 11 picks up the signal through the receiver circuit 201, and passes it to the communication circuit 202 in order to retrieve the sound file embedded in the spread spectrum signal. The processor 200 processes the sound file outputs it to the sound system circuit 208.

External Audio Feature

Although history has shown that the storage capacity of memory chips increases steadily as fabrication technology improves, there will always be a finite amount of memory available when an application requires resident file storage. For example, in the present embodiment, there will always be a limit on the amount of sound files that can be stored "on board" the model train 11 or in the TIU 12. The present invention addresses this issue by allowing a user to connect the model train system to an external audio source. This is shown in FIG. 3, described next.

As shown in FIG. 3, the TIU 12 is connected to an external audio source 40 through standard left and right stereo jacks 126 or other suitable connections. The external source 40 may be a CD player, DVD player, cassette player, mini-disc player, memory stick, mp3 player, or other sound source. Because the TIU 12 is also capable of communicating with a computer 30, as explained above, the external source here may also be a computer's hard drive or an open modem connection to the Internet via the computer.

When the user desires to play the external audio source 40, he or she enters an appropriate command on the remote control 16, which informs the TIU 12 that it will be receiving sounds from the external audio source 40. The TIU processor 121 then sends a command to the model train 11 to stop playing any sounds previously commanded by the user. The model train 11 receives the "stop" command and stops playing all stored sounds.

Once the external audio source 40 is activated, the sounds "stream" from the external audio source 40 to the TIU 12 to the model train 11, where the sounds are heard emanating from the speaker 208" on board the train 11. In this way, the user will interpret "real-time" sounds coming from the model train 11.

This is accomplished through the use of the aforementioned spread spectrum signals. The spread spectrum signal is capable of carrying large amounts of data, such as continuously played sounds from the external audio source 40. Moreover, the rate at which data is passed from the TIU 12 to the tracks in the form of spread spectrum signals is very high (the aforementioned example being approximately 121 KHz). This high data rate also allows for real-time sound to be sent down the tracks.

The sounds enter the TIU 12 from the external audio source 40 as line level audio via the aforementioned left and right stereo jacks 126 or other connections. The TIU processor 121 samples the sounds and converts them into digital data (by a standard A/D converter, not shown), which is passed to the communication circuit 123. The communication circuit 123 then embeds the digital sound data into a spread spectrum signal which is sent out to the train track rails as previously described. The model train receiver circuit 201 picks up the spread spectrum signal, and passes it to the train communication circuit 202, which decodes the digital sound data from the spread spectrum signal. The communication circuit 202 passes the digital sound data to the processor 200. The train processor 200 then converts the digital sound data into analog form through a DAC and passes the analog signal to the sound system circuit 208, which plays the analog sound through the speaker 208". This process repeats itself at a high enough rate that the user hears continuous sounds playing from the model train 11.

In this embodiment, the sounds from the external audio source 40 are converted into ADPCM (Adaptive Differential Pulse Code Modulation) format at a rate of 4 bits/sample and 11,000 samples/second. This requires a data rate from the TIU 12 to the train track rails of at least 44,000 bits/second. The aforementioned illustrative data rate of 121 KHz meets this requirement.

The left and right stereo sounds received by the TIU 12 via the left and right stereo jacks 126 are added by the TIU processor 121 and output to the tracks in mono form. As described previously, the user can adjust the master volume of the model train 11 in order to increase or decrease the volume of the sound output by the model train 11.

It should be apparent that the present invention provides the user with a number of exciting options. For example, the user may connect the TIU 12 to a CD player and have the model train "play" the user's favorite songs. The user may have a unique pattern of train sounds specifically created by the user and stored on the user's computer hard-drive. This invention enables the user to play his or her customized "train sound track" through a model train 11.

The system disclosed herein provides other sound possibilities. For example, the external audio source 40 may be a microphone. Following the same steps as described above, the user may speak into the microphone and have his or her own voice transmitted down the train track rails by the TIU 12 (via spread spectrum signals), where it will be converted by the train communication circuit 202 and processor 200 and played through the sound system circuit 208 on the model train 11. In place of an external microphone, the present invention also contemplates having a microphone 166 built into the remote control 16, which the user could turn on with one of the push buttons 162 on the remote control 16, and then speak directly into the remote control microphone 166.

Through this feature of the present invention, the user can be the train "engineer" and announce train station stops, status updates, etc. Of course, this feature also enables the user to playfully interact with other people in the room. For example, the user may have the train 11 say "happy birthday" to someone else in the room, or have the train 11 call to the family dog. The possibilities are endless, and the foregoing are merely examples.

Custom Sound

Another aspect of the present invention allows users to store their own custom sound files in the flash memory 209 located in the model train 11 on the printed circuit board 20. In an alternative embodiment, the custom sound files are stored in the flash memory 125 located in the TIU 12. The general concepts are the same for both embodiments.

The user is capable of entering a "record" command on the remote control 16. The record command is sent via the RF signals to the TIU 12, which embeds the command into a spread spectrum signal and passes the command down the rails to the model train 11. The command is received and processed by the receiver circuit 201, communication circuit 202, and train processor 200, respectively. The processor 200 then checks the flash memory 209 on the printed circuit board 20 for available capacity. Assuming there is capacity, the processor 200 creates a sound file in the flash memory 209 and assigns a ID to the file. The flash memory 209 then is placed in "record" (or "store") mode and awaits sound data.

The sound data can come from any of the above-described sources identified with respect to the external audio source 40, i.e., CD players, tape players, mini-disc players, mp3 players, memory sticks, computer hard-drives, Internet websites, or someone's voice via the microphone. After the user enters the "record" command on the remote control 16, the user then enters the command informing the TIU 12 that sounds will be coming from the external audio source 40. The sounds from the external audio source 40 are embedded as digital data into a spread spectrum signal by the communication circuit 123. The signal is passed down the train track rails where it is received by the model train 11. The train's communication circuit 202 and processor 200 decode the sound digital data from the spread spectrum signal and pass it to the flash memory 209, where it is stored as digital sound data in the newly created sound file. When the user enters the "stop recording" command on the remote control 16, the processor 200 stops the flow of data into the sound file. In one embodiment, the sound file is recorded on the fly into the flash memory 209 in the engine board 20. In another embodiment, the sound file may first be stored in the flash memory 125 in the TIU 12, and then transferred at a later time into the flash memory 209 in the engine board 20.

The flash memory 209 now has a unique sound file recorded by the user. The train processor 200 passes the ID of the unique sound file to the TIU 12 in an information packet through the track rails, and the TIU 12 passes the information on to the remote control 16 via RF signals. The remote control 16 can then provide the user with the ID of the newly created sound file so that the user can recall that ID on the remote control 16 when he or she wants the train 11 to play the unique sound file. Alternatively, the user can assign an ID to the recorded sound file on the remote control 16 (for example, pressing a combination of three push buttons 162 on the remote control 16 will activate the recorded sound file). The user-assigned ID is then passed along to the train processor 200, which stores the user-assigned ID in memory and activates the recorded sound file when the user-assigned ID is entered on the remote control 16.

In the alternative embodiment, where the recorded sound file is stored in the flash memory 125 in the TIU 12, the system works substantially the same way. In this embodiment, however, the TIU processor 121 converts the sounds to be recorded into digital data and stores them in a sound file created in the TIU flash memory 125. When the user wishes to have the recorded sound file played, the TIU processor 121 retrieves it from the flash memory 125 and passes it to the communication circuit 123, which embeds the digital sound data from the sound file into a spread spectrum signal. This is then output to the train track rails, where it is picked up and played by the model train 11, as has been previously described.

This "recording" feature also expands on the capabilities of the model train system for the user. For example, a user may sing "happy birthday" to his or her daughter and store the song in a sound file in the flash memory (125 or 209). When the daughter enters the room, the user can activate the sound file and the daughter will hear the train "sing" happy birthday to her.

Another example concerns new train sounds. Model train makers are constantly searching for new and different sounds that simulate real-life train sounds. A manufacturer may make an upgrade available with new sound files. With the present invention, the user could purchase a CD (for example) having the new sound files, and record the new sound files from the CD to the flash memory (125 or 209).

Further, because of the present invention's capability of interacting with a computer 30, the manufacturer may make the new sound files available for download from the manufacturer's Internet website. The user can connect the model train system to his or her computer, access the website, and download the new sound files directly into the flash memory (TIU 12 or model train) using the "record" feature.

Figure 4A:
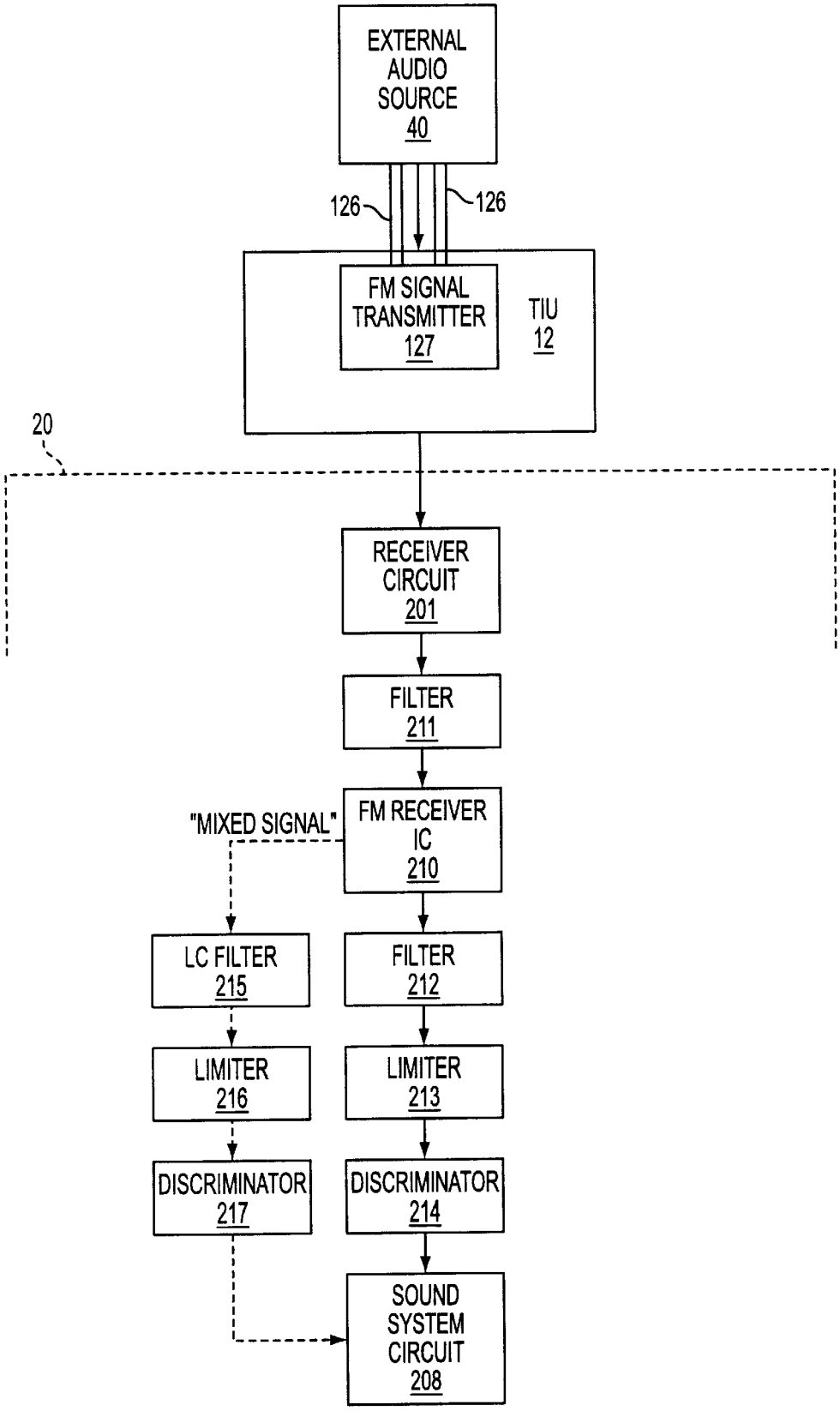
FIG. 4A shows an alternative "analog" sound system.

Returning to the ability of the present invention to play streaming sounds from an external audio source 40, the embodiment described above uses the spread spectrum signaling method to digitize the sound and provide it to the train processor 200. The train processor 200 then converts the digitized sound to analog for playing through the sound system circuit 208. In an alternate embodiment, the present invention does not digitize the streaming sound. This may be referred to as the "analog" embodiment, as shown in FIG. 4*a*.

The setup for the analog system is similar to that shown in FIG. 3. The TIU 12 is connected to an external audio source 40, as described above. In this embodiment, rather than converting the audio signal into digital data for embedding into a spread spectrum signal, the TIU 12 uses FM modulation techniques. In one non-limiting example, the audio signal is FM modulated at a frequency of 10.7 MHz. The peak frequency deviation is about 40 KHz. This was chosen because it is similar to modulation used for FM radio when only a mono receiver is used. It should be understood, however, that other frequencies and deviations may be used, and are considered within the scope of the present invention.

In this embodiment, it is contemplated that an FM signal transmitter 127 is housed in the TIU 12. In the preferred embodiment, the TIU 12 has two inputs 126 for audio in, although one input is also possible, as is more than two. In the preferred embodiment of two inputs, one is line level and the other is microphone level. When an audio signal is presented at either one of these inputs, the FM signal transmitter 127 is enabled. In this embodiment, there is a delay between the end of the audio signal and the disabling of the FM signal transmitter 127. This is done so that the silence between songs on a CD or other source will not cause the model train 11 to return to playing normal train sounds, such as chuffing.

The FM signal transmitter 127 may be any suitable one available in the art. An acceptable FM signal transmitter 127 consists of a 10.7 MHz LC transistor oscillator, an output driver, and a coupling power source. A varactor in the FM signal transmitter 127 varies the transmitter's output frequency with changes in the audio input. The driver boosts the transmitted FM signal and the coupling power source couples the 10.7 MHz signal onto the train track rails.

In the analog embodiment, an FM receiver integrated circuit (IC) 210 is located on the model train's printed circuit board 20. Once the FM receiver 210 receives a 10.7 MHz signal, it signals the train processor 200 to stop producing other sounds and the sound system circuit 208 is driven by the output of the FM receiver IC 210. This is described in more detail below.

The receiver circuit 201 picks up the FM signal from the train track rails (in a three-rail system, this signal is found on the center rail). This signal is filtered in a 10.7 MHz ceramic filter 211. The filtered signal is then passed to the FM receiver IC 210. Any standard FM receiver IC 210 or circuit may be used for this purpose. Non-limiting examples of such ICs are the Philips SA614 and the Motorola MC3371.

The FM receiver IC 210 receives the filtered signal and amplifies it. The amplified signal is then externally filtered in another ceramic filter 212. The second filtered signal is then passed through a limiter 213 and into a discriminator 214. The output of the discriminator is the audio signal. This audio signal is muted if the received 10.7 MHz signal is not strong enough. If it is sufficiently strong, the audio signal is passed to the sound system circuit 208 where it is amplified and played through the speaker 208".

Alternatively, the FM receiver IC 210 mixes the received filtered signal down to 450 KHz. The source for the 10.24 MHz local oscillator is a crystal. The 450 KHz signal is then amplified and externally filtered in an LC filter 215. The second filtered signal then goes through a limiter 216 and into the discriminator 217 where the audio signal is recovered. Once again, this audio signal is muted if the 450 KHz signal is not strong enough. If the signal is strong enough, the audio signal then goes to the audio amplifier where it drives the speaker 208" in the sound system circuit 208.

Diagnostic Information

The ability of the present invention to communicate with a computer 30 takes advantage of the two-way "handshake" capability between the TIU 12 and the model train 11. As previously stated, the train processor 200 is capable of outputting a large amount of information concerning the status of the model train 11. This information can be "uploaded" from the model train 11 via the TIU 12 to the Internet. Thus, a user having a problem with a particular model train 11 can put the train 11 on the track 10 and connect the TIU 12 to a computer 30. Once the computer 30 is linked to the Internet via a modem connection, the TIU 12 can retrieve operating information about the model train 11 from the train processor 200 and upload that information to a troubleshooting website, manufacturing website, dealer website, or other location. A technician at the other end can then retrieve and analyze the train information and propose solutions to any operating difficulties the user is having. It is also possible that the technician can download a software patch or other solution to the train 11 through the open modem connection, in the manner described above concerning the playing of sounds from an external audio source 40. Alternatively, a user may be able to download a software patch from a website directly.

Speed Control Overview

Another aspect of the invention, "speed control," will be described next. First, some background information concerning the state of the prior art is appropriate.

Figure 5:
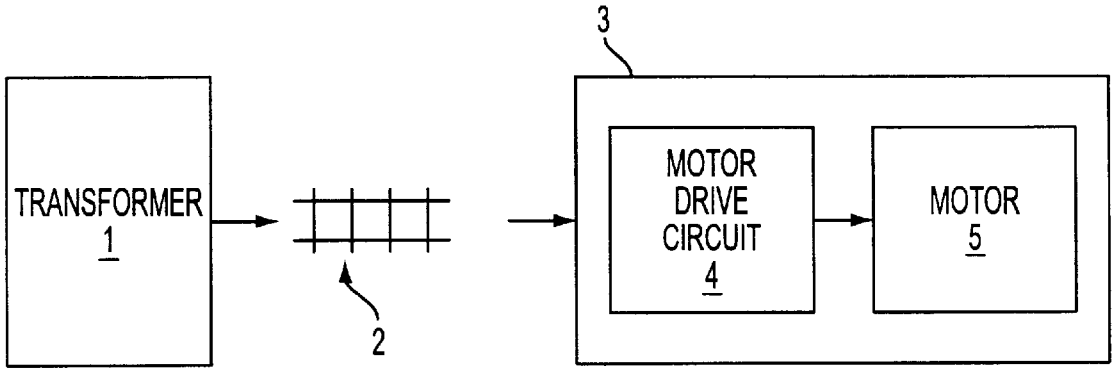
FIG. 5 (PRIOR ART)
FIG. 5 shows a prior art ("legacy") speed control circuit.

For example, FIG. 5 illustrates a traditional speed control for a model train corresponding to the aforementioned "legacy mode." A transformer 1 powers the track 2 with AC/DC voltage. The AC/DC voltage is then fed directly into the engine 3 of the train. The engine 3 includes a motor drive circuit 4 and a motor 5. The motor drive circuit 4 receives the AC/DC voltage and applies this to the motor 5 directly, or indirectly such as through rectification in the case of an AC track voltage and a DC motor.

In the aforementioned setup, speed control for the train is accomplished by manual control of the output voltage supplied by the transformer 1. A user may manually adjust the output voltage of the transformer 1, e.g., using a control knob or throttle arm, to a predetermined value which would correlate with a desired speed for the model train. Accordingly, the higher the voltage output of the transformer 1, the faster the train will go.

Figure 6:
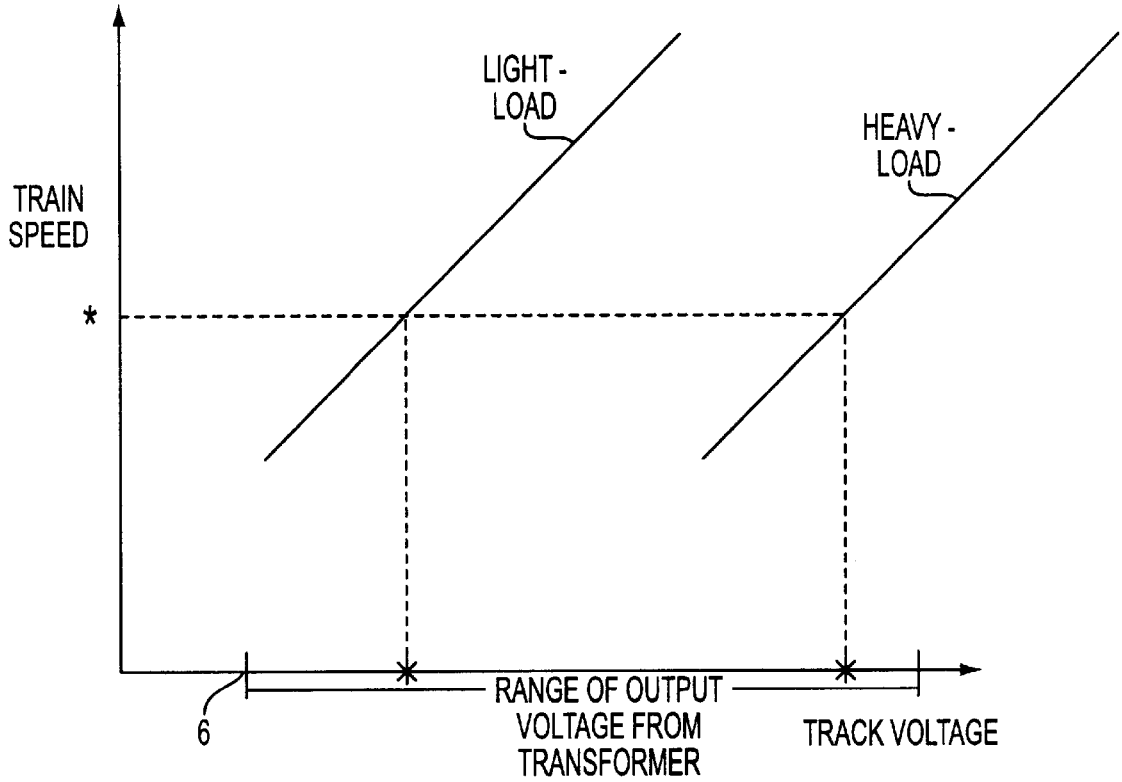
FIG. 6 shows a graph indicating speed vs. voltage at different loads for the speed control circuit of FIG. 5.

The problems associated with the "legacy mode" of operation will now be discussed with respect to FIG. 6. The graph shown in FIG. 6 compares the output voltage of the transformer 1 versus the resulting speed of the train. The transformer 1 can be adjusted from some non-zero starting voltage 6. The gap between zero volts and the non-zero starting voltage 6 is used as a signaling mechanism, whereby a train may interpret momentary interruptions in track voltage as a command to shift to a neutral state or to change direction.

As is clear from the graph, the speed control of the trains in the "legacy mode" of operation in the prior art is dependent upon the load of the train. The two lines represent the correlation between voltage output and speed for differing loads, one for light-load and one for heavy load. When an engine is lightly loaded (e.g., few or no cars, going downhill), less voltage is required to achieve a given speed. Accordingly, with increasing load (e.g., more cars, going uphill) more voltage is required to maintain the given speed.

As evident from FIG. 6, train load is an important parameter for speed control. As such, a given desired speed indicated by a "*" on FIG. 6 will require two different voltages marked on the graph as "X", one voltage for low load and another voltage for high load. Accordingly, if a user desires to accurately control speeds at desired values, he/she must manually attempt to calculate and/or conduct repeated tests in order to establish a look-up table/graph that will list the required voltage for every known load. In effect, a user would have to manually produce data, similar to what is shown in FIG. 6, for every different load they will operate with. It is quickly apparent that such an undertaking would be practically impossible.

Moreover, the resulting data (i.e., look-up table or chart) would still not take into consideration the inherent load changes that take effect while driving the train throughout the layout. In other words, the load lines shown in FIG. 6 are based on the assumption that load will remain fixed in value (e.g., solely dependent on number of trains, etc.). However, in practice, load will continuously change while driving the trains throughout the layout in response to certain factors related to the layout; for example, going up or down a hill or around a curve. Therefore, even if a user could produce a look-up table or chart, the user would still not be able to automatically maintain a constant speed throughout the entire layout. Additionally, it should be noted that it is typical for there to be large variations between train engines (particularly from different manufacturers). Thus, manual control of the speed of one engine will not apply to other engines.

An additional limitation of the "legacy mode" of operation occurs at relatively slower speeds. At a given load, only a portion of the power source's voltage range can be used to operate an engine over the desired speed range. As shown in FIG. 6, the load lines do not extend to a point where either the voltage or the train speed is zero. This is because the train must initially be supplied with sufficient voltage to overcome static friction between the train and the track. Once the train begins to move, the slope of the line representing the correlation of speed vs. voltage is larger as a result of the smaller amount of dynamic friction; hence, it is difficult to control the train at low speeds.

Specifically, small manual adjustments using a power source's control knob or throttle arm cause dramatic changes in speed, thereby making it is difficult to achieve or maintain consistent slow speed operation. Moreover, a slow-moving engine stalls at curves or when climbing a hill because the supplied voltage cannot provide enough motor current to overcome the additional torque. Once stalled, the voltage must be increased to supply enough current to again overcome or break through the static friction. Additionally, in the case of lightly loaded engines, the power source voltage itself may drop out as the speed of the engine is lowered.

In summary, the "legacy mode" speed control in the prior art does not automatically provide a constant speed around the track regardless of static and dynamic load changes. Moreover, the prior art provides poor speed control at slow speeds, resulting in a jerk, snap-type motion when moving the trains from rest or relatively slow speeds.

Figure 7:
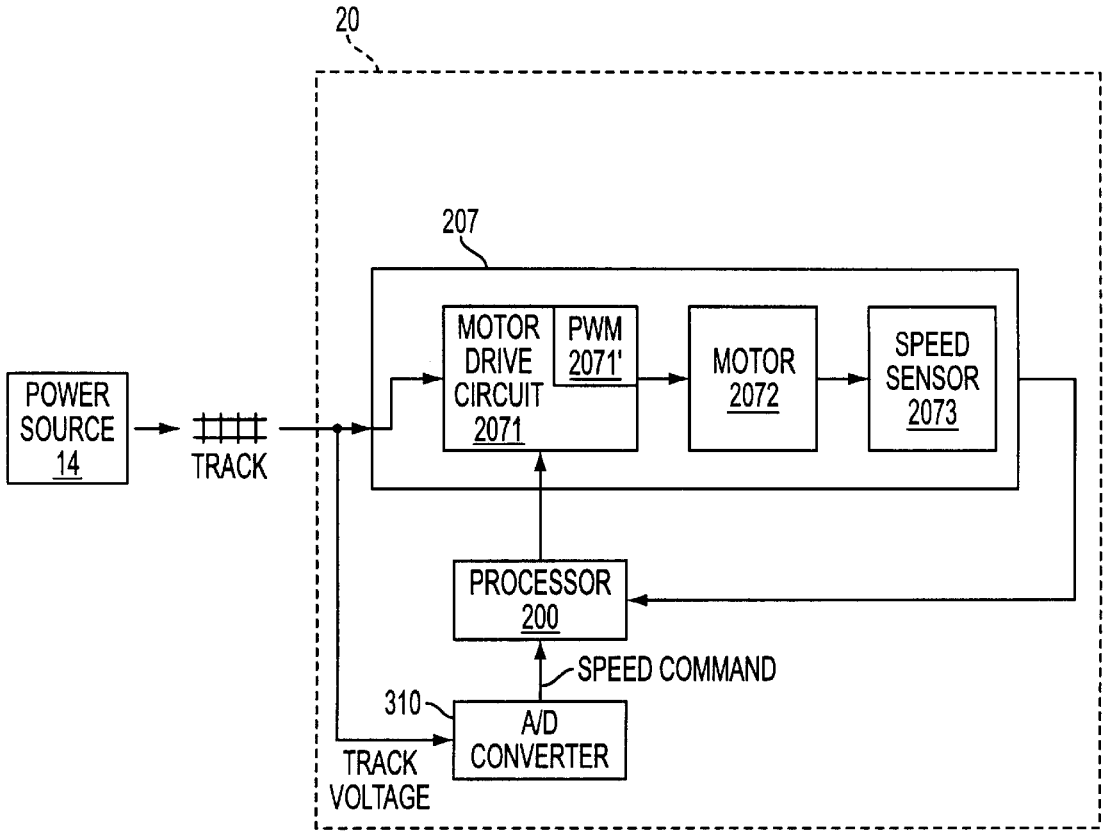
FIG. 7 shows one exemplary embodiment of the speed control circuit of the present invention.

Turning to FIG. 7, the novel speed control system of the present invention will be described in more detail. Importantly, this method can be used with existing power sources. Generally, the speed control system of the present invention comprises a feedback loop that maintains a constant desired speed of the train regardless of motor imperfections and/or load variations such as adding cars, climbing a hill or traversing a curve.

Figure 8:
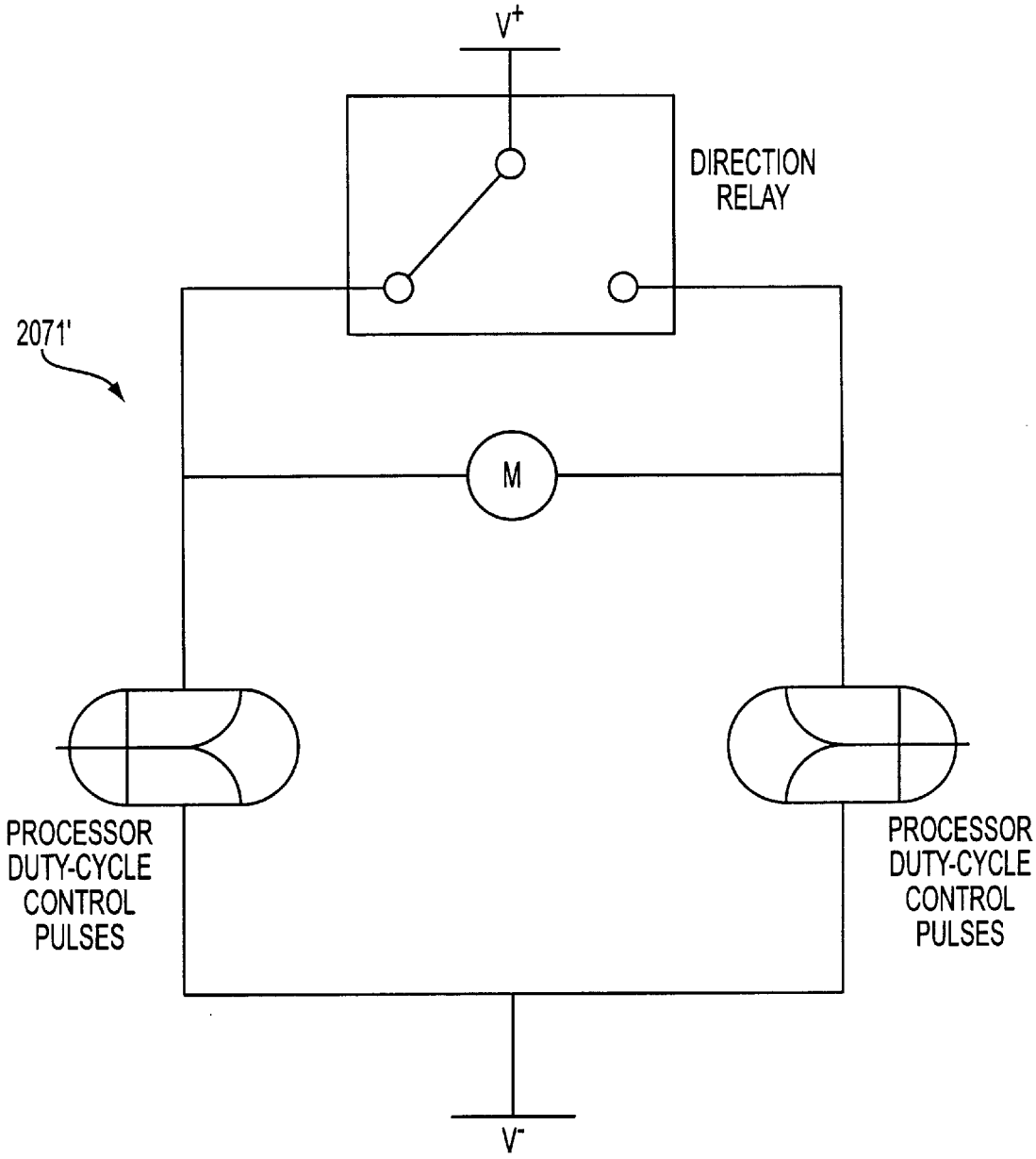
FIG. 8 shows one exemplary embodiment of the pulse width modulator circuit for the speed control circuit of FIG. 7 of the present invention.

The motor control 207 includes a motor drive circuit 2071, a motor 2072 and a speed sensor 2073. The motor drive circuit 2071 includes a bi-directional pulse width modulation circuit ("PWMC") 2071' illustrated in FIG. 8. The PWMC 2071' includes a two-transistor with relay "H" bridge which provides bi-directional drive to the DC motor. The bridge is pulse-width-modulated at a fixed and inaudible frequency of approximately 20 kHz. The single-ended bus voltage to the bridge is rectified from an AC track voltage. The "H" bridge configuration permits forward or backward drive to the motor. The "H" bridge is commonly used and maintaining this topology allows the processor 200 to emulate existing variable track voltage speed control systems by completely enabling the forward or reverse bridge paths without modulation. In this manner, the motor drive will be directly proportional to the rectified track voltage and will emulate the behavior of legacy systems, thereby making the SCS control easily adaptable with existing systems.

The PWMC 2071' functions to alter the duty cycle at which the track voltage is pulsed into the motor 2072. Accordingly, at any given track voltage, the PWMC 2071' can control the train speed by changing the duty cycle at which the voltage is applied to the motor.

The processor 200 senses the motor speed via the speed sensor 2073 and modulates the turn-on interval or duty-cycle of the "H" bridge transistors to modulate the current applied to the motor 2072. With a striped speed sensor 2073, the processor 200 accumulates the transitions in a fixed control interval. The processor 200 compares the number of transitions with the commanded speed scaled to transitions per control interval.

For example, if the fixed interval is 57 milliseconds, then a 10 mph scale speed would generate 40 transitions per interval using a 24-stripe sensor. The error is used to proportionally increase or decrease the duty-cycle to the motor 2072. Additionally, the acceleration is estimated by comparing the transition count from the present time interval to the previous time interval. This acceleration is also used to increase or decrease the duty-cycle. This implements a so-called PID (proportional-integral-derivative) control loop and can be stated algorithmically as:

$$D_n = D_{n-1} + k_{prop} * (S_n - S_{target}) + k_{deriv} * (S_n - S_{n-1})$$

where:

$D_n$, $D_{n-1}$ are the duty-cycle to the motor drive circuit for the present and previous control interval $S_n$, $S_{n-1}$ are the sensed motor speed for the present and previous control interval $S_{target}$ is the commanded target speed $k_{deriv}$, $k_{prop}$ are weighting multiplier or "gains"

The weighting multipliers are not necessarily constant and may be adjusted as a function of target speed and sign of the difference value to which they are applied. At slow motor speeds in particular, the characteristics of torque variations in brushed DC motors demand careful selection of these multipliers.

Accordingly, the PWMC 2071' serves the important function of controlling train speed independently of the voltage across the track. For example, if the track voltage is set at 20 VAC which equates to a set scale miles per hour ("smph") (up to a maximum of 100 smph), then the PWMC 2071' is capable of increasing the speed of the train by increasing the duty cycle (i.e., increasing the time that the voltage is applied to the motor 2072) for the application of the 20 VAC to the motor 2072. Similarly, the PWMC 2071' can reduce the speed of the train (to as little as 1 smph) by decreasing the duty cycle. The PWMC 2071' thus enables the processor 200 to adjust the speed of the train over a wide range with the same track voltage.

When desired to run in "legacy mode", the user enters the request on the remote control 16, which will send a signal to the processor 200 in the printed circuit board 20 of the train(s) 11. Accordingly, the processor 200 sets the PWMC 2071' to a fixed maximum value that remains constant regardless of the actual speed of the train 11 sensed by the speed sensor 2073.

Speed Control—Conventional Mode

The general functional and operational interrelationship between the elements of the novel speed control of the present invention will now be discussed with respect to "Conventional Mode". It should be noted that the following description is for exemplary purposes only and that alternative operational sequences are possible.

Returning to FIG. 7, the power source 14 supplies a voltage across the track. The amount of voltage applied to the track is directly related to the desired speed for the train(s) on the track, as will be discussed in more detail below. The track voltage will be picked up by rollers (not shown), which also pick up the digital commands sent by the TIU 12 as discussed above, on the underside of the train(s) 11. The track voltage is sampled by an A/D converter 310 which then converts the voltage into a digital signal and outputs the digital signal to the processor 200. Accordingly, the digital signal represents a speed command of the user. That is, the track voltage set by the user is indicative of the user's desired speed for the train(s) 11 (more voltage=more speed). The processor 200 utilizes the sampled track voltage to access a look-up table stored in memory that indicates what the speed of the train should be at the sampled track voltage. The looked-up speed corresponding to the sampled track voltage becomes the user's desired speed. The processor 200 also receives a signal from the speed sensor 2073 which is indicative of the actual train speed. The processor 200 compares the desired speed (i.e., speed command) with the actual speed and adjusts the duty cycle accordingly. The look-up table applies to all trains equipped with the present invention so that the resultant speeds are the same.

An example of operation will now be discussed. To begin, a user manually adjusts the power source 14 to a given voltage corresponding to a desired speed. Under normal conditions (i.e., constant load, etc.), the train(s) 11 will gradually reach the desired speed. However, when the train(s) 11 traverses a curve or goes up/down a hill, or box cars are added, the load will change. Accordingly, the set voltage and default duty cycle will no longer be capable of maintaining the desired speed.

In the "legacy mode" of the prior art control systems discussed above with respect to FIG. 5, when a user set the track voltage by manually adjusting the transformer 1 for a desired speed, if the load on the train increased, the user had to again increase the track voltage by manually adjusting the transformer 1 in order to maintain the desired speed. As was seen in FIG. 6, this resulted in a speed control system that was dependent upon the load, leading to an inefficient and impractical speed control scheme where the user must continuously adjust the track voltage to maintain a desired speed.

In contrast, the present invention automatically provides a constant speed for the train 11 independently of any load changes (within limitations set by the available power supplied to the track). Consequently, once the user sets a desired speed (i.e., by manually setting a voltage), the system will maintain that speed.

Returning to FIG. 7, how the present invention automatically maintains a constant speed independently of load will now be explained. The speed sensor 2073 is coupled to the motor 2072. The speed sensor 2073 is preferably a flywheel that is attached to the motor shaft (not shown) thereby rotating at the same rate as the motor 2072, so as to measure the angular rotation of the motor 2072. Either a reflective or transmissive optical sensing method can be employed depending on the available space in the engine housing. The reflective method uses an LED (not shown) to illuminate the flywheel which is marked with alternating reflecting and non-reflecting stripes. As the flywheel turns, a photodetector detects the rate of optical transitions thereby indicating speed. Alternatively, the transmissive method attaches a circular disk with radial stripes or spokes to either transmit or block the LED illumination. Further, the motor shaft can itself be marked similarly to the flywheel. The gear ratio for typical model engines is ¼" of track motion per motor revolution. For ¼sth scale, 1 mph is equivalent to 1.47 motor revolutions/sec. For example, if the flywheel is marked with 24 stripes or spokes, there will be 48 transitions per revolution or 70.6 photodetector transitions per scale MPH.

Alternatively, the speed can be measured by sensing the per-revolution variation in motor current due to the self-commutation. Commutation causes an instaneous, measurable change in current (sensed as a feedback pulse) as windings move to the next brush in motors. This occurs a fixed number of times per motor revolution. Since the commutation sequence repeats with each revolution, there is a discrete number of feedback pulses per revolution, which, in essense, is an odometer. The processor 200 can sense the motor current through a sense resistor (not shown) and algorithmically estimate the speed. The back-emf of the motor 2072 can optionally be simultaneously sensed to improve the estimate. The advantage of this speed sensing method is that it can be retrofitted without modifying the motor mechanical assembly; as such, it is compatible with existing motors.

Another method of sensing the motor speed is the use of a magnetic hall effect sensor or switch that comprises a magnetic ring with bands of alternate polarities. The speed at which the polarities change is measured, in a manner similar to the optical flywheel described above.

The desired track voltage is sampled by the AND converter 310 and converted into a digital signal for outputting to the processor 200. This digital signal represents the desired speed. Accordingly, the processor 200 is made aware of the desired speed for the train(s) 11. The speed sensor 2073 will continuously monitor the motor speed as an indication of the train speed and output this reading into the processor 200.

Accordingly, the processor 200 will adjust the duty cycle according to a comparison that is made between the desired speed represented by the track voltage and the actual speed sensed by the speed sensor 2073.

For example, if a user enters on the remote control 16 a desired speed of 10 smph, the power source 14 will output the corresponding voltage over the track (similarly, the user may manually set the power source 14 at the desired voltage representing the desired speed). Accordingly, the train(s) 11 will gradually reach 10 smph at which point the measured speed and desired speed will have a substantially one-to-one correspondence and the processor 200 will maintain the current duty cycle. However, if, for example, the train(s) 11 goes up a hill, the same track voltage will not be sufficient to maintain the desired speed because of the increase in load. As a result, the train will begin to slow down as it climbs the hill.

The speed sensor 2073 will immediately sense the decrease in motor speed. Accordingly, when the processor 200 compares the desired speed (i.e., sampled track voltage) with the actual speed (from speed sensor 2073), the processor 200 will know that the train(s) 11 is now going slower than the desired speed. In response, the processor will increase the duty cycle using the PWMC 2071' and thereby increase the power applied to the motor 2072. This feedback loop will continue, with a continuously increasing duty cycle, until the measured speed is again in a substantially one-to-one correspondence with the desired speed. The same process occurs when the train(s) 11 goes down a hill, except that the processor 200 will decrease the duty cycle.

Figure 9:
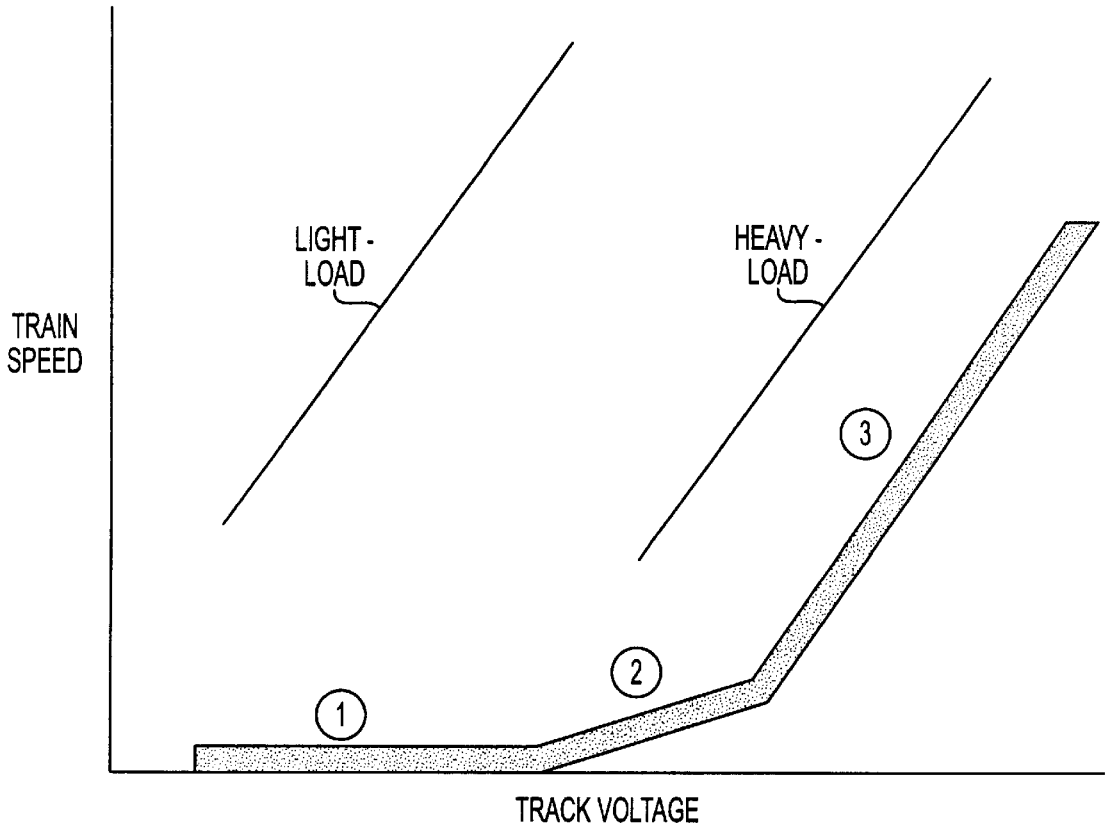
FIG. 9 shows a graph indicating speed vs. voltage of the present invention in comparison to the prior art graph of FIG. 6.

Turning to FIG. 9, a curve illustrating the relation between speed and track voltage of the present invention is illustrated in comparison to the conventional speed vs. track voltage curve shown in FIG. 6. As is evident, the speed control system of the present invention results in a single curve that is independent of load, whereas the conventional speed control system includes a line for each load (light-load and heavy load shown). Accordingly, for every given track voltage, the present invention will maintain the corresponding speed by continuously adjusting the duty cycle. The single curve derived from the speed control of the present invention will always lie to the right of the light/heavy load lines of the conventional system so that the processor 200 can modulate the motor voltage at less than or equal to the maximum voltage available.

It can be seen from FIG. 9 that the single curve of the present invention is defined by three distinct regions. Region 1 defines the track voltage over which the train does not move (i.e., speed=0). In other words, if a user manually turns on the power source 14 to a track voltage in Region 1, the processor 200 will direct the PWMC 2071' to a zero duty cycle. Therefore, the motor 2072 will not receive any power. Region 1 is set to be above the drop out voltage of the particular power source in order to be compatible with the existing signaling method for interrupting track voltage in order to make a transition between forward, reverse, or neutral modes of operation for the train. Region 2 defines a gradual increase in speed with increased track voltage and Region 3 defines an increased slope for the speed vs. track voltage curve.

The reduced slope of Region 2 provides a significant advantage. Finite speed changes at slower speeds are more noticeable than at faster speeds. For example, the change in speed that a car makes from 60 mph to 65 mph is much less noticeable than a car that changes speeds from 5 mph to 10 mph. Accordingly, the reduced slope of Region 2 provides an improved resolution for slow speed operation. Moreover, all available power sources inherently have finite output impedance (i.e., meaning their voltage drops slightly with increasing load) causing load disturbance and/or change. The effects of such load disturbances and/or changes are relatively higher for slow speed operation versus high speed operation. Accordingly, the reduced slope of Region 2 helps mitigate these effects on the desired speed of the train.

In fact, because the PWMC 2071' is directed by the processor 200 to continuously modulate the voltage applied to the motor 2072, the present invention provides the capability to set forth any range of speed vs. track voltage curves by programming the processor 200 to control the PWMC 2071' in the desired manner. For example, a user can provide dramatic increases in speed (resulting in an increased slope) by increasing the rate at which the duty cycle increases in response to an increased track voltage. Similarly, a user can provide very fine speed adjustments by decreasing the rate at which the duty cycle increases in response to an increased track voltage. Accordingly, the accuracy and precision of slow speed operation is significantly improved.

Speed Control—Command Mode

A discussion of the novel speed control of the present invention is now discussed with respect to the "Command mode", which can be selected via the remote control 16. It should be understood that trains equipped with the engine board 20 in FIG. 4 are capable of operating in either Command or Conventional mode. The default is Command mode. However, a user may disable Command mode by entering an appropriate command on the remote control 16, at which point the train will operate in Conventional mode. Entering another command on the remote control 16 will return the train to Command mode.

When in "Command mode", the user will adjust the power source 14 such that the track voltage is set at a pre-determined maximum value (e.g., the power source's maximum). Once the pre-determined maximum value for the voltage across the track is set, the user no longer needs to adjust the track voltage for changing speeds.

Turning back to FIG. 7, the speed control system used in "Command Mode" is the same as used in the "Conventional Mode" and thereby operates in the same manner. That is, the processor 200 compares the speed command and the actual speed and adjusts the duty cycle to obtain the desired speed. However, in "Command Mode", the speed command is no longer a function of the track voltage selected by the user either directly or indirectly. As discussed above, the track voltage is set at a predetermined maximum. Instead, the speed command is directly inputted into the printed circuit board 20 of a particular train 11 from the remote control 16. Each train 11 has a unique digital address. Accordingly, a user will first input into the remote control 16 a specific train 11 whose speed the user wants to change, and then inputs the desired speed.

The remote control 16 will output a signal embedded with the digital address and the desired speed into the TIU 12 and onto the track. The signal will "find" the train(s) 11 whose digital address matches the one embedded in the signal. The signal will then be inputted into the printed circuit board 20 of the selected train 11 and be fed into the processor 200.

At this point, the speed control feedback works similarly to the "Conventional Mode". That is, the processor 200 receives the speed command in digital form. The A/D converter 310 samples the track voltage, which is set at the desired maximum voltage, and outputs a signal to the processor 200. The processor then compares the speed command to the maximum voltage and determines a duty cycle that will accurately modulate the maximum track voltage to the motor 2072 in order to achieve the desired speed. Accordingly, in "Command Mode", a user can select different speeds for every train 11 on the track by simply using the remote control 16.

Moreover, in "Command Mode", the acceleration and deceleration at which the train(s) 11 reach the desired speed can be adjusted. In addition to a default acceleration/deceleration, there are a plurality of other acceleration/deceleration rates that are stored in flash memory 209. More acceleration/deceleration rates can be added by inputting and storing the desired rates using the remote control 16. The user simply accesses the appropriate file in the flash memory 209 related to the acceleration/deceleration rates and selects the desired rate. Even further, the acceleration rates can be distinct and independent from the deceleration rates, thereby allowing the user to have different rates for acceleration and deceleration.

Coupler Design

Another inventive feature of the present invention is a new coupler design. Couplers are used on model trains to connect a train to one or more box cars, oil tankers, other trains, or other loads. The couplers also connect between box cars, for example.

Figure 10A:
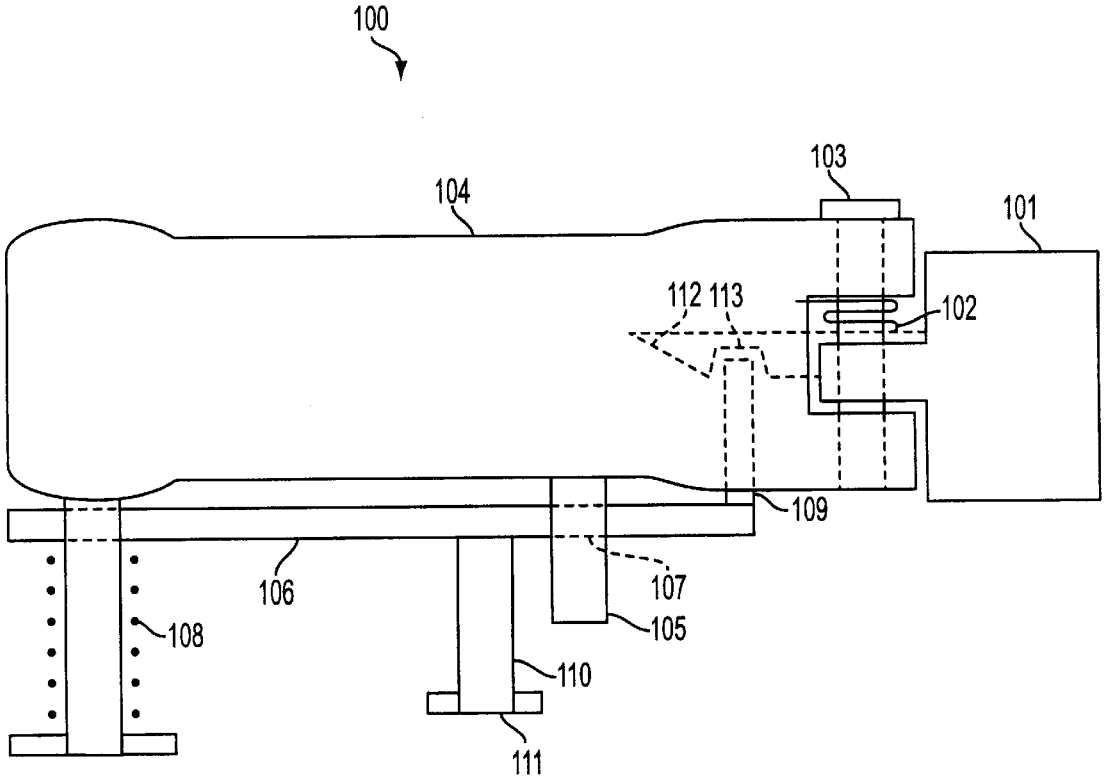
FIG. 10A (PRIOR ART)
FIG. 10*a* shows a side view of a conventional mechanical coupler.
Figure 10B:
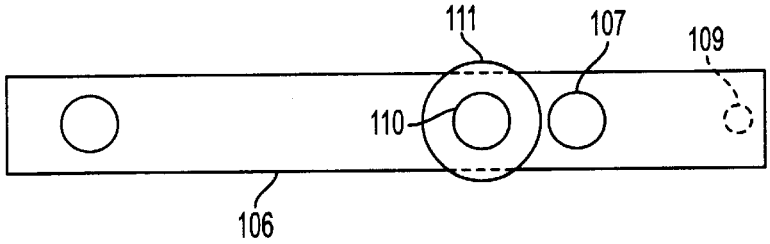
FIG. 10B (PRIOR ART)
FIG. 10*b* shows a bottom view from FIG. 10*a* of the latch member of the conventional mechanical coupler.

Turning to FIG. 10*a*, a conventional mechanical coupler 100 for connecting and disconnecting trains is illustrated. The main components of the conventional mechanical coupler 100 include a knuckle 101, a knuckle spring 102, a knuckle pin 103, a housing 104, a housing lock pin 105, a latch member 106, a latch member hole 107, a latch member spring 108, a latch pin 109, a latch plate post 110, a latch plate 111, a knuckle latch ramp 112 and a knuckle latch notch 113. FIG. 10*b* illustrates a bottom view of the latch member 106 taken from FIG. 10*a*. The operation and functionality of each of the components of the conventional mechanical coupler will now be described.

Figure 11A:
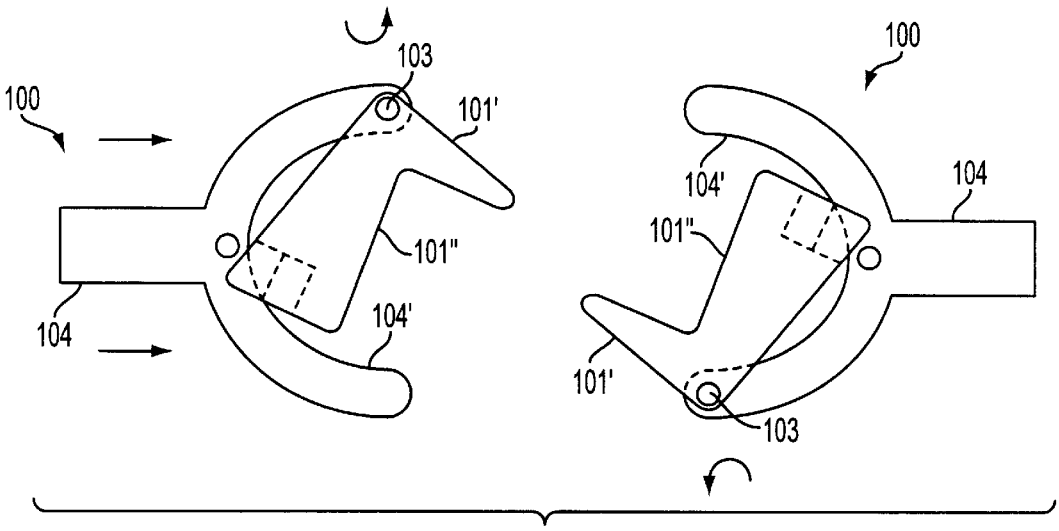
FIG. 11A (PRIOR ART)
FIG. 11*a* shows two trains preparing to be coupled using the conventional mechanical coupler of FIG. 10*a;*
Figure 11B:
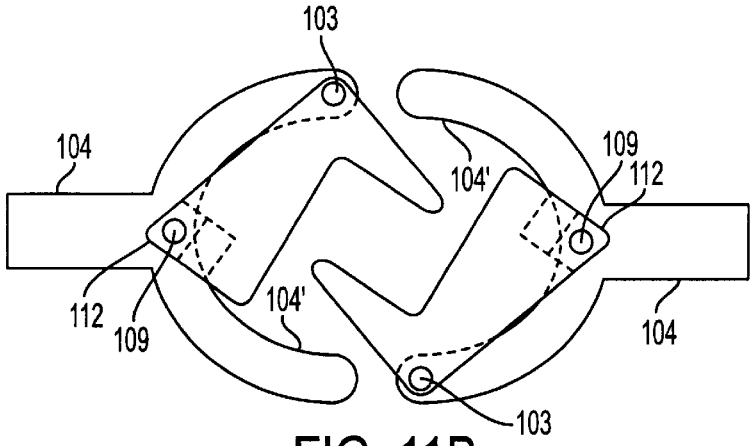
FIG. 11B (PRIOR ART)
FIG. 11*b* shows interaction between the conventional mechanical couplers.
Figure 11C:
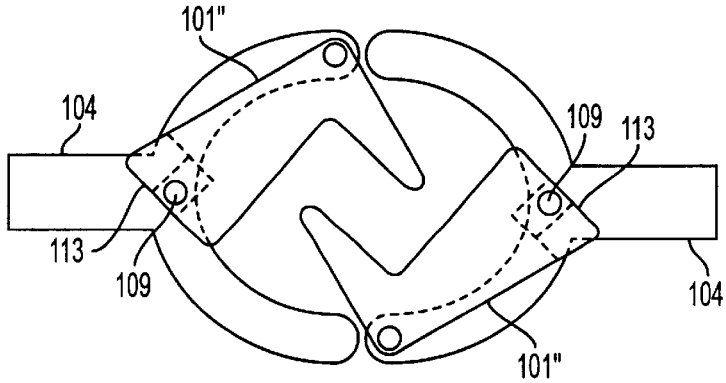
FIG. 11C (PRIOR ART)
FIG. 11*c* shows the two conventional mechanical couplers in a locked closed position.

FIGS. 11*a* through 11*c* illustrate the process by which two trains are coupled together. FIG. 11*a* shows two conventional mechanical couplers 100 on different trains (not shown) in the unlocked open position, where one train is approaching the other. Each knuckle includes two arms 101' and 101". Knuckle arm 101" includes on an outer portion thereon the knuckle latch ramp 112 and the knuckle latch notch 113. The knuckle 101 is rotatable about the knuckle pin 103 and is biased open by knuckle spring 102 (bias illustrated by semi-circular arrow in FIG. 11*a*). Turning to FIG. 11*b*, the user will direct one of the trains into the other such that the respective knuckle arms 101' pass each other and come into contact with an inner surface 104' of the housing 104 of the other coupler 100. The contour of the inner surface 104' of the housing 104 causes the knuckle 101 to rotate about its knuckle pin 103 toward the latch pin 109 that is positioned within an opening of the knuckle's housing 104 (see FIG. 10*a*). As seen in FIGS. 11*a* through 11*c*, the rotation of the knuckles 101 will cause the knuckle latch ramp 112 (shown in FIG. 10*a*) on the respective knuckles 101 to engage the latch pin 109. This mechanical interaction between the knuckle latch ramp 112 and the latch pin 109 will raise the latch pin 109 and latch member 106 against the bias of latch member spring 108. When the knuckle 101 has rotated a sufficient amount, the latch pin 109 will be forced into the knuckle latch notch 113 via latch member spring 108 so that the coupler 100 will be locked in the closed position (see FIGS. 10*a* and 11*c*).

The conventional mechanical coupler 100 can be opened in two ways: either by manually raising latch pin 109 out of knuckle latch notch 113, or by providing a magnetic pull on latch plate 111 to raise latch pin 109 out of knuckle latch notch 113. The magnetic pull is derived from an electromagnet (not shown) that is built into the track layout at a given location. Accordingly, a user will need to position the train such that the latch plate 111 is positioned over the electromagnet. The user will then energize the electromagnet for pulling the latch plate 111 toward the electromagnet, thereby moving the latch pin 109 out of the knuckle latch notch 113. Once the latch pin 109 is raised out of knuckle latch notch 113, knuckle spring 102 will force the knuckle 101 (and knuckle latch ramp 112/knuckle latch notch 113) back into the unlocked open position (FIG. 11*a*). When the manual or magnetic force is removed, latch member spring 108 will return the latch member 106 and latch pin 109 back into their normal position (shown in FIG. 10*a*).

One of the disadvantages of the conventional mechanical coupler 100 is that, to unlatch a coupler 100, the user must either manually raise the latch member 106 every time a de-coupling is desired, or place the train precisely in a particular position on the track so that the latch plate 111 is located over an operating electromagnet. Furthermore, in order to provide the remote de-coupling, a large electromagnet requiring substantial energy is required in order to overcome the frictional forces resulting from the metal—metal contact between the various elements (e.g., latch pin 109 and housing 104; housing lock pin 105 and latch member 106; latch pin 109 and knuckle 101).

Figure 12A:
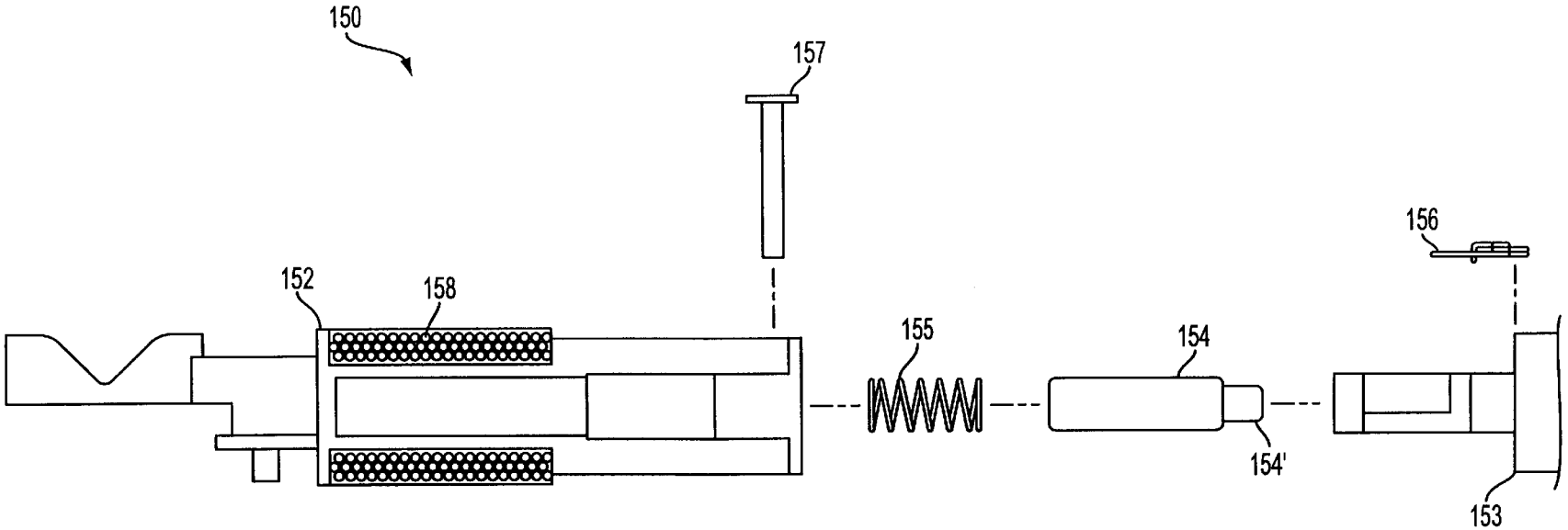
FIG. 12A (PRIOR ART)
FIG. 12*a* shows the basic elements of a conventional solenoid coupler.
Figure 12B:
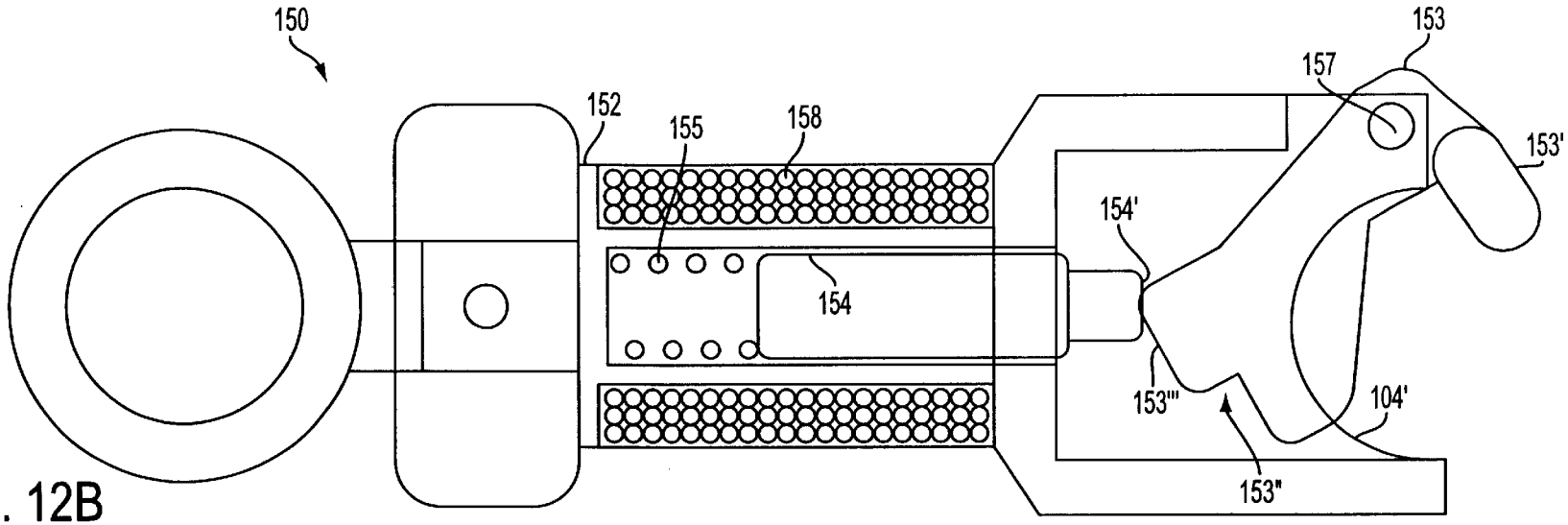
FIG. 12B (PRIOR ART)
FIG. 12*b* shows the conventional solenoid coupler in an un-locked opened position.
Figure 12C:
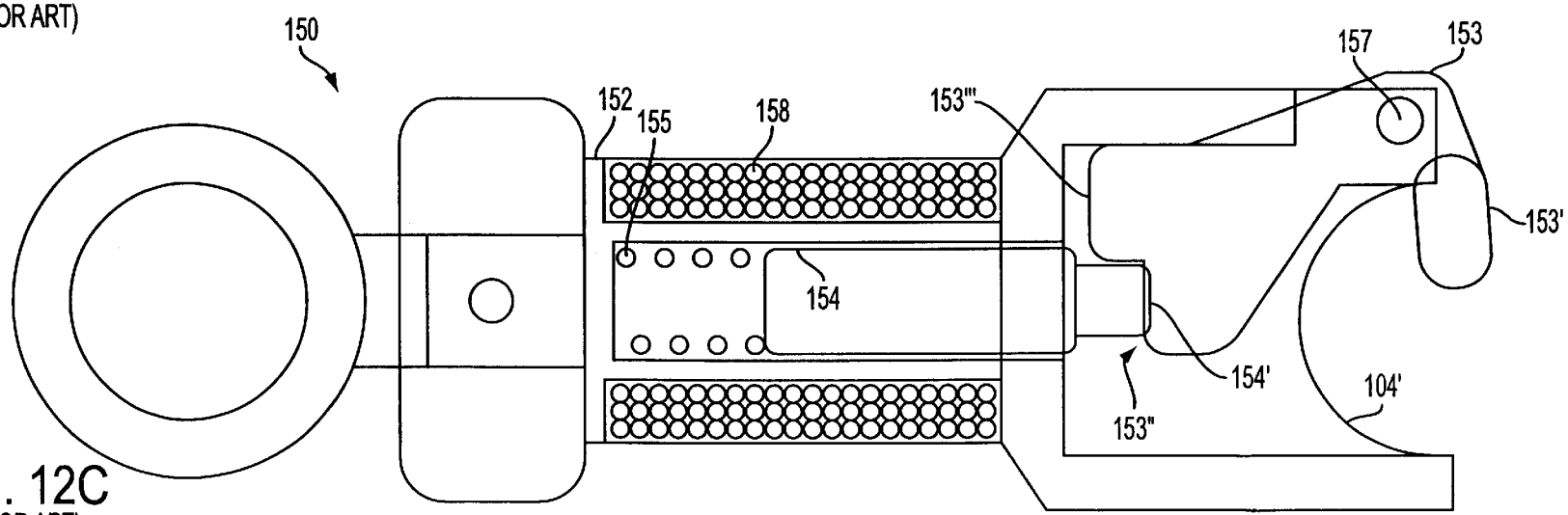
FIG. 12C (PRIOR ART)
FIG. 12*c* shows the conventional solenoid coupler in a locked closed position.

Turning to FIGS. 12*a* through 12*c*, the conventional solenoid coupler 150 is illustrated. The conventional solenoid coupler 150 was designed to overcome the deficiencies of the conventional mechanical coupler 100. In particular, the conventional solenoid coupler 150 was developed to allow remote controlled de-coupling operations to take place anywhere on the track. As shown in FIG. 12*a*, the solenoid coupler 150 comprises a housing 152 and solenoid coil 158. The conventional solenoid coupler 150 further includes a knuckle 153, latch plunger 154, latch plunger spring 155, knuckle spring 156 and knuckle pin 157.

FIG. 12*b* illustrates a cross-sectional view of a conventional solenoid coupler 150 in the unlocked open position while FIG. 12*c* illustrates a cross-sectional view of a conventional solenoid coupler 150 in the locked closed position. Similarly to the conventional mechanical coupler 100 discussed above (see, e.g., FIGS. 11*a*–11*c*), when two couplers 150 are brought together, the respective knuckle arms 153' will engage the inner surface 104' of the other coupler 150, causing the respective knuckles 153 to rotate about their knuckle pins 157.

During initial rotation, the knuckle latch ramp 153'" will contact the latch plunger nubbin 154', thereby pushing the latch plunger 154 against the latch plunger spring 155. When the knuckle 153 has rotated a sufficient amount, the latch plunger nubbin 154' will be forced by the latch plunger spring 155 into the knuckle latch notch 153" and the coupler will be locked in the closed position (shown in FIG. 12*c*).

With the conventional solenoid coupler 150, de-coupling is done remotely through electronic control. In particular, the solenoid coil 158 is electrically energized by circuitry in the train, typically a capacitor (not shown), which is driven by the voltage through the tracks. One of the main problems with the conventional solenoid coupler 150 is the amount of voltage required to sufficiently energize the solenoid 158 for driving the plunger 154. For example, it may take upwards of 12 volts for the solenoid 158 to provide the electromagnetic pull required to move the plunger nubbin 154' away from engagement with the knuckle 153. Additionally, a user would have to put the train in neutral in order to charge the capacitor, and only after the capacitor was sufficiently charged could the coupler be fired.

Accordingly, as discussed above with respect to the conventional mechanical coupler 100, this results in inefficient, costly power consumption. In cases where the tracks provide the voltage used to energize the solenoid 158 (without a capacitor), a user must provide sufficient voltage on the track to effect a de-coupling operation. However, if the user desires to drive the trains at a slow speed which requires less than 12 volts, the user must speed up the trains by increasing the track voltage solely for effecting the de-coupling operation, and then reduce the track voltage to return to the desired train speed/operating conditions. This results in an inconvenient and repetitive process of speeding up and slowing down trains solely for the purpose of de-coupling trains. Accordingly, there is a need in the art for reducing the voltage required to energize the solenoid 158.

Turning to FIGS. 13*a* through 13*g*, the novel coupler 206 of the present invention is illustrated. The coupler 206 includes a coupler body 2061. The coupler body 2061 has two ends, one end 2061' for connecting the coupler 206 to the train and the other end 2061" for connecting the coupler 206 to another coupler 206 of a different train. The coupler 206 is driven by a solenoid assembly 41; however, any conventional driver can be utilized (e.g., DC linear motor). The solenoid assembly 41 includes a bobbin 42, bobbin wiring 42' and bobbin through-hole 42", a solenoid back end 43, a solenoid sleeve 44 (see FIGS. 13*d*, 13*e*), and a solenoid forward end 45. The solenoid sleeve 44 surrounds the bobbin wiring 42' while the solenoid back end 43 and solenoid forward end 45 close the respective openings at the ends of solenoid sleeve 44.

Figure 13A:
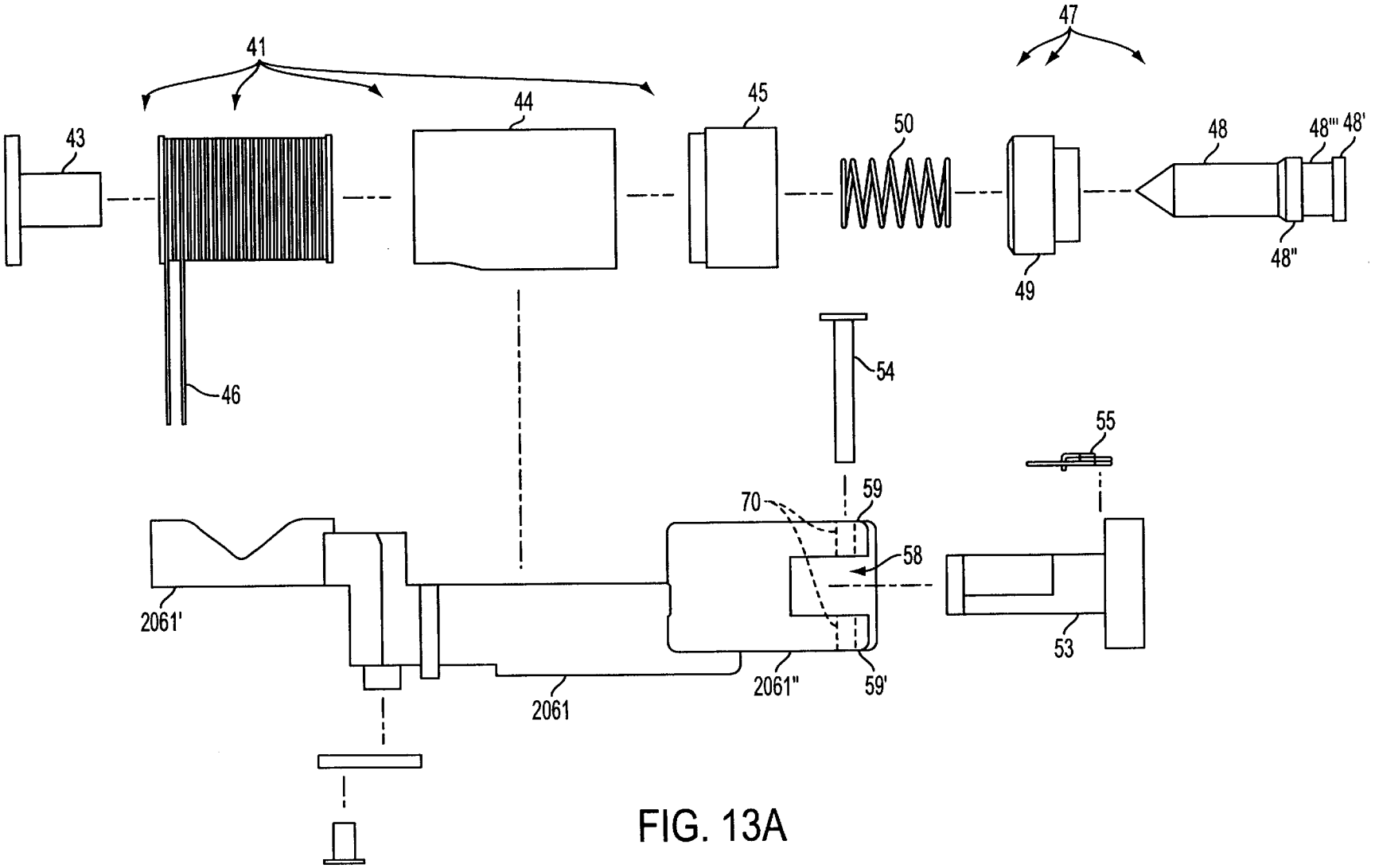
FIG. 13*a* shows the basic elements of an exemplary embodiment of the novel coupler of the present invention.
Figure 13B:
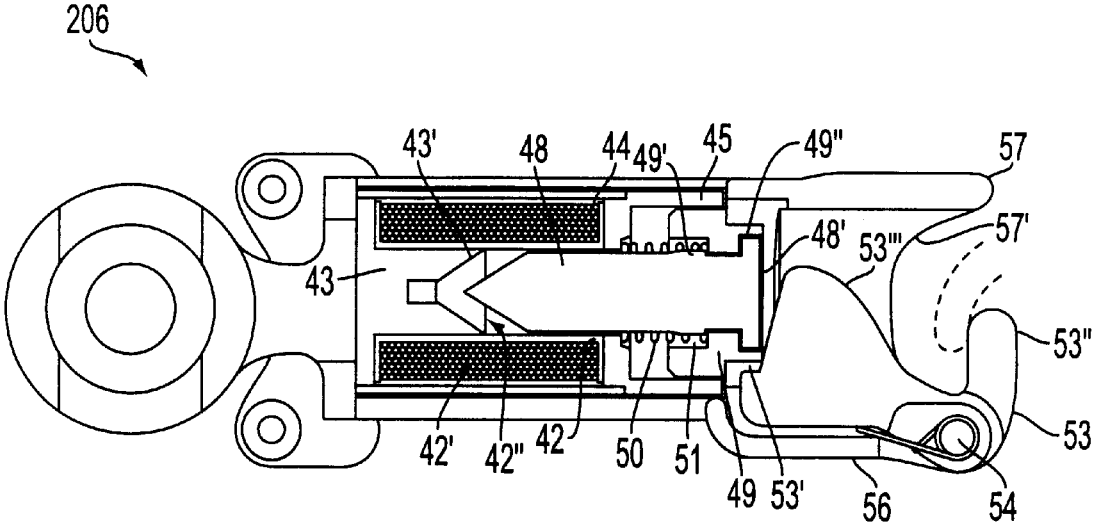
FIG. 13*b* shows the novel coupler of the present invention in the locked closed position.
Figure 13C:
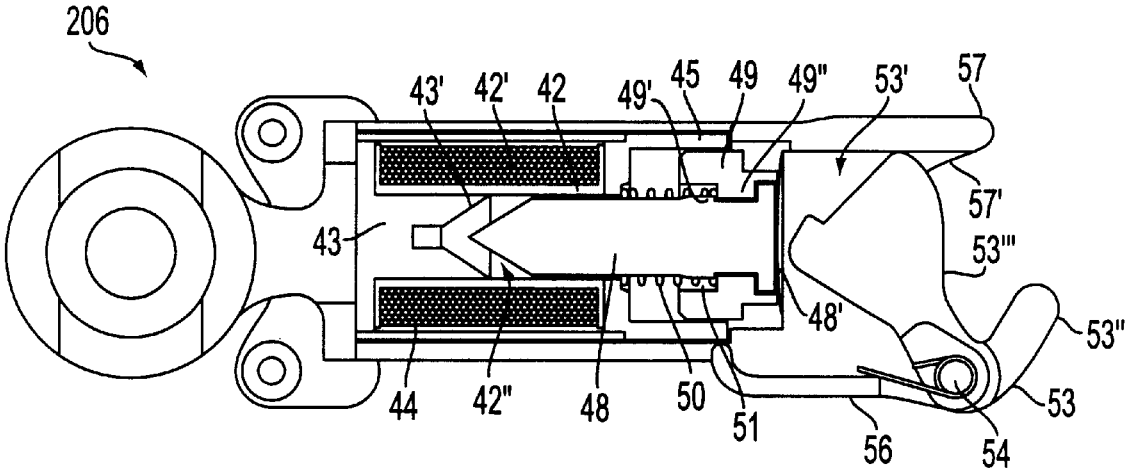
FIG. 13*c* shows the novel coupler of the present invention in the un-locked open position.

The bobbin wiring 42' includes at least one lead wire 46 extending therefrom which is connected to the coupler body 2061 via any known suitable means (e.g., soldering). The lead wire 46 receives a voltage from the track in order to provide power to the solenoid assembly 41. As shown in FIG. 13*a*, the solenoid assembly 41 is housed in an open portion of the coupler body 2061.

The coupler 206 further includes a plunger assembly 47. The plunger assembly 47 includes a plunger 48, a plunger cap 49 and a plunger spring 50. The plunger 48 includes an enlarged diameter head portion 48' located at one end of the plunger 48 and another enlarged diameter ring portion 48" located near the one end, thereby forming a groove 48'" therebetween. The plunger cap 49 is a hollow ring-shaped member with an inner circumferential surface 49' defined therein. Extending radially inward from the inner circumferential surface 49' is an annular projection 49". Accordingly, the annular projection 49" of the plunger cap 49 is tightly fit into the groove 48'" of the plunger 48 therefore locking together the plunger cap 49 and plunger 48. The plunger 48 and plunger cap 49 can also be formed from a single piece of material; however, the manufacturing cost may be increased and/or the benefits of low friction material in the plunger cap 49 may be lost. The integrally formed plunger 48 and plunger cap 49 define a gap 51 located between the inner circumferential surface 49' of the plunger cap 49 and an outer circumferential surface of the plunger 48. The plunger spring 50 functions to bias the plunger 48/plunger cap 49 toward a knuckle 53 (described below) and away from the solenoid assembly 41. One end of the plunger spring 50 is seated against the solenoid forward end 45, and the other end of the plunger spring 50 is guided by the gap 51 to be seated on the annular projection 49".

The end 2061" of the coupler body 2061 which connects to a coupler 206 of another train includes a knuckle 53, a knuckle pin 54, and a knuckle spring 55. The knuckle 53 includes therein a slot 53' whose functionality will be discussed below. The end 2061" of the coupler body 2061 further includes two outwardly extending projections 56, 57 which form a U-shape. The projection 56 has a cut-out portion extending into the projection 56, thereby defining an opening 58 and two parallel arms 59, 59' (see FIG. 13*a*). The two arms 59, 59' each have a hole 70 extending therethrough for receiving the knuckle pin 54. The opening 58 is sized to receive a portion of the knuckle 53, which portion includes a hole therethrough for receiving the knuckle pin 54.

Accordingly, the knuckle 53 is attached to the coupler body 2061 by placing the knuckle portion into the opening 58 and inserting the knuckle pin 54 through the respective holes 70 of the two arms 59, 59' and the knuckle portion. The knuckle pin 54 can be fixed to the projection 56 using any suitable fastening means (e.g., washer). The knuckle spring 55 is fitted between the knuckle portion and either arm 59, 59' of the projection 56 for biasing the knuckle 53 towards its open position (i.e., rotated away from the coupler body 2061). Extending from the other projection 57 is an inner curved surface 57' whose contour effects the coupling of two couplers 206 as will be discussed below.

Operation and the functional relationship between the elements of the novel coupler of the present invention will now be discussed with respect to FIGS. 13*d* and 13*e*. The knuckle 53 can be in a closed position shown in FIG. 13*d* or an opened position shown in FIG. 13*e*. At least one of the couplers 206 needs to be in the open position when coupling of two trains 11 is desired. That is, the knuckle 53 of one or both of the couplers 206 needs to be configured as shown in FIG. 13*e*.

When two trains 11 are ready to be coupled together (i.e., the knuckles 53 of the respective couplers 206 are facing one another), the user enters a command on the hand-held remote control 16 to move one of the trains 11 towards the other (the user could of course also manually bring the trains together). Similarly to the conventional solenoid coupler 150, as the trains 11 approach one another, the knuckle arms 53" of each knuckle 53 pass each other and engage the inner curved surface 57' of the other coupler 206. Accordingly, the knuckles 53 are forced to rotate about their knuckle pin 54 inward against the bias of the knuckle spring 55. As the knuckles 53 rotate, the plunger 48 is forced toward the solenoid back end 43 (i.e., the rotational motion of the knuckle 53 forces the translational motion of the plunger 48). The knuckle 53 slides across the enlarged diameter head portion 48' of the plunger 48 as the plunger 48 retreats downward against the bias of the plunger spring 50.

When the two trains 11 are pushed into each other a sufficient amount, the plunger cap 49 will fall into the slot 53' of the knuckle 53. Accordingly, the plunger spring 50 will force the plunger cap 49 into the slot 53'. As shown in FIG. 13*d*, the plunger cap 49 serves as a stop for preventing the knuckle 53 from rotating to the open position through the bias of the knuckle spring 55. As a result, each knuckle 53 is locked in the closed position, with the respective knuckle arms 53" held together in an overlapping manner (see dashed line in FIGS. 13*b,d*, which represents another coupler 206). Accordingly, the two trains 11 are coupled together in a simple, one step process of simply moving the trains 11 against each other. In fact, a model train engine or car equipped with an open novel coupler 206 can latch and then unlatch with an open or closed novel coupler 206, conventional mechanical coupler 100 or conventional solenoid coupler 150 on other train cars.

When the user wishes to de-couple the trains 11, he/she simply enters the command on the remote control 16. The remote control 16 sends the command (via TIU 12) over the track as discussed above to the engine board 20 and processor 200 thereon. The processor 200 receives the de-couple command and in response, pulses the track voltage to the lead wires 46 in order to energize the bobbin wiring 42' of the solenoid assembly 41. Energizing the bobbin wiring 42' generates a magnetic field. The magnetic field follows a path around the bobbin wiring 42' of the bobbin assembly 42, through the solenoid back end 43, the solenoid sleeve 44, the solenoid forward end 45, the plunger 48, and through a minimized gap between the solenoid back end 43 and the plunger 48 (see FIG. 13*g*).

The magnetic field causes an attraction between the solenoid back end 43 and the plunger 48 thereby pulling the plunger 48 toward the solenoid back end 43 against the bias of the plunger spring 50. The plunger 48 will continue to move toward the solenoid back end 43 until the plunger cap 49 engages the solenoid forward end 45, which serves as a stop for the plunger 48, or when the knuckle 53 is released from the locked position. The distance between the plunger cap 49 and the portion of the solenoid forward end 45 adjacent to the bobbin 42 is configured to be sufficient to allow the plunger cap 49 to move out of the slot 53' of the knuckle 53. Consequently, the knuckle 53 is forced outwardly away from the coupler body 2061 by the knuckle spring 55. At that point, the knuckles 53 are in the open position and the trains 11 are allowed to de-couple.

Figure 13D:
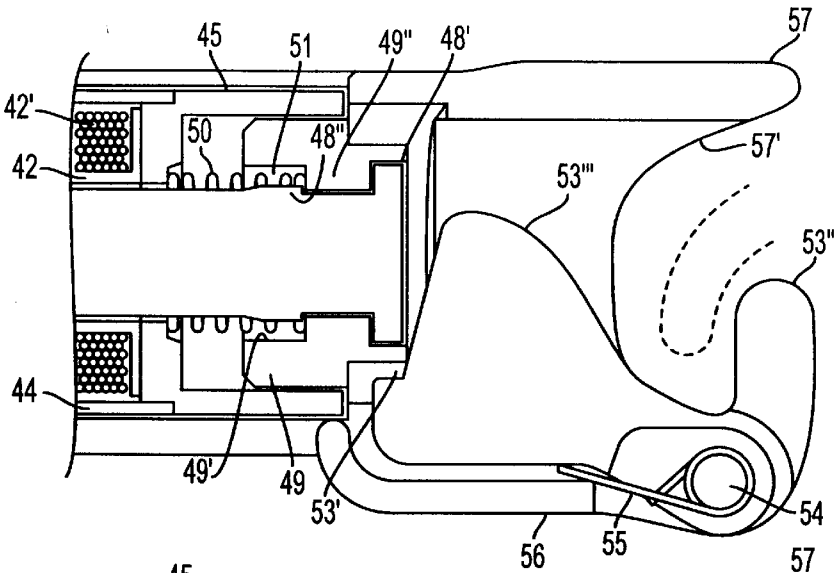
FIG. 13*d* shows a portion of FIG. 13*b* in enlarged detail.
Figure 13E:
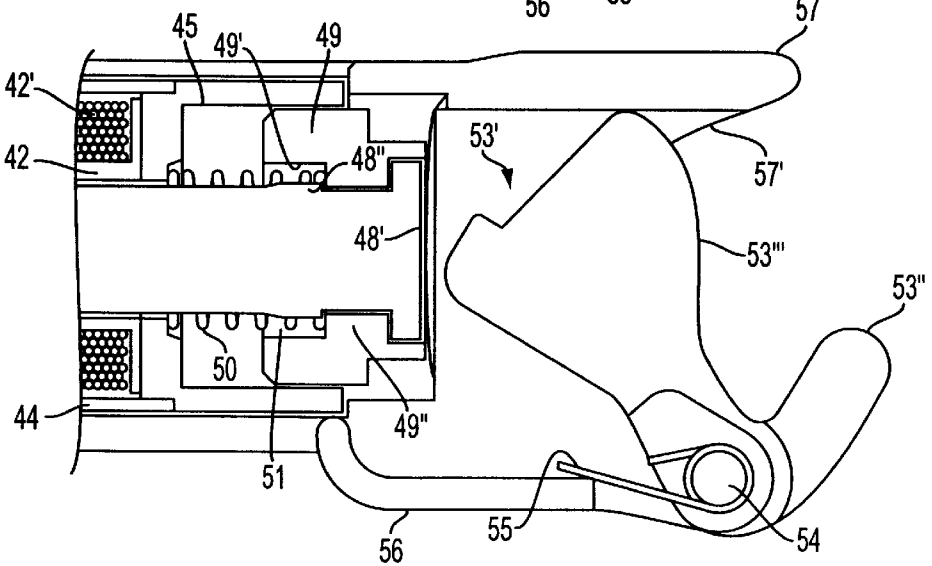
FIG. 13*e* shows a portion of FIG. 13*c* in enlarged detail.

As the knuckle 53 opens, the distance between the projection 57 and the knuckle arm 53" increases (see transition from FIGS. 13*d* to 13*e*). As a result, the knuckle arm 53" of one coupler 206 has sufficient room to move out of engagement with the knuckle arm 53" of the other coupler 206. Moreover, a second knuckle arm 53'" of one coupler 206 further facilitates de-coupling by rotating into the knuckle arm 53" of the other coupler 206 in the closed position, thereby pushing the knuckle arm 53" out of its closed position. It should be noted that the knuckle configuration of the present invention is such that only one bobbin wiring 42' needs to be fired to actuate the de-coupling, although if desired, the bobbin wiring 42' of both couplers 206 could be fired.

The coupler 206 of the present invention operates at significantly less voltage than the prior art due to its unique structure and mechanical connections. The present invention contemplates that the amount of voltage necessary to fire the couplers is approximately 6 volts, or about half the amount of voltage necessary in the conventional solenoid coupler 150. As a result, the coupler 206 can be opened at minimal track voltage without the need to first increase the track voltage to a sufficient amount, or to place the train in neutral and use charged capacitors to provide sufficient voltage to operate the coupler mechanism, as was required by the prior art.

Figure 13F:
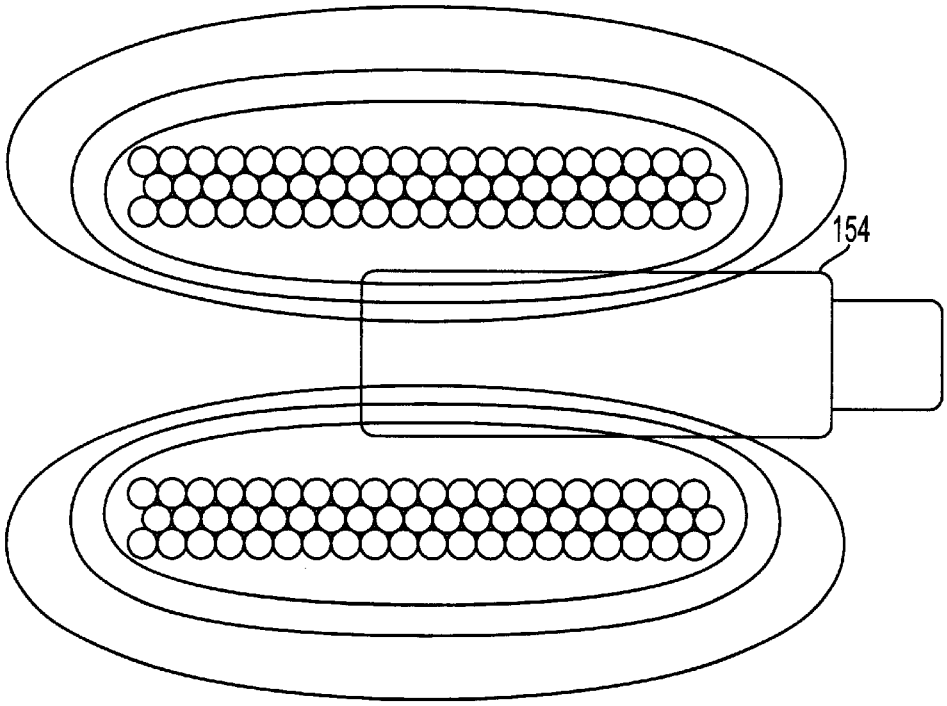
FIG. 13F (PRIOR ART)
FIG. 13*f* shows the magnetic flux lines produced in the conventional solenoid coupler.
Figure 13G:
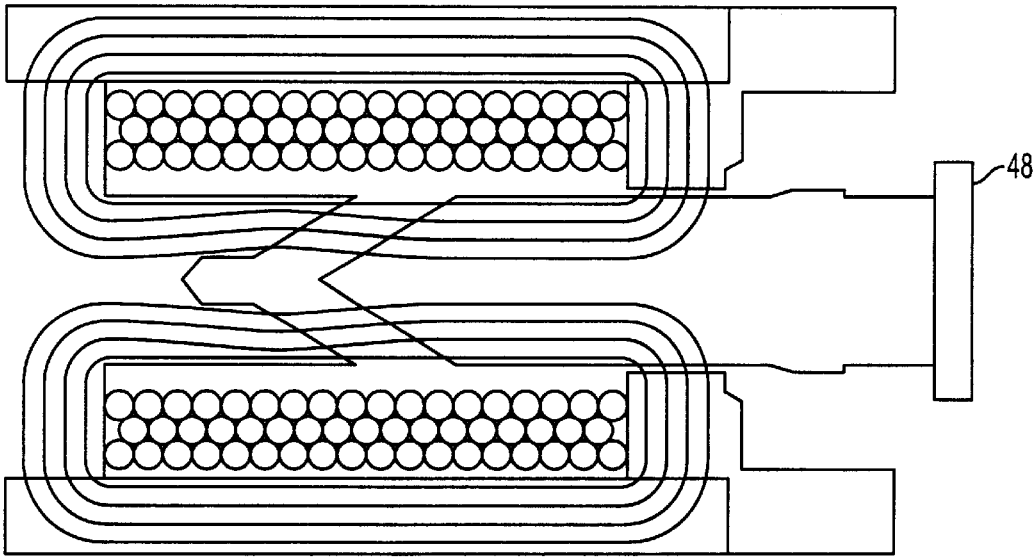
FIG. 13*g* shows the magnetic flux lines produced in the novel coupler of the present invention.

Turning to FIGS. 13*f* and 13*g*, the structural differences between the novel coupler 206 (FIG. 13*g*) and the conventional solenoid coupler 150 (FIG. 13*f*) which give rise to the differing voltage requirements will now be discussed. Both couplers draw voltage from the track to energize their respective solenoids for producing a magnetic field comprising magnetic flux lines. The magnetic flux lines run through the plunger to create a pull on the plunger in the direction of the magnetic flux lines. The more flux lines produced and the more dense those flux lines are, the more magnetic pull applied to the plunger. Ideally, all flux lines should run through the plunger in order to optimize the full pull force available from the magnetic flux lines created by the solenoid. Accordingly, the novel coupler 206 of the present invention was designed and configured to increase the amount and density of magnetic flux as well as to create a magnetic circuit that maximizes the amount of flux lines that run through the plunger (as opposed to outside of the plunger).

In order to increase magnetic flux, the novel coupler 206 provides an improved "magnetic circuit" that incorporates ferromagnetic material. Specifically, each of solenoid sleeve 44, solenoid forward end 45, plunger 48 and solenoid back end 43 are made from ferromagnetic material (preferably, steel) for conducting the magnetic flux lines in an intimate closed circuit. Accordingly, a greater number of magnetic flux lines that are more closely spaced (i.e., more dense) are produced. Furthermore, as the solenoid forward end 45 surrounds the majority of the plunger 48, the closed magnetic circuit produced by the configuration of the aforementioned elements of the novel coupler 206 increases the number of flux lines that run through the plunger 48.

FIG. 13*g* illustrates generally the magnetic flux lines produced by the novel coupler 206 of the present invention (the thickness of the sleeve 44 has been exaggerated to better illustrate the sleeve's ability to contain essentially all the flux lines within its thickness). In contrast, turning to FIG. 13*f*, the magnetic flux lines produced by the conventional solenoid coupler 150 are both smaller in amount and more diffuse (i.e., less dense), resulting in a less-efficient conversion of voltage to magnetic pull. In addition, some of the flux lines run outside of the plunger 154 (adjacent the plunger nubbin 154'), thereby wasting a portion of the magnetic pull created by the solenoid wiring 158.

Several factors contribute to this deficiency in the conventional solenoid coupler 150. Foremost among them is the lack of ferromagnetic material for conducting the magnetic flux lines. The only ferromagnetic material found in the conventional solenoid coupler 150 is in the plunger 154. The housing 152 is made from non-ferromagnetic material (e.g., zinc). Furthermore, there is no sleeve, solenoid forward end, or solenoid back end to form a closed magnetic circuit around the solenoid wiring 158. Accordingly, as there is no structural boundary for which to contain the magnetic flux lines, leaving only air as the magnetic conductor (which is highly inefficient), the resulting magnetic flux lines are diffused about a greater area surrounding the conventional solenoid coupler 150. Therefore, as shown in FIG. 13*f*, the magnetic flux lines produced in the conventional solenoid coupler are far fewer and less dense than those produced in the novel coupler 206 of the present invention shown in FIG. 13*g*. Because the end portion of the plunger 154 (including plunger nubbin 154') is not surrounded by a ferromagnetic material (which would have extended more of the magnetic circuit through the plunger 154), some flux lines are lost from the plunger 154 in the conventional solenoid coupler 150, as shown in FIG. 13*f* (flux lines moving away from plunger 154 before running completely through plunger 154).

As a result of the structural distinction between the novel coupler 206 of the present invention and the conventional solenoid coupler 150, the novel coupler 206 will produce significantly more magnetic pull with the same amount of applied voltage. It follows that the novel coupler 206 will require less voltage than the conventional solenoid coupler 150 to produce the same magnetic pull. For example, if it takes 12 volts to provide the needed magnetic pull for moving the plunger 154 out of engagement with the knuckle 153 (thereby effecting a de-coupling operation) in the conventional solenoid coupler 150, it would take only about 6 volts in the novel coupler 206.

Moreover, the aforementioned difference in voltage requirements between the conventional solenoid coupler 150 and the novel solenoid coupler 206 is based on the assumption that the various mechanical interactions (e.g., plunger sliding on bobbin/housing, knuckle/plunger interface, etc.) result in the same frictional resistance in both couplers.

However, another advantage of the novel coupler 206 is the elimination of metal-to-metal contact, which decreases wear/tear (improving reliability) as well as decreasing the frictional forces that the magnetic pull needs to overcome for de-coupling the coupler. The conventional solenoid coupler 150 does not include a bobbin and therefore the solenoid wiring 158 is wrapped directly around the metal (e.g., zinc) housing 152. As a result, the steel plunger 154 is in bearing contact with the inner surface of the housing 152. This metal-to-metal contact increases the resistive frictional forces, thereby increasing the amount of magnetic pull needed to pull the plunger, as well as adding to the wear/tear of both the plunger 154 and the inner surface of the housing 152.

In contrast, the novel coupler 206 incorporates a spool-like Acetal plastic bobbin 42 which holds the bobbin wiring 42' around its outer surface. It should be appreciated that any low-friction plastic may be used (e.g., Nylon). Accordingly, the metal plunger 48 is in bearing contact with the plastic inner surface of the spool-like bobbin 42 within the bobbin through-hole 42", resulting in less wear/tear and frictional resistance.

Similarly with respect to the knuckle/plunger mechanical interaction, the conventional solenoid coupler 150 incorporates metal—metal contact (steel plunger nubbin 154' and zinc knuckle 153). In contrast, the plunger cap 49 of the novel coupler 206 is made from low-friction plastic (Acetal, Nylon, etc.), thereby inducing a plastic-metal contact between itself and the knuckle. As a result, the novel coupler 206 greatly reduces the wear/tear and frictional resistance resulting from the mechanical movements within the coupler 206.

Other improvements and advantages of the novel coupler 206 will now be discussed. The solenoid forward end 45 serves other important functions in addition to completing the magnetic circuit for the flux lines. In particular, the solenoid forward end 45 serves as a bearing for the plunger cap 49, thereby guiding movement of the plunger assembly 47. The solenoid forward end 45 may be configured with an inner diameter slightly larger than the diameter of the plunger 48 in order to prevent bearing metal-to-metal contact therebetween, further reducing friction and wear. As a result of the bearing contact between the plunger cap 49 and solenoid forward end 45 (which is also a plastic-metal interface for reducing frictional/wear), any side thrust force exerted on the plunger 48 from the coupling operation will be absorbed at the end of the plunger 48 (as opposed to the portion of the plunger 48 just outside of the bobbin 42). This dramatically reduces any bending movement applied to the plunger 48 which would otherwise damage the plunger 48 over time. In addition, the solenoid forward end 45 acts as a locating feature for mounting the bobbin 42 onto the coupler body 2061. These combined functions of the solenoid forward end 45 reduce tolerance buildups in the overall design of the novel coupler 206. Even further, the configuration of the solenoid forward end 45 provides the capability to exclude the plunger spring 50 from the magnetic path (by functioning as a spring seat outside of the magnetic path; see FIGS. 13*d*, 13*e*), thereby allowing the magnetic path to incorporate as much steel as possible. However, in the conventional solenoid coupler 150, the plunger spring 155 is positioned within the housing 152. This displaces steel from the magnetic circuit (e.g., by displacing a solenoid back end) of the conventional solenoid coupler 150, which contributes to fact that the magnetic path in the conventional solenoid coupler 150 is essentially all air (except for plunger 154). As discussed above, the solenoid back end 43 of the novel coupler 206 closes the magnetic circuit and increases the amount of metal (e.g., steel) in the magnetic circuit (thereby increasing magnetic flux). As an additional enhancement for the magnetic flux, the solenoid back end 43 includes a conical end shape 43' that receives a corresponding conical end portion of plunger 48. This configuration further minimizes air gaps in the magnetic circuit.

The plunger cap 49 provides several important functions, some of which include: (1) acting as a seat and pocket for the plunger spring 50, (2) acting as a bearing for the end of the plunger assembly 47 contacting the knuckle 53, (3) acting as a stop for the plunger assembly 47 when the bobbin wiring 42' is energized (importantly, this function prevents contact between the plunger 48 and solenoid back end 43, which could otherwise allow residual magnetic fields to keep the plunger 48 in the energized position; i.e., precluding the ability to lock the knuckle 53 in the closed position), and (4) acting as the surface which latches into the slot 53' of the knuckle 53. It is preferred that the plunger cap 49 be made of a one-piece construction, thereby minimizing parts and tolerances. The hole through the bobbin 42 serves as a bearing for the plunger 48. Thus, the plunger 48 motion is guided by plastic bearings, avoiding metal-to-metal contact with its consequential high friction forces and wear. It is further preferred that the plunger cap 49 and bobbin 42 be made from Acetal Plastic or other low friction, high impact plastic (including but not limited to Nylon), thereby minimizing friction in the bearing and latch functionality resulting in a further reduction in the voltage required to energize the bobbin wiring 42'.

In summary, the coupler 206 of the present invention provides significant advantages over the conventional prior art couplers for several reasons. In particular, the construction of the coupler 206 of the present invention greatly reduces the frictional forces between the moving parts resulting from the locking and unlocking of the knuckle 53 into and out of coupling position. Accordingly, the coupler 206 avoids the wear and tear inherent in the prior art couplers 100 and 150. The steel back end 43, sleeve 44 and front end 45 form a magnetic path with the plunger 48 which greatly enhances the flux generated in the bobbin wiring 42', compared to the prior art solenoid coupler 150. The combination of low friction and efficient magnetic path allow the novel coupler 206 to operate under much lower voltage than the prior art. The novel configuration of the coupler 206 of the present invention therefore provides significant advantages over the prior art both in its structure and its function.

Smoke/Steam Unit

Yet another feature of the present invention is a new smoke/steam unit design. Various methods exist in the prior art for producing puffs of "smoke" or steam from the model train, in an effort to depict a real train working as it moves down a track. This application will refer to the "smoke unit" hereafter, although it should be understood that the same design and principles apply to "steam."

Figure 14A:
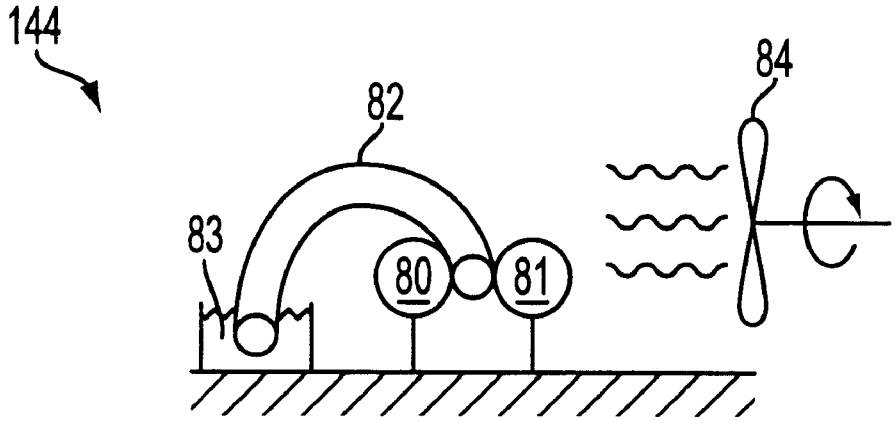
FIG. 14*a* shows one exemplary embodiment of a smoke unit of the present invention.
Figure 14B:
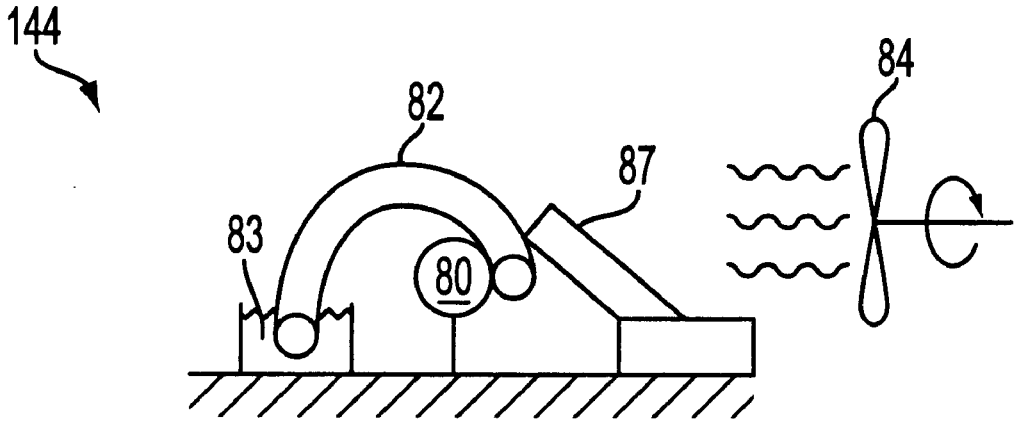
FIG. 14*b* shows another exemplary embodiment of a smoke unit of the present invention.
Figure 14C:
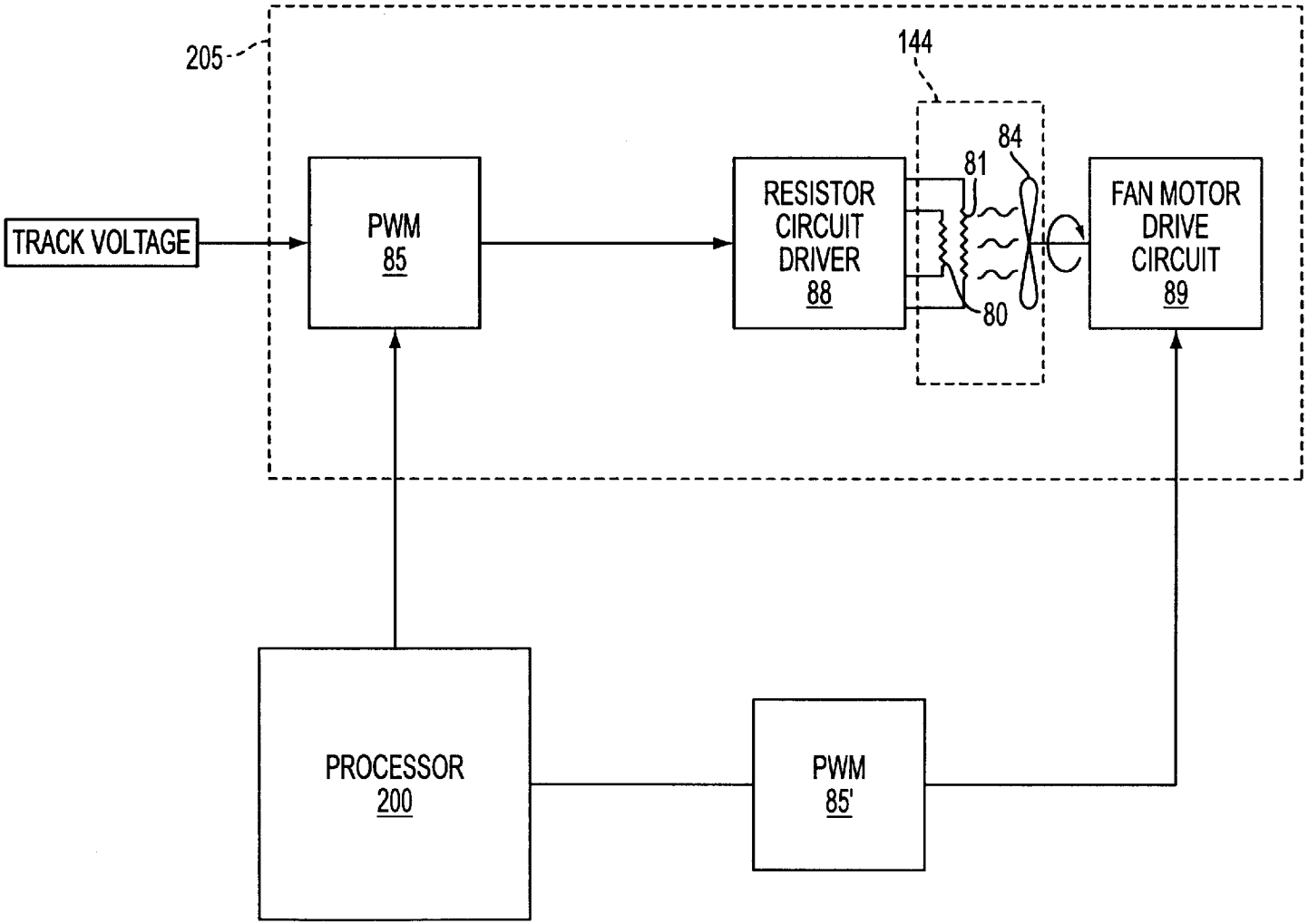
FIG. 14*c* shows the control schematic for the smoke unit of the present invention.

Turning to FIGS. 14*a* through 14*c*, an exemplary novel smoke unit 144 of the present invention will be described. The smoke unit 144 includes two resistors 80, 81, fiberglass material 82, an oil substance 83, and a fan 84. One resistor 80 can also be used, preferably in combination with a biasing member 87 (as shown in FIG. 14*b*), but two resistors will more securely hold the fiberglass material. The smoke unit 144 produces smoke by supplying the resistors 80, 81 with track voltage. Consequently, the resistors 80, 81 heat up and vaporize the oil substance 83 to produce the smoke while the fan 84 "puffs" out the smoke from the train.

The quantity of smoke outputted by the smoke unit 144 is directly related to the power applied to the resistors 80, 81. That is, the more voltage applied to the resistors 80, 81, the more smoke will be outputted. The smoke unit 144 can be controlled in two modes, manual and automatic. The user can select in which mode to operate by inputting the desired mode on the remote control 16. In manual mode, the user will input on the remote control 16 one of, for example, three possible quantities of smoke: high, medium, and low (it should appreciated that that any number of quantities of smoke can easily be programmed into the processor). Accordingly, at any time during operation for any train(s), the user can initiate a smoke output.

For example, if the user wants one of the train(s) to puff a high quantity of smoke (e.g., when climbing a hill, implying the engine is working hard), the user first inputs the digital address of the desired train(s) (or, if the user desires all the train(s) to output the smoke, then he/she can go directly to the next step without indicating a particular train). Next, the user enters the quantity of smoke desired (low, medium, and high) into the remote control 16.

The remote control 16 sends the request via RF signals to the TIU 12, which in turn sends the request to the track 10. The signal from the TIU 12 searches for the selected train(s) via the digital address. The processor 200 on the engine board 20 of the train(s) will interpret the signal as a request for a low, medium, or high quantity of smoke.

The processor 200 adjusts the amount of voltage applied to the smoke unit 144, and thereby the quantity of smoke, by using a smoke system driver circuit 205 (see FIGS. 4 and 14*c*) that comprises a pulse width modulator circuit 85 to adjust the time that voltage is applied to a resistor circuit driver 88, which controls the voltage applied to the resistors 80, 81. The fan 84 will be turned on via a fan motor drive circuit 89, to puff out the smoke. Accordingly, the smoke unit 144 will be able to produce the needed smoke independently of the track voltage. For example, if the track voltage is high but the request for smoke is low, the processor 200 will adjust the power applied to the resistors 80, 81 by pulse width modulating the track voltage to decrease the time the voltage is applied to the resistors 80, 81. Similarly, if the track voltage is low (e.g., in "Conventional" or "Legacy" mode, where the train(s) are moving at slow speeds), the pulse width modulator 85 will increase the time the voltage is applied to the resistors 80, 81. Alternatively, the voltage applied to the resistors 80, 81 could also be controlled by using a linear voltage regulator (not shown).

Another novel feature of the present invention is the fast response time of the smoke system driver circuit 205. The smoke system driver circuit 205 of the present invention uses an electronic brake (not shown) located in the fan motor drive circuit 89 to quickly stop or start blowing the smoke out of the smoke unit 144. In particular, the electronic brake is a FET (not shown) that is placed across the fan motor that will short out the motor when the user commands the smoke unit 144 to stop blowing smoke. As an alternative, the processor 200 can also be programmed to momentarily reverse the voltage on the motor to stop the fan 84 even quicker. Accordingly, the smoke unit 144 will immediately stop or start blowing smoke at the user's command. In another embodiment, the fan 84 would run continuously and a valve or shutter could be used to stop the airflow at the desired time, thereby stopping the flow of smoke.

In automatic mode, the novel smoke system driver circuit 205 of the present invention will control the smoke unit 144 according to the speed and load of the train(s) in order simulate a realistic steam and/or diesel train. In other words, the smoke will be outputted automatically at a rate and quantity that matches the current condition of the train(s), similarly to what takes place in a real-life train.

The rate at which the smoke is "puffed" out is dependent on the speed of the train(s). There are various types of trains, each having distinct qualities with respect to their respective smoking systems. A steam engine train will output discrete "puffs" of smoke in response to the revolutions on the wheel. For example, for every ¼ turn of a wheel, the smoke unit 144 would output one "puff" of smoke (of course, the processor 200 can be programmed, via the remote control 16, to any correlation between the wheel revolutions and the number of "puffs"). In contrast, a diesel engine train outputs smoke at a continuous rate. The smoke unit 144 of the present invention works under both conditions (discrete vs. continuous).

Accordingly, in steam engine mode (which can be selected using the remote control 16), the processor 200 will control the on/off switching rate of the fan 84 based on the output of the speed sensor 2073. The speed sensor 2073, as discussed above, is a direct measure of the revolutions per minute ("rpm") of the wheels of the train(s). Accordingly, if the speed sensor 2073 indicates that the wheels are turning at 100 rpm, then the processor 200 will command the fan 84 of the smoke unit 144 to turn on and off at 400 times/minute (100 revolutions*4 "puffs" per revolution). In diesel mode, the processor 200 will use steady state control of the fan 84, as opposed to on/off switching, to gradually increase the rate the smoke is outputted as the speed of the train increases. This is accomplished by the PWM 85 (see FIG. 14*c*).

The operation of the smoke unit 144 in automatic mode with respect to the quantity of smoke will now be discussed. In order to obtain the quantity of smoke to be output by the smoke unit 144, the processor 200 will determine the load on the motor 2072 of a train(s) by calculating the power that is currently required to move the train(s) at a given speed. The calculated result is then compared to the "normal" power required to move the train(s) at the given speed, which "normal power" is stored in flash memory 209 for the particular motor on the engine board 20. This comparison will indicate to the processor 200 whether the motor 2072 is requiring more power or less power than normal to run at the current speed. Accordingly, the processor 200 will implicitly know the load on the motor 2072 of the train(s). The processor 200 will then automatically operate the smoke unit 144 according to the load on the motor 2072.

An example will better illustrate how the smoke unit 144 controls the quantity of smoke in automatic mode. As discussed above, a user initiates operation by inputting on the remote control 16 the desire for the system to be in automatic mode for the smoke unit 144. Accordingly, when the train is running under normal conditions, the comparison of the "normal" power consumption of the motor 2072 at a given speed and the actual power consumption of the motor at the given speed will have a one-to-one ratio.

However, when the train goes up a hill, although the speed will remain the same as a result of the novel speed control system of the present invention and therefore the rate of puffs will not change, the power inputted into the motor will increase (which will be sensed by a voltage sensor for example) by virtue of the increased duty cycle. Accordingly, the processor 200 will deduce that the load on the motor 2072 has increased. As a result, the processor 200 will command that more voltage be applied to the resistors 80, 81 by increasing the duty cycle via the pulse width modulator circuit 85 (the fan 84 will remain at the same rate because the train is moving at the same speed). The resistors 80, 81 will get hotter and thereby release a more dense "puff" of smoke. Similarly, when going down hill, the reduced load on the motor 2072 is sensed, the duty cycle reduced, and the resistors 80, 81 will get less hot and thereby release a less dense "puff" of smoke. The density of smoke will be output in the same fashion regardless of being in diesel mode or steam engine mode.

Brake and Crash Sounds

Some other features of the present invention are now described. The processor 200 can be directed by the user via the remote control 16 to automatically retrieve, for example, a brake sound when the train slows down at a given rate. For example, if the track voltage (reflecting user's desired speed) in "Conventional Mode" is reduced at a rate faster than 5 MPH/second, the processor 200 will sense the deceleration using the feedback from the speed sensor 2073 and thereby retrieve the requisite sound file to play a "braking" sound. As another example, if the contact between the roller (not shown) of the train(s) which rolls on the charged center rail is lost, for example if the train is derailed (i.e., speeding too fast around a corner, etc.), the processor 200 can be programmed to retrieve a "crash" sound stored in the flash memory 209.

Doppler Effect Features

Each of the sounds played through the train speaker 208" can be modified to incorporate the Doppler Effect. A description of the Doppler effect characteristics of the present invention will now be provided. The Doppler effect is a well-known principle that represents the change in pitch and volume that results from a shift in the frequency of the sound waves as evidenced by the sound of an approaching object. A common example of the Doppler effect is experienced when an ambulance or fire truck approaches. As the vehicle approaches an observer, the sound waves from the siren are compressed towards the observer. The intervals between the sound waves diminish, which results in an increase in the frequency or pitch of the siren. As the vehicle recedes past the observer, the sound waves are stretched relative to the observer, causing a decrease in the pitch of the siren. Thus, by listening to the change in pitch of a siren, the observer is able to determine if the vehicle is approaching or speeding away.

Figure 16A:
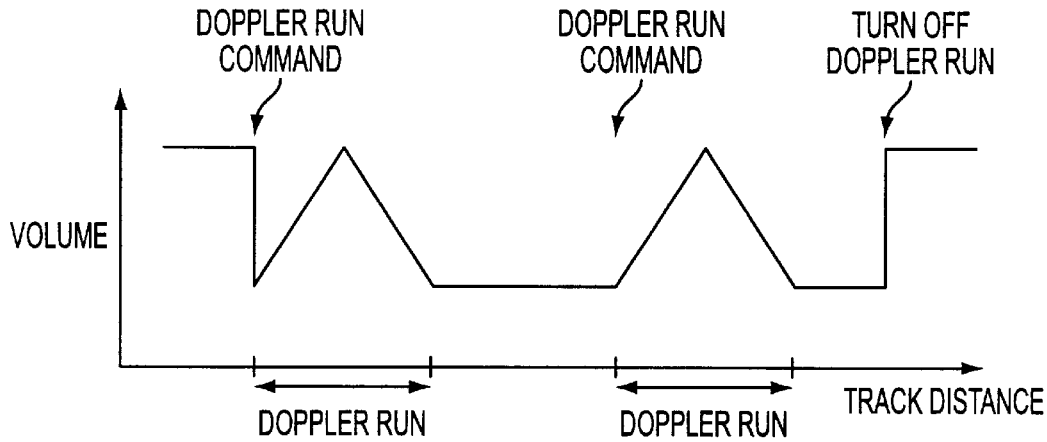
FIGS. 16*a*–16*d* show graphs of the Doppler effect simulations capable with the present invention.

The most basic implementation of the Doppler effect in the present invention will be referred to as a "Doppler run." FIG. 16*a* graphically depicts the Doppler run mode. The user sets the volume of the train sounds at some maximum arbitrary level, such as 75 dB (this is a non-limiting example only) from the remote control 16. As the model train cycles around the tracks, the user enters the command for a Doppler run. This is based on a fixed distance that the train travels, and can be pre-programmed to any reasonable distance. As one example, assuming the model track layout is approximately 25 feet of track, the fixed distance could advantageously be programmed to be 25 feet.

Once the user enters the Doppler run command, the volume of the train immediately drops to a fixed attenuation level, for example, 40 dB. The train processor 200 then monitors the distance the train travels (speed versus time) and causes the sound output from the train to rise from the 40 dB level to the maximum arbitrary level of 75 dB. The maximum volume level is obtained at approximately the mid-way point of the fixed distance (in the above example, at approximately 12.5 feet). The sound then drops back to the attenuated level of 40 dB, which is reached when the train completes the fixed distance (in the given example, at the point where 25 feet of track has been traversed). The pitch of the sound behaves in the same fashion, and is a function of the real-time speed of the train.

The Doppler run command allows a user to simulate the real-life Doppler effect on the model train track layout 10. For example, assume that the user has an observer stationed at one end of the track. At the point when the train is the farthest away from the observer, the user enters the Doppler run command. The sound of the train will immediately drop to the attenuated level and shift the pitch according to the speed of the train, giving the observer the effect that the train is far off in the distance. As the train approaches the observer, the sound increases until the point when the train passes the observer, at which point the maximum volume is reached. The pitch of the train increases as it approaches and then drops to a zero shift at the point when the volume is maximum. Once the train passes the observer, the sound immediately begins to decrease and the pitch is at a negative frequency shift (see FIG. 16*d*). Thus, the observer is left with a sense of the real Doppler effect, as the train whooshes past the observer. The observer hears the oncoming sound followed by the receding fade in the same manner as a person standing by a real set of train tracks.

Figure 16B:
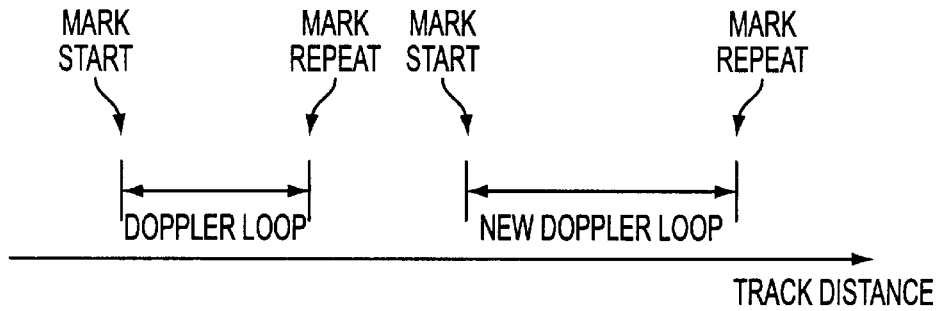
Figure 16C:
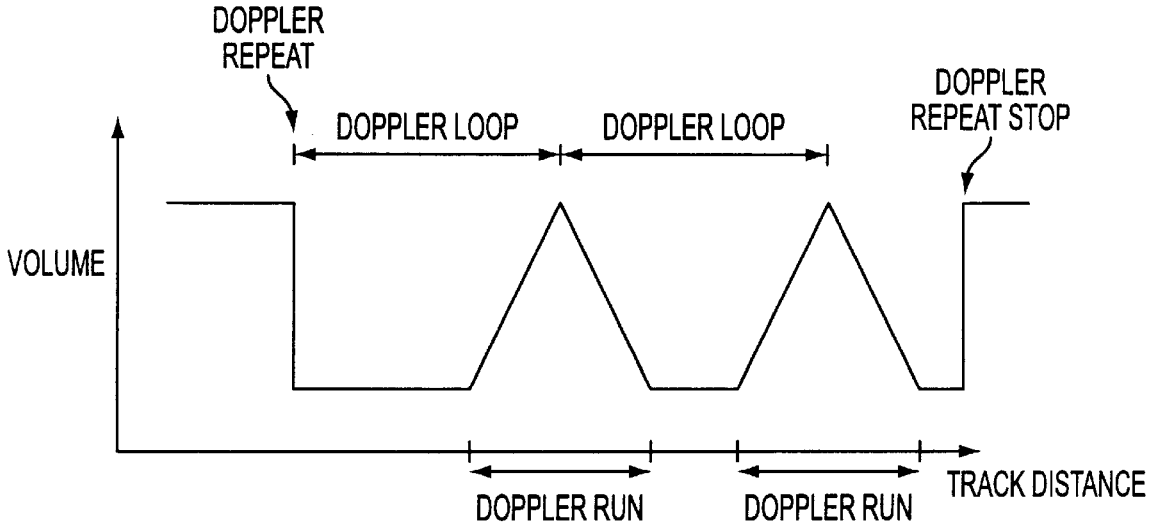
Figure 16D:
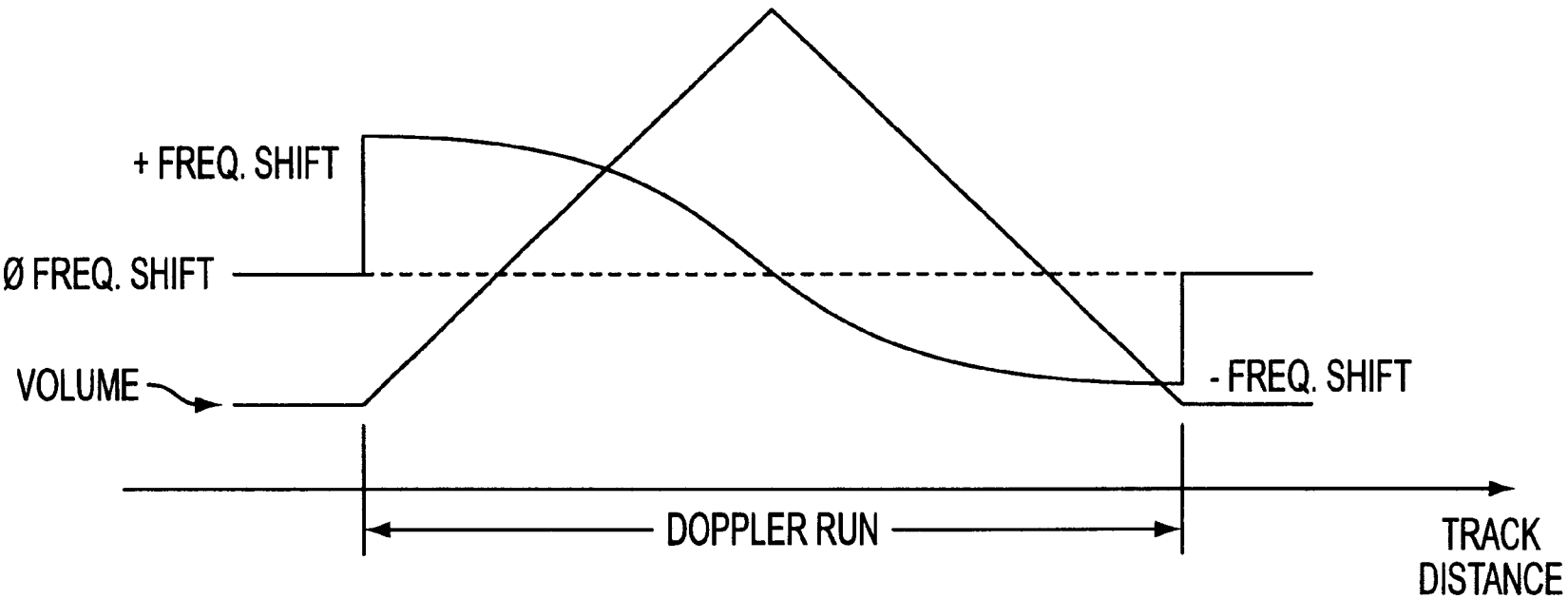

The next embodiment of the Doppler effect in the present invention is called the "Doppler repeat." This mode of operation is graphically depicted in FIGS. 16*b* and 16*c*. The user enters a "Mark Start" command on the remote control. This resets an internal odometer inside the model train. The odometer accumulates the distance travelled by the train until the user enters a "Mark Repeat" command on the remote control. The accumulated distance from Mark Start to Mark Repeat is the "Doppler loop."

In operation, the user then enters the Doppler repeat command. The volume immediately drops to the far-off attenuation level, for example, 40 dB, and the pitch shifts according to the train speed. The model train processor then calculates the required distance for causing the Doppler peak to occur at the Doppler loop point. The volume will thereafter peak at every Doppler loop distance travelled, and the pitch shift will demonstrate the characteristics shown in FIG. 16*d*, until the user turns off the Doppler repeat command.

Chuff Sounds

Similarly to the smoke unit 144, the sound system circuit 208 can be programmed to automatically output sounds corresponding to the condition of the train(s) 11. Specifically, every time the processor 200 sends a "puff" signal to the smoke system driver circuit 205 in response to the feedback of the speed sensor 2073, the processor 200 will simultaneously retrieve from the flash memory 209 a "chuff" sound file. This chuff sound file is sent to the sound system circuit 208. Accordingly, for every "puff" of smoke there will a "chuff" of sound, both corresponding to the speed of the train.

Further, there are three possible "chuff" sounds reflective of the load on the train(s): constant (normal), labored "chuff" and drift "chuff". Again, with respect to the load on the train(s), the sound system circuit 208 will respond via the processor 200 to the load measurements on the motor 2072 in the same fashion as the smoke system driver circuit 205. That is, if for example the train 11 is going up a hill, the processor 200 will sense the increase in load and will thereby alter the sound to reflect a "labored" chuff sound. In the same way, if the train(s) is going down a hill, the processor 200 will sense the decrease in load and will thereby alter the sound to reflect a "drift" chuff sound. In addition, the "labored" and "drift" chuff sounds can be utilized in the "conventional" or "legacy" mode of operation in the following manner: whenever track voltage is increased, "labored" chuffs will be played, and conversely, whenever track voltage is decreased, "drift" chuffs will be played.

Light Control

The light driver circuit 204 includes a pulse width modulator (not shown) in order to maintain the same brightness regardless of the track voltage to thereby attain the realism associated with a real-life train (i.e., a real-life train does not regulate its light output dependent on power to the engine). Of course, it is also contemplated that a user could obtain a desired brightness and colors by entering the command on the remote control 16.

Accessory Interface Unit

Figure 17A:
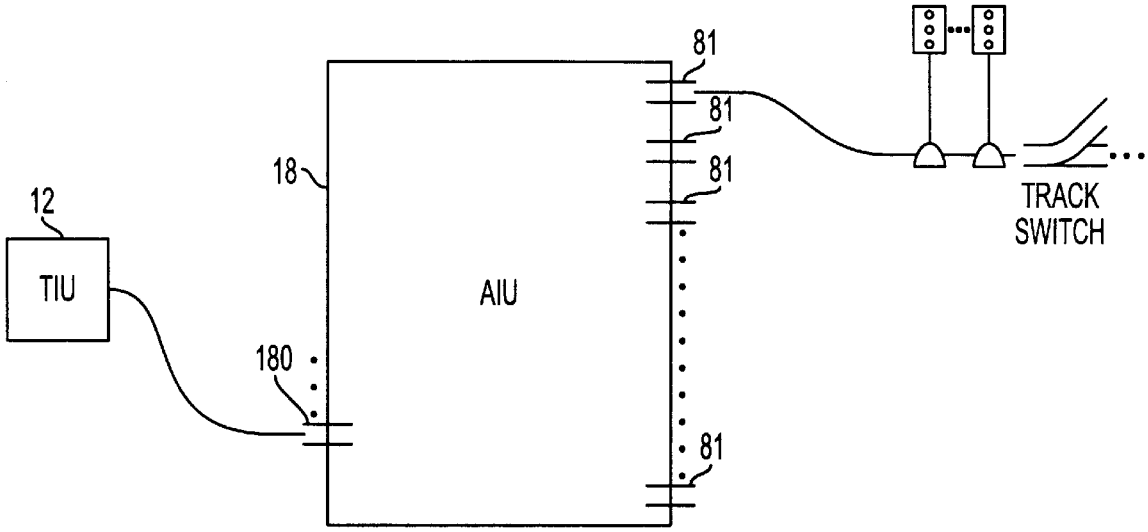
FIG. 17*a* shows one exemplary embodiment of the Accessory Interface Unit of the present invention.
Figure 17B:
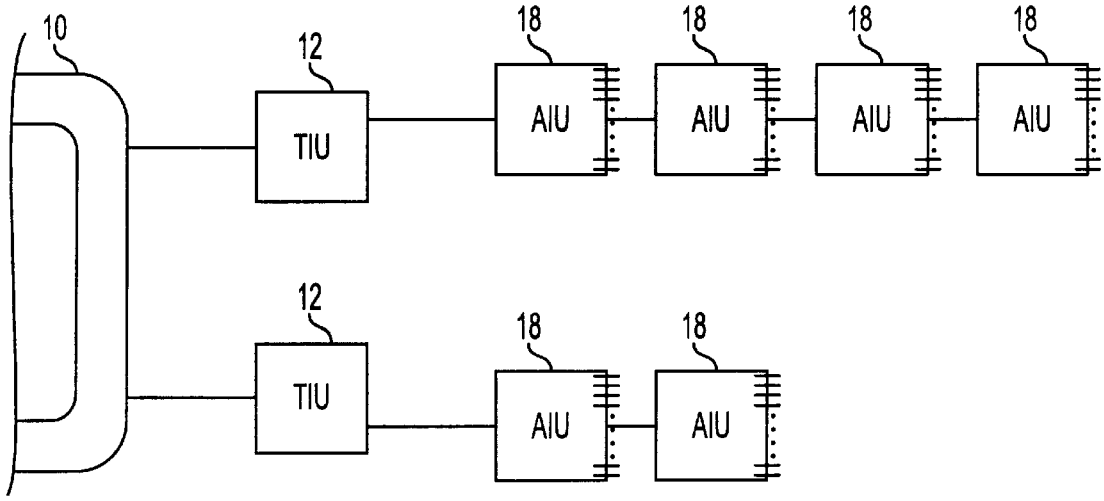
FIG. 17*b* shows one exemplary embodiment of a plurality of Accessory Interface Units attached to the track layout.

Turning to FIGS. 17*a* and 17*b*, the AIU 18 will be discussed in greater detail. The AIU 18 functions to control operation of any of the accessories (examples provided below) included in the track layout 10 (it should be noted that the AIU 18 can also be coupled to accessories not within the immediate track layout 10; e.g., a gas station around the periphery of the track layout 10). The AIU 18 can be powered by any suitable means, including, but not limited to, a transformer connected to a standard wall outlet (not shown) (this can be same as the transformer the powering track), or a battery. The AIU 18 is coupled to the TIU 12 (see FIG. 17*a*) via an input 180. The connection between the AIU 18 and TIU 12 can also be any known suitable means, including, but not limited to, a phone line or a conventional power line. The difference between the two examples (phone line or conventional power line) lies in the type of communication signal (fiber optic phone signal or voltage at given frequency) that will be sent to the AIU 18 from the TIU 12.

The AIU 18 further includes a set of output relays 181 which are coupled to various portions of the track layout 10 through standard hard wiring (i.e., voltage/current carrying lines). Accordingly, the AIU 18 can be connected to a wide range of accessories in any configuration desired by the user, details of which will be discussed below.

The AIU 18 functions to operate the various accessories (i.e., turn on/off) in response to user commands on the remote control 16. Specifically, when a user enters a command to turn on a street light, for example, the remote control 16 will output an RF signal to the TIU 12. In turn, the TIU 12 will output the command via the connection (phone line or conventional power line) to the AIU 18. The AIU 18 will then switch on/off the appropriate relay 181 coupled to the selected accessory to thereby turn on/off power to the selected accessory.

When a user first connects the AIU 18 to the track layout 10, he/she has the option to select any combination of accessories to be simultaneously switched with each respective relay 181. For example, the user can couple one relay 181 to a series of street lights (see FIG. 17*a*) distributed throughout the track layout 10. In addition, the user can couple another relay to a track switches for changing the train path in the layout 10. Accordingly, the user can couple each of the relays marked, for example, 1–20, to a different series of accessories. Moreover, the combinations are not limited to the same type of accessories for each relay 181. In other words, a single given relay 181 can be coupled to a street light, a crossing gate, and a track switch. It is quickly apparent that the number of combinations are endless, thereby limiting the user in creating a personal track layout 10 only to the extent of his/her imagination.

Once the user couples the desired relays 181 to the respective accessories throughout the track layout 10, the user will then store into memory (either TIU flash memory 125 or remote control flash memory 163') the respective configuration. For example, if a user couples relay #1 to all the street lights in the track layout 10, the user will then input into the remote control 16 that relay #1 will turn on all street lights.

The remote control 16 includes push-buttons 162 with alphanumeric characters printed thereon. Accordingly, when programming a particular relay 181, the user will be able to name the respective category of accessories that the particular relay 181 will switch on. The user can then store in memory the specific name the user chooses to identify each configuration. That way, the user can simply scroll through the stored names using the thumb-wheel 161 on the remote control 16, and select the name which matches the accessories the user wants to turn on. For example, let's assume a user couples relay #1 to all the street lights, relay #2 to the track switches on the southern part of the track layout 10, and relay #3 to all the crossing gates on the track layout 10. Using the push-buttons 162 with the alphanumeric characters printed thereon, the user can then spell out and store the names "All street lights" corresponding to relay #1, "Southern track switches" corresponding to relay #2, and "All crossing gates" corresponding to relay #3.

Anytime the user wants to operate, for example, the track switches located on the southern part of the track layout, he/she need only scroll through the stored list of "named" relays and select "Southern track switches", and the TIU 12 will send the appropriate signal to the AIU 18 corresponding to the selected relay 181, thereby powering and switching the track switches on the southern portion of the track layout 10.

Each relay 181 has a corresponding switch that is configured to be turned on/off based on the output signal from the TIU 12. For example, if a conventional power line is used for the connection between the AIU 18 and the TIU 12, then each relay 181 can be activated, and therefore identified, by a distinct voltage frequency. For example, if the user commands relay #1 to turn on, the TIU 12 will send out a voltage at 50 Hz, whereas if the user commands relay #2 to turn on, the TIU 12 will send out a voltage at 100 Hz. Accordingly, a different frequency will be applied to the AIU 18 from the TIU 12, depending on which relay 181 is commanded to be turned on. A three wire serial interface connection between the TIU 12 and AIU 18 may also be used, wherein one wire is a data line that is set to the value of the most significant bit of the data byte being sent. A clock line is then pulsed high then low to clock in the signal into an 8 bit shift register in the AIU 18. After 8 bits have been clocked in, the entire byte is clocked out by pulsing the third line, which is a latch. The data in the byte is therefore essentially 7 bits of address to get to the particular relay in the AIU that the user wishes to open or close and 1 bit to determine if the relay is being opened or closed.

Of course, various other "identifying" means can be used such as voltage amplitude, fiber optic signals (phone line connection), etc. The general concept remains the same; that is, each relay 181 will be configured to be triggered (i.e., turned on/off) by a "identification signal" sent from the TIU 12 in response to a user command to turn on a particular accessory.

As shown in FIG. 17*b*, it is contemplated that any number of AIUs 18 can be used for the track layout 10 of the present invention, although power constraints from the TIU 12 may limit the number of AIUs that can be connected to a single TIU 12. Up to five AIUs connected to a single TIU has been tested successfully at the present time, although it is anticipated that this number will improve in the future. Accordingly, a user can obtain a large number of relays 181 needed for creating the desired combinations of accessories that are to be turned on/off together. Along the same line, a plurality of TIUs 12 can also be coupled to the track layout 10, which is made possible by its unique electrical configuration. With any given set-up (e.g., AIUs 18 and TIUs 12), the user simply will identify and store the relays 181 into memory. It is clear that relay #1 of AIU #1 can easily be differentiated from relay #1 of AIU #2 by simply coding relay #1 of AIU #2 as relay #21 (on the assumption that AIU #1 has 20 relays).

It is contemplated that the AIUs 18 will have multiple inputs that can be monitored by the TIU 12. For example, infrared switches (so-called "infrared track activation devices (ITAD)") or mechanical contact switches may be connected to the AIU 18. When such a switch is opened or closed, a signal is passed from the AIU 18 to the TIU 12 so that the TIU 12 can activate a related action. For example, an ITAD (which functions as an infrared motion detector) may be placed near the track and wired to the AIU 18 such that when a train passes, the ITAD switches and this action is then passed to the TIU 12. The TIU 12, now knowing where the train is on the track, could then activate a crossing gate located elsewhere on the track. Any number of connection possibilities can be achieved in accordance with this feature of the present invention. For simplicity's sake, only one input to the AIUs 18 are shown in the figures.

The SCS of the present invention provides the user with a wide range of accessories for incorporation into the track layout 10 to further the conception of realism exuded by the track layout 10. For example, a user may add an accessory such as a passenger station with "people" waiting to board the approaching train, which will change into an empty passenger station after the "people" have boarded the train and the train moved on. By wiring the passenger station to an AIU 18, the user can operate a motor (not shown) to move the panel holding the passengers behind the roof of the station when a train leaves the passenger station, thereby creating a realistic portrayal of a true passenger station). Similarly, a freight station is also contemplated by the present invention, where cargo replaces the passengers. The operation to "hide" the cargo when a train leaves is similar to the passenger station.

It should be appreciated that many other types of accessories may be used with the present invention, including, but not limited to, houses with internal lighting, drive-thru restaurants, lights along the track, crossing-gates, flashing barricades, track switches (where two distinct tracks, indicating different paths, come together into one track and the track switch determines which track the train will go on), bridges with lighting, water towers, fire houses with firetrucks that go in and out from the track layout 10, billboards with speaker announcements, . . . etc.

Command Record

Another aspect of the present invention is the "record mode" for recording a list of commands inputted on the remote control 16 to be played back at a later time. A user can push a designated push-button 162 on the remote control 16 to initiate "record mode". Thereafter, the user can input any command (including actuation of any accessories) to drive the track layout 10. For example, the user can input a desired speed of 10 smph for two trains on the track in "command mode" of operation, a desired speed of 7 smph for the remaining trains on the track in "conventional mode", firing couplers, playing music, switch track switches, turn on street lights, etc. Each command inputted in the remote control 16 will be stored in the flash memory 125 of the TIU 12 (or alternatively, the commands can be stored in the flash memory 163' of the remote control).

When the user has finished his/her desired chronology of commands, the user will then push the appropriate push-button 162 to "stop recording". The user can then name the file and save it in a fashion similar to saving file names with respect to the accessories discussed above. Accordingly, the user will be able to "play-back" the commands at any time in the future by simply activating the stored file. This is done by scrolling through the remote control 16 using the thumb-wheel 161 and finding the file identified by the name given to it (e.g., "My favorite commands"). By activating the desired file name, the remote control 16 will then send the appropriate RF signal to the TIU 12, which will retrieve from its flash memory 125 the desired file and will automatically play back the list of commands as they were saved!

Saving commands in "record mode" can be accomplished in many modes. One mode is during actual real time operation. That is, while "record mode" is on, the user can input commands and operate the track layout 10 under normal conditions. The remote control 16 will function to operate the track layout in real time while simultaneously directing the TIU 12 to store each command, exactly as inputted in real time with the same time delay between commands, into its flash memory 125. When the user desires to stop recording, he/she simply presses the appropriate push-button 162 and thereafter names the file. At which point, the commands, as their were entered, will be stored in the flash memory 125 of the TIU 12 under the given file name. The user is then free to continue operating the track layout 10.

In another mode, the user can also "record" commands without operating the track layout 10. This provides many benefits, one of which is illustrated with the following example. Assume a daughter wants to surprise her mom for her birthday by playing "happy birthday" through the speaker 208" of one of the trains (via, e.g., a CD player) while driving the train towards her mom as she enters the room. If she was required to operate the train before the mom entered, the surprise would be ruined as the mom would hear the train moving.

Accordingly, the present invention allows the user to "record" into files several sets of commands very quickly and efficiently, as well as quietly (which will allow a user to continue "recording" during late night hours while others are sleeping). Even further, if a user desires to input certain time delays between commands (e.g., turning on 10 street lights at 10 minute intervals), the user can do so without waiting 100 minutes during actual operation to record such a command set.

Recording without operating the track layout can be accomplished in various manners. Most simply, the transformer could be physically de-coupled, or the TIU 12 could be physically de-coupled from the track layout 10. Alternatively, the TIU 12 can be commanded, via the remote control 16, to operate under "ignore mode". In "ignore mode", the TIU 12 will receive the entered commands from the remote control 16 and will save them in the flash memory 125 as discussed above, but will not forward the commands onto the track layout 10 and/or AIU 18. This can be effected by activating an open circuit, for example, via a transistor so that the TIU 12 is electrically de-coupled from the track layout 10 and/or the AIU 18.

TIU Power

Another aspect of the present invention is the capability to operate with any type of power source (i.e., power source 14) for powering the track layout 10. This capability is provided by the novel electrical configuration of the TIU 12. The TIU can be configured with multiple voltage inputs and voltage outputs. The voltage inputs may be fixed and/or variable. Similarly, the voltage outputs may be fixed and/or variable.

Accordingly, the TIU 12 is capable of receiving voltage from both DC (fixed) and AC (variable) power supplies. Thus, the SCS of the present invention can be operated by any commercial power source. Moreover, the TIU 12 is capable of receiving a fixed voltage regardless of the type of power source (e.g., an AC power source connected to a fixed voltage input will be converted to DC or to a different AC value). In the same manner, a received fixed voltage input can be converted to a variable output, thereby allowing the TIU 12 of the present invention to control track voltage independently of the power source 14. This allows the more archaic power sources that do not have RF capability (i.e., can not receive and transmit RF signals thereby not being capable of communicating directly with the remote control 16) to operate with the same features enjoyed using a power source 14 with RF capability. That is, a user can alter track voltage without needing to manually adjust the power source (e.g., manipulating a throttle on the power source). Moreover, with fixed voltage power sources, like a battery, previous TIU units would require replacing the battery for every different track voltage desired, which it can be quickly appreciated is impractical to say the least. By making the appropriate connections to the TIU 12 of the present invention, a single battery can be used while still enjoying the wide range of features of the present invention which require varying track voltage (e.g., changing speeds in legacy and conventional mode).

Operating Example

An example of the range of features and capabilities of the present invention will now be provided. This example is illustrative, not exhaustive.

A model train layout is connected as shown in FIG. 1. A model train is placed on the track. The user turns the power source up to full and leaves it there, indicating that the user is interested in operating in "command mode." Once the track is powered up, the trains automatically enter Command mode. The model train sends a data packet containing information about the model train (address, operating conditions, etc.). This information is retrieved by the user through the remote control and shown on the display unit (if desired).

Once powered up, the TIU regularly sends out a "watchdog" packet to the trains. If these watchdog packets are present on the track, the trains assume that Command mode remains the default mode. In the event the train ceases to receive the watchdog packets, the train assumes the user wishes to operate in conventional mode and disables the ability to receive Command mode commands. By this feature, each model train may be selected and "started up" independently. All model trains equipped with the engine board 20 are always "listening" to the track for data packets addressed to them, even when the trains appear to be dormant on the track.

The user is now ready to operate the train. The user first decides to turn on and test the train lights. By either pressing a button on the remote control dedicated to a particular light control, or scrolling through the commands on the remote control displayed on the display unit, the user turns on (and/or off) the various lights located on the model train, such as the head lights, marker lights, ditch lights, beacon lights, and cab interior lights. The light functions are independent of any train movement.

Next, the user decides to turn the model train's engine on. This is accomplished by entering the train address and the command "engine on" through the remote control. The model train responds with authentic "engine start-up" sounds. The user now desires the train to begin to traverse the track. The user enters a scale mile-per-hour command, and, if desired, an acceleration rate at which the user wants the model train to reach the desired scale mile-per-hour. For example, if the user wants the train to very slowly reach the desired speed, the user may enter a slow acceleration rate. Conversely, the user may want the train to reach the desired speed rapidly. A fast acceleration rate will then be entered.

The train will smoothly begin to move, and will eventually reach the desired speed. Once there, the speed control circuit maintains the constant speed, even as the train goes around curves and up and down hills.

The user may also desire that authentic sounds operate in conjunction with the desired speed. Thus, the user can enter a command that will correlate the engine "chuff" sound with the speed of wheel rotation. Another feature that may be correlated to the speed is the smoke output. If the train is moving slowly, the smoke output can be set to lightly puff or stream smoke (or steam) from the smokestack. If the user enters a new speed, for example, one that is faster than the previous speed, the sounds and smoke will automatically increase with the increase in speed. In other words, the engine "chuff" sound will become more rapid as the wheel rotation rate increases, and the amount of smoke or steam will increase, thereby simulating a harder working engine.

In addition to the engine sounds, the user may desire that other sounds be played simultaneously with the engine sounds. These may be sounds that are played randomly by the engine (with a command such as "random operating sounds"), or manually by the user entering each appropriate sound command, or by playing a customized sound sequence pre-recorded by the user. There are numerous such sounds available. A non-exhaustive list includes bells, whistles, horns, coupler slack sounds, clickety-clack sounds, cab chatter, freight yard sounds, passenger station sounds, train announcements, break sounds, maintenance sounds, dispatcher sounds, and many more. The system also allows the user to independently control the volume of multiple sounds (for example, the user can turn down the engine chuff sound, turn up the cab chatter, mute the whistle, and leave the passenger station sounds constant). The system also provides the user with a master volume control that allows the user to turn up, down, or mute all the active sounds at once.

The next feature the user wishes to activate is the Doppler sound effect. This is a one-button command on the remote control. The train sound system then activates the Doppler sound effect and the user hears a simulation of the growing and fading sounds of a train as it approaches and passes by. The realism of the Doppler sound effect can be heightened by programming it to occur at regular intervals. By so doing, the user can "time" the Doppler sound effect to coincide with each pass of the train by where the user is standing, for example.

The user now wishes to connect the model train to a consist. The user slows the train down by entering a new speed command. All sounds and smoke appropriately coincide with the change in speed. The user then hits the "coupler" button on the remote control and the coupler opens on the train (a sound file plays a coupler firing sound at the same time). The user can then bring the train into contact with the consist, the coupler on the consist is joined with the coupler on the train, and the train coupler closes upon joinder. The user can then, if desired, stop the train and reverse direction (both one-button controls). The user can enter another speed, and the train will pull away with the consist in tow.

The train, however, now has to work harder to pull the consist. This is reflected in the amount of smoke or steam is output, and in the engine sounds. The model train engine board monitors the amount of work the engine is expending in order to maintain the desired speed. As the amount of work increases, the model train will activate a new engine sound file that sounds "deeper" and more labored than when the train is moving without a load. The model train will also cause the smoke unit to produce a greater amount of smoke or steam, commensurate with the increased work load.

The user may now decide to activate some of the accessories. For example, the user may desire to turn on the lights at all the intersections. The user enters the command previously programmed by the user on the remote control (for example, "activate intersection lights." This command is passed from the remote control to the TIU to the AIU, which activates the appropriate relay corresponding to the intersection lights. The lights at all the intersections then turn on. Other accessories are controlled in a similar fashion, including layout switches, signal lights, crossing gates, and much more.

The user may now want to become the dispatcher for the train. The user presses the microphone button on the remote control. Certain sounds, such as the bell and whistle, are muted, while other sounds, such as chuffing, will remain in order to maintain a realistic operation. The user speaks into the microphone on the remote control, and the user's voice plays out the speaker on the model train, while the train moves around the track.

Next, the user desires to play a CD. The user enters the "proto-cast" command, which tells the system that sounds from an external source will now be input. The system mutes all other sounds and waits for input from the external source (such as a CD player or computer). The sounds are played from the external source and are streamed, in real time, down the tracks where they are picked up by the model train and played out the train speaker. The user can adjust the volume using the master volume control.

When the user is ready to end his or her session, the user enters a "stop" command. The train smoothly decelerates to zero miles per hour and comes to a stop. The user then enters an "engine off" command. The train responds with a series of extended "shutdown" sound effects. Engine lights can be automatically turned off or turned off manually by the user. Finally, the user asks the train for the total "scale miles" traversed by the engine. That information is passed from the train to the remote control and displayed on the display unit. The model train processor records and maintains the total amount of mileage for each session and the total for that particular engine. Thus, the user has an accurate account of the total "mileage" and run time in hours on that particular train, which is useful for managing the maintenance of the train.

The present invention has been described with reference to its preferred embodiments. It is noted that the present invention may be embodied in other forms without departing from the spirit or essential characteristics thereof. For example, the novel control system of the present invention, for exemplary purposes only, has been described in terms of model trains. However, it should be appreciated that the novel control system of the present invention has applicability to a wide range of model vehicles other than model trains, including, but not limited to, cars, buses, metro rails, airplanes (e.g., on the runway, or while flying using RF signals directly between the engine board of the plane and the hand-held remote), bicycles, etc. In short, any type of model vehicle that moves and can be independently controlled by a user can utilize the novel control system of the present invention. The present embodiments are therefore to be considered in all respects as illustrative and not restrictive, the scope of the invention being indicated by the appended claims, and all changes that come within the meaning and range of equivalency of the claims are therefore intended to be embraced therein.

What is claimed is:

1. An electrically operated model train coupler comprising:

a knuckle assembly movable between an open position and a closed position;

a movable plunger assembly mechanically couplable to said knuckle assembly, wherein said movable plunger assembly includes a cap configured to engage said knuckle assembly at a locking position of said plunger assembly for locking said knuckle assembly in said closed position;

a solenoid assembly for driving said movable plunger assembly toward or away from said locking position; and a guide member for guiding said cap toward and away from said locking position.

2. The coupler of claim 1, wherein application of a voltage to the solenoid assembly causes the solenoid assembly to generate a magnetic field which attracts the plunger assembly, thereby causing the plunger assembly to move toward or away from said locking position.

3. The coupler of claim 2, wherein the applied voltage to the solenoid assembly is less than or equal to approximately 6 volts.

4. The coupler of claim 1, wherein said guide member and said cap are configured to be in bearing contact.

5. An electrically operated coupler, comprising:

a knuckle assembly movable between an open position and a closed position;

a plunger assembly mechanically couplable to said knuckle assembly; and a solenoid assembly having a central hollow portion for receiving at least a portion of said plunger assembly, at least a portion of said solenoid assembly includes ferromagnetic material adapted to define at least a portion of a magnetic circuit for driving said plunger assembly, wherein said plunger assembly includes a plastic plunger cap adapted to selectively contact a portion of said knuckle assembly.

6. The electrically operated coupler of claim 5, wherein said solenoid assembly comprises a driver part and a housing assembly for housing said driver part, wherein said at least a portion of said solenoid assembly includes at least a part of said housing assembly.

7. The electrically operated coupler of claim 6, wherein said housing assembly includes at least one element selected from the group consisting of a sleeve at least partially surrounding said driver part, a back end positioned on one longitudinal end of said driver part, a forward end positioned on another end of said driver part, and a bobbin positioned at least on an inner surface of said driver part within said central hollow portion.

8. The electrically operated coupler of claim 7, wherein said housing assembly includes each of said sleeve, said back end and said forward end, wherein said housing assembly includes sufficient ferromagnetic material so as to form a closed magnetic circuit.

9. The electrically operated coupler of claim 8, wherein said sleeve, said back end and said forward end are each made from ferromagnetic material.

10. The electrically operated coupler of claim 5, wherein at least a portion of said plunger assembly moves within said central hollow portion, said solenoid assembly includes a plastic bobbin surrounding said central hollow portion, said plastic bobbin adapted to contact said at least a portion of said plunger assembly.

11. The electrically operated coupler of claim 5, wherein said solenoid assembly comprises a driver part and a housing assembly for housing said driver part, said housing assembly includes a forward end positioned between said driver part and said knuckle assembly, said plunger assembly includes a biasing spring positioned between said forward end and said knuckle assembly.

12. The electrically operated coupler of claim 5, wherein said solenoid assembly comprises a driver part and a back end positioned on one longitudinal end of said driver part, and said plunger assembly includes a plunger having a conical end, wherein said back end includes a corresponding conical cut-out portion facing said conical end such that during operation a portion of said conical end can be surrounded by said conical cut-out portion.

13. The electrically operated coupler of claim 5, wherein said knuckle assembly includes a spring for biasing said knuckle assembly into the open position.

14. The electrically operated coupler of claim 5, wherein said plunger assembly includes a spring for biasing the plunger towards the knuckle assembly.

15. An electrically operated coupler comprising:

a knuckle assembly movable between an open position and a closed position;

a plunger assembly mechanically couplable to said knuckle assembly; and a solenoid assembly having a central hollow portion for receiving at least a portion of said plunger assembly, at least a portion of said solenoid assembly includes ferromagnetic material adapted to define at least a portion of a magnetic circuit for driving said plunger assembly, wherein said plunger assembly includes a plunger end adapted to move within said central hollow portion, and said solenoid assembly comprises a driver part and a housing assembly for housing said driver part, said housing assembly includes a back end positioned on an end of said driver part so as to face said plunger end, wherein said plunger assembly includes a plunger cap configured to prevent contact between said plunger end and said back end.

16. An electrically operated coupler comprising:

a knuckle movable between an open position and a closed position;

a movable plunger mechanically couplable to said knuckle, plunger includes an increased diameter portion configured to engage said knuckle at a locking position of said plunger for locking said knuckle in said closed position;

a solenoid for driving said movable plunger toward or away from said locking position; and a guide member for guiding said portion toward and away from said locking position.

* * * * *